US012102275B2

(12) United States Patent
DeJonge et al.

(10) Patent No.: US 12,102,275 B2
(45) Date of Patent: Oct. 1, 2024

(54) SURFACE CLEANER

(71) Applicant: BISSELL Inc., Grand Rapids, MI (US)

(72) Inventors: Mitchell J. DeJonge, Fruitport, MI (US); Ryan J. Alt, Byron Center, MI (US)

(73) Assignee: BISSELL Inc., Grand Rapids, MI (US)

( * ) Notice: Subject to any disclaimer, the term of this patent is extended or adjusted under 35 U.S.C. 154(b) by 0 days.

(21) Appl. No.: 18/307,923

(22) Filed: Apr. 27, 2023

(65) Prior Publication Data

US 2023/0363612 A1 Nov. 16, 2023

Related U.S. Application Data

(60) Provisional application No. 63/341,604, filed on May 13, 2022.

(51) Int. Cl.
*A47L 11/40* (2006.01)
*A47L 9/00* (2006.01)
(Continued)

(52) U.S. Cl.
CPC ..... *A47L 11/4055* (2013.01); *A47L 9/009* (2013.01); *A47L 9/0411* (2013.01); *A47L 9/0444* (2013.01);
(Continued)

(58) Field of Classification Search
CPC .... A47L 11/4055; A47L 9/009; A47L 9/0411; A47L 9/0444; A47L 9/0455;
(Continued)

(56) References Cited

U.S. PATENT DOCUMENTS 2,416,420 A * 2/1947 Taylor ..... A47L 5/34 15/372
2,477,079 A 7/1949 Mueller
(Continued)

FOREIGN PATENT DOCUMENTS

CA 604809 A 9/1960
CN 1984593 B 6/2007
(Continued)

OTHER PUBLICATIONS

U.S. Appl. No. 63/297,851, entitled Surface Cleaning Apparatus with Steam, filed Jan. 10, 2022.
(Continued)

*Primary Examiner* — David Redding
(74) *Attorney, Agent, or Firm* — Quinn IP Law

(57) ABSTRACT

A surface cleaner may have various features including an engagement mechanism secured to an agitator support frame and positioned to be pivoted by an agitator lift lever as the agitator lift lever translates, the pivoting engagement mechanism lifting the agitator support frame and the agitator secured thereto from a lowered position to a raised position. Other features may include a projection to limit belt slack when the agitator assembly is raised, a compact detent mechanism for releasing a spine assembly in an upright surface cleaner, a compact motor drive assembly, a self-priming centrifugal pump, a fluid-dispensing system having a high flow operating state and a low flow operating state, and a clean-out tray in which a base of the surface cleaner may be docked.

15 Claims, 26 Drawing Sheets

(51) Int. Cl.
*A47L 9/04* (2006.01)
*A47L 11/30* (2006.01)

(52) U.S. Cl.
CPC ..... *A47L 9/0455* (2013.01); *A47L 9/0477* (2013.01); *A47L 9/0494* (2013.01); *A47L 11/302* (2013.01); *A47L 11/4041* (2013.01); *A47L 11/4069* (2013.01); *A47L 11/4075* (2013.01)

(58) Field of Classification Search
CPC .... A47L 9/0477; A47L 9/0494; A47L 11/302; A47L 11/4041; A47L 11/4069; A47L 11/4075; A47L 5/225; A47L 11/34; A47L 11/4058; A47L 5/34; A47L 11/282; A47L 11/32; A47L 11/4063; A47L 11/4091; A47L 2201/00; A47L 2201/02; A47L 2201/04
See application file for complete search history.

(56) References Cited

U.S. PATENT DOCUMENTS

| | | | |
|---|---|---|---|
| 2,951,449 | A | 9/1960 | Van Blarcom, Jr. et al. |
| 4,637,778 | A | 1/1987 | Pollari |
| 6,131,237 | A | 10/2000 | Kasper et al. |
| 6,438,793 | B1 | 8/2002 | Miner et al. |
| 8,414,257 | B2 | 4/2013 | Scott et al. |
| 9,186,028 | B2 | 11/2015 | White et al. |
| 10,188,252 | B2 | 1/2019 | Nguyen et al. |
| 10,238,260 | B2 | 3/2019 | Lenkiewicz et al. |
| 10,820,769 | B2 | 11/2020 | Xia et al. |
| 11,166,610 | B2 | 11/2021 | Nguyen |
| 2018/0168419 | A1 | 6/2018 | Johnson et al. |
| 2018/0263444 | A1 | 9/2018 | Krebs |
| 2020/0093344 | A1 | 3/2020 | Quintero et al. |
| 2020/0214526 | A1 | 7/2020 | Huang et al. |
| 2020/0214527 | A1 | 7/2020 | Resch et al. |
| 2020/0253446 | A1 | 8/2020 | Gilbert et al. |
| 2022/0015597 | A1 | 1/2022 | Nguyen et al. |
| 2022/0218167 | A1 | 7/2022 | Lenkiewicz et al. |

FOREIGN PATENT DOCUMENTS

| | | | |
|---|---|---|---|
| CN | 103122860 | A | 5/2013 |
| CN | 106351881 | A | 1/2017 |

OTHER PUBLICATIONS

U.S. Appl. No. 63/305,723, entitled Extraction Cleaner With Steam, filed Feb. 2, 2022.
Zhejiang Yili Machinery & Electric Co., Ltd. Portable Carpet Cleaner, https://www.yilielectric.com/product/detail91.htm, accessed Jun. 17, 2022.
Hoover®, CleanSlate Pet Carpet & Upholstery Spot Cleaner, https://hoover.com/products/cleanslate-pet, accessed Jun. 17, 2022.
Bissell®, Rinse & Storage Tray ProHeat 2X®Revolution Pet Pro®, https:/www.bissell.com/nnsestorage-tray-proheat-2x-revolution-pet-pro-.

* cited by examiner

SURFACE CLEANER

CROSS-REFERENCE TO RELATED APPLICATIONS

This application claims the benefit of priority to U.S. Provisional Application No. 63/341,604, filed May 13, 2022 which is incorporated by reference in its entirety.

TECHNICAL FIELD

The present disclosure generally relates to a surface cleaner for cleaning a surface.

BACKGROUND

There are many types of surface cleaners, some of which may employ suction and/or a fluid to clean a surface. One category of surface cleaner is referred to as an upright cleaner. Some surface cleaners, including some upright cleaners, may be extraction cleaners that extract dirt from a surface using both a vacuum system to suction debris and/or fluid from a surface and a fluid delivery system.

BRIEF SUMMARY

A surface cleaner with various improvements is disclosed herein. The surface cleaner may be, but is not limited to, an upright extraction cleaner. The surface cleaner may be equipped to lift agitators away from the surface to be cleaned in certain modes. In an example, the surface cleaner may include a base configured for movement across a surface to be cleaned. The base may include a base housing defining an agitator chamber, an agitator assembly housed in the agitator chamber, and an agitator lift lever supported on the base housing and translatable relative to the base housing between a forward position and a rearward position. The surface cleaner may include a spine assembly for directing the base across the surface to be cleaned. The spine assembly may be pivotably connected to the base and pivotable relative to the base about a pivot axis between a first position and a second position. The agitator assembly may include an agitator support frame and a rotatable agitator rotatably supported on the agitator support frame. The spine assembly may be configured to operatively engage the lever and translate the lever from the forward position to the rearward position when the spine assembly is pivoted from the second position to the first position. An engagement mechanism may be secured to the agitator support frame and positioned to be pivoted by the agitator lift lever as the agitator lift lever translates to the rearward position, the pivoting engagement mechanism lifting the agitator support frame and the agitator secured thereto from a lowered position to a raised position, the agitator being further from the surface to be cleaned in the raised position than in the lowered position.

A surface cleaner within the scope of the disclosure may be equipped to prevent slack in a drive belt when the agitator is lifted. For example, a surface cleaner may include a base configured for movement across a surface to be cleaned, the base may include a base housing defining an agitator chamber, and an agitator assembly housed in the agitator chamber. The surface cleaner may include a spine assembly for directing the base across the surface to be cleaned. The spine assembly may be pivotably connected to the base and pivotable relative to the base about a pivot axis between a first position and a second position. The first position may be relatively upright with respect to the base and the second position may be relatively reclined with respect to the base. The agitator assembly may include an agitator support frame, a rotatable agitator rotatably supported on the agitator support frame, and a sprocket supported for rotation with the rotatable agitator about an agitator axis. The agitator support frame and the rotatable agitator supported thereon may lift from a lowered position to a raised position when the spine assembly is pivoted from the second position to the first position, with the rotatable agitator being further from the surface to be cleaned in the raised position than in the lowered position. The surface cleaner may include a drive assembly including a motor-driven shaft, a belt engaged with both the motor-driven shaft and with the sprocket for rotating the agitator about the agitator axis. A projection may extend from the base housing in the agitator chamber and may have a belt-engaging surface. The belt may be spaced apart from the belt-engaging surface when the agitator assembly is in the lowered position, and the belt may be disposed against the belt-engaging surface when the agitator assembly is in the raised position. In some examples, the projection may cause a path of the belt to have the same length in both the lowered and the raised position so that slack is prevented while tension in the belt remains unchanged.

A surface cleaner within the scope of the disclosure may have a release button and detent mechanism of a compact design and that are configured to protect internal chambers of the base housing from external debris and liquid while releasably retaining a spine assembly in an upright position. For example, a surface cleaner may include a base configured for movement across a surface to be cleaned, the base including a base housing, and a spine assembly for directing the base across the surface to be cleaned. The spine assembly may be pivotably connected to the base and pivotable relative to the base about a pivot axis between a first position and a second position. The first position may be relatively upright with respect to the base and the second position may be relatively reclined with respect to the base. A detent mechanism may be configured to selectively retain the spine assembly in the first position. The detent mechanism may include a catch operatively secured to a lower shell of the spine assembly, a pivot arm pivotably secured to the base housing, and a spring biasing the pivot arm against the catch when the spine assembly is in the first position. The detent mechanism may also include a release button that may be mounted to the base housing and may be depressible against the pivot arm to pivot the pivot arm away from the catch and against the spring, releasing the pivot arm from the catch, allowing the spine assembly to be pivoted to the second position. With this configuration, the pivot arm may be fully housed within the base housing, and an opening for the release button may have a smaller footprint on the base housing.

A surface cleaner within the scope of the disclosure may have a motor drive assembly that is compact in size but still manages loads and allows access to belts as may be necessary for belt replacement, for example. The surface cleaner may include a base that has a base housing defining an agitator chamber, and an agitator assembly supported by the base housing in the agitator chamber and including a rotatable agitator. The surface cleaner may include a drive assembly operative for rotating the agitator about an agitator axis. The drive assembly may include a motor having a motor shaft defining a motor axis, and an intermediate shaft disposed between the agitator and the motor shaft and defining an intermediate axis parallel to the agitator axis and the motor axis. A first bearing assembly and a second bearing assembly may be mounted to the base housing and may rotatably support the intermediate shaft. A first belt may be operatively engaged with the intermediate shaft between the first bearing assembly and the second bearing assembly, and the first belt may also be operatively engaged with the motor shaft. A second belt may be operatively engaged with the intermediate shaft at an end of the intermediate shaft with the first bearing assembly between the second belt and the first belt, and the second belt operatively engaged with the agitator. In this configuration, with the first belt disposed between the two bearing assemblies, a cantilever loading effect present when both bearing assemblies are on one side of the belt is avoided, which may allow for a reduction in overall length of the drive assembly.

In an implementation of the drive assembly, in order to allow access to the first belt and to the pulley on which it is mounted, which is between the bearing assemblies, the first bearing assembly may include a slotted, annularly-mounted bearing support that is configured to provide such access. For example, a first pulley may be disposed on the intermediate shaft between the first bearing assembly and the second bearing assembly, with the first belt engaged with the first pulley. The first bearing assembly may include a bearing housing fixed to the base housing and surrounding the intermediate shaft. The bearing housing may include a through hole through which the intermediate shaft extends. An annularly-mounted bearing holder may be supported by the bearing housing in a first wall of the bearing housing at the through hole and may be rotatable relative to the bearing housing. The annularly-mounted bearing holder may have a slot, and the bearing housing may have a window that extends to the through hole. The slot may be in communication with the window during a portion of a rotation of the annularly-mounted bearing holder. The slot and the window may be sized to permit the first belt to be routed around and engaged with the first pulley.

A surface cleaner within the scope of the disclosure may include a self-priming centrifugal pump that avoids the need for external components to prime the pump, minimizing packaging space within the surface cleaner. The surface cleaner may include a base configured for movement across a surface to be cleaned, the base including a base housing. The surface cleaner may include a fluid-dispensing system operable for delivering fluid to the surface to be cleaned. The fluid-dispensing system may include a centrifugal pump mounted in the base housing. The centrifugal pump may include a casing having an inlet through which fluid is drawn, and an outlet through which fluid is discharged. The casing may further include a volute scroll in fluid communication with the inlet, an expansion chamber in communication with the outlet, a throat fluidly connecting the volute scroll with the expansion chamber, and a weep hole fluidly connecting the expansion chamber with the volute scroll. The centrifugal pump may include an impeller configured to rotate in the volute scroll to pump fluid from the inlet to the outlet through the throat and the expansion chamber, with fluid in the expansion chamber separating from air in the expansion chamber and returning to the volute scroll through the weep hole, priming the centrifugal pump. In some implementations, a ratio of a cross-sectional area of the throat to a cross-sectional area of the outlet may be from about 1.35 to 1.55. In the same implementation or in a different implementation, a ratio of a volume of the volute scroll to a cross-sectional area of the outlet may be from about 175 to 195. With these particular ratios, the centrifugal pump may operate to provide sufficient pressure at the outlet while maintaining a self-primed flow at the volute scroll. In some implementations, the centrifugal pump may be driven on the intermediate shaft of the motor drive assembly discussed herein.

A surface cleaner within the scope of the disclosure may include a fluid-dispensing system that enables selection of a low flow operating state or a high flow operating state by utilizing an electrically-controlled centrifugal pump and a pressure valve configured to open under a predetermined fluid pressure. For example, the surface cleaner may include a fluid-dispensing system operable for delivering fluid to a surface to be cleaned. The fluid-dispensing system may include a fluid supply, an electric motor, and a centrifugal pump configured to be driven by the electric motor and having an inlet and an outlet. The inlet may be in fluid communication with the fluid supply. A pump control switch may be operatively connected to the centrifugal pump. The pump control switch may have an on state and an off state. The centrifugal pump may be off when the pump control switch is in the off state, and the centrifugal pump may be on when the pump control switch is in the on state. The fluid-dispensing system may include a pressure valve in fluid communication with the outlet. The pressure valve may have a first flow area under fluid pressure less than a predetermined fluid pressure, and a second flow area greater than the first flow area under fluid pressure greater than or equal to the predetermined fluid pressure. The fluid pressure at the pressure valve is less than the predetermined fluid pressure when the centrifugal pump is off, and is greater than or equal to the predetermined fluid pressure when the centrifugal pump is on. Fluid from the fluid supply may drain through the centrifugal pump to reach the pressure valve when the pump control switch is in the off state.

A clean-out system for use with a surface cleaner within the scope of the disclosure may include a tray in which a base of the cleaner may be docked for cleanout of agitators, such as brush rolls. The tray may be configured for easy use that minimizes spilling or splashing of cleaning fluid. For example, a clean-out system for use in cleaning out an agitator assembly of a surface cleaner may include a docking tray defining a reservoir and a filling trough, with a wall of the docking tray separating the reservoir from the filling trough. The docking tray may be configured to support a base of the surface cleaner with an agitator assembly included in the base disposed at the reservoir. The docking tray may define a channel extending through the wall and connecting the reservoir with the filling trough. The docking tray may be configured such that fluid poured into the filling trough flows into the reservoir through the channel. Accordingly, a user can fill the main reservoir by pouring cleaning fluid into the filling trough while the base is docked in the tray.

A surface cleaner within the scope of the disclosure may include a base configured for movement across a surface to be cleaned, and a spine assembly operatively connected to the base for directing the base across the surface to be cleaned; wherein the spine assembly includes a frame having an aperture. The surface cleaner may further include a recovery tank for collecting liquid received from a mixed air and liquid stream generated in the base. The recovery tank may have a bottom wall, and a plurality of side walls extending upward from the bottom wall that define a tank chamber with a top opening. The surface cleaner may further include a lid, a handle, and a spring-biasing mechanism. The recovery tank, lid, handle, and spring-biasing mechanism may be referred to as a recovery tank assembly. The lid may be securable to the recovery tank to extend over the top opening. The lid may have a top wall with a top window and a side wall with a side window. The handle may be pivotably connected to the lid and pivotable between a lowered position and a lifted position. A spring-biased mounting mechanism may be operable to selectively secure the lid to the frame. The spring-biased mounting mechanism may include a body having a top projection extending upward through the top window and biased to an extended position, and a side arm extending sideways through the side window. The recovery tank may be configured to fit to the frame with the lid secured to the recovery tank and the top projection extending in the aperture of the frame when the handle is in the lifted position. The handle may interfere with the side arm when pivoted to the lowered position, moving the side arm downward in the side window and simultaneously moving the top projection downward through the top window to withdraw the top projection from the aperture and allow the recovery tank to be removed from the frame.

A surface cleaner within the scope of the disclosure may include a base configured for movement across a surface to be cleaned, and an air/liquid separation system for separating liquid and air in the working air/liquid stream. The air/liquid separation system may include a recovery tank for collecting liquid received from a mixed air and liquid stream generated in the base. The recovery tank may have a bottom wall, and a plurality of side walls extending upward from the bottom wall and defining a tank chamber with a top opening. The air/liquid separation system may further include a lid securable to the recovery tank to extend over the top opening, a plurality of vertical walls disposed within the tank chamber and defining an inlet stack and an outlet stack, and a float disposed within the tank chamber and operatively attached to and vertically translatable relative to the lid. The bottom wall may have an inlet opening at a bottom of the inlet stack through which the mixed air and liquid stream is introduced, and an outlet opening at a bottom of the outlet stack through which separated air is discharged from the recovery tank. The lid may include a top wall and a bottom wall with a lid chamber therebetween. The bottom wall may have a first lid chamber opening in selective fluid communication with the tank chamber and serving as a tank chamber air outlet, and a second lid chamber opening at an inlet of the outlet stack. The float may be configured to close the first lid chamber opening when liquid within the tank chamber reaches a predetermined level. The lid and attached float may be removable from the recovery tank as a unit, with the plurality of vertical walls that define the inlet stack and the outlet stack remaining in the tank chamber when the lid and attached float are removed.

A surface cleaner within the scope of the disclosure may include a base configured for movement across a surface to be cleaned and may comprise a fluid-dispensing system operable for delivering fluid to the surface to be cleaned. The fluid-dispensing system may include a heater operable for generating steam and having a steam outlet. The fluid-dispensing system may also include a dispenser having a dispenser outlet through which the steam is distributed to the surface to be cleaned, and a conduit path through which the steam travels from the steam outlet to the dispenser. The conduit path may have a conduit inlet at the steam outlet of the heater and a conduit outlet at the dispenser. The conduit inlet may be disposed further above the surface to be cleaned than the conduit outlet when the base is resting on the surface in a use position. In such a configuration, the steam will not cool and pool within the conduit path when the heater and/or the cleaner are off, for example.

BRIEF DESCRIPTION OF THE DRAWINGS

The drawings described herein are for illustrative purposes only, are schematic in nature, and are intended to be exemplary rather than to limit the scope of the disclosure.

The above features and advantages and other features and advantages of the present teachings are readily apparent from the following detailed description of the modes for carrying out the present teachings when taken in connection with the accompanying drawings. It should be understood that even though in the following Figures embodiments may be separately described, single features thereof may be combined to additional embodiments.

DETAILED DESCRIPTION

Figure 1:
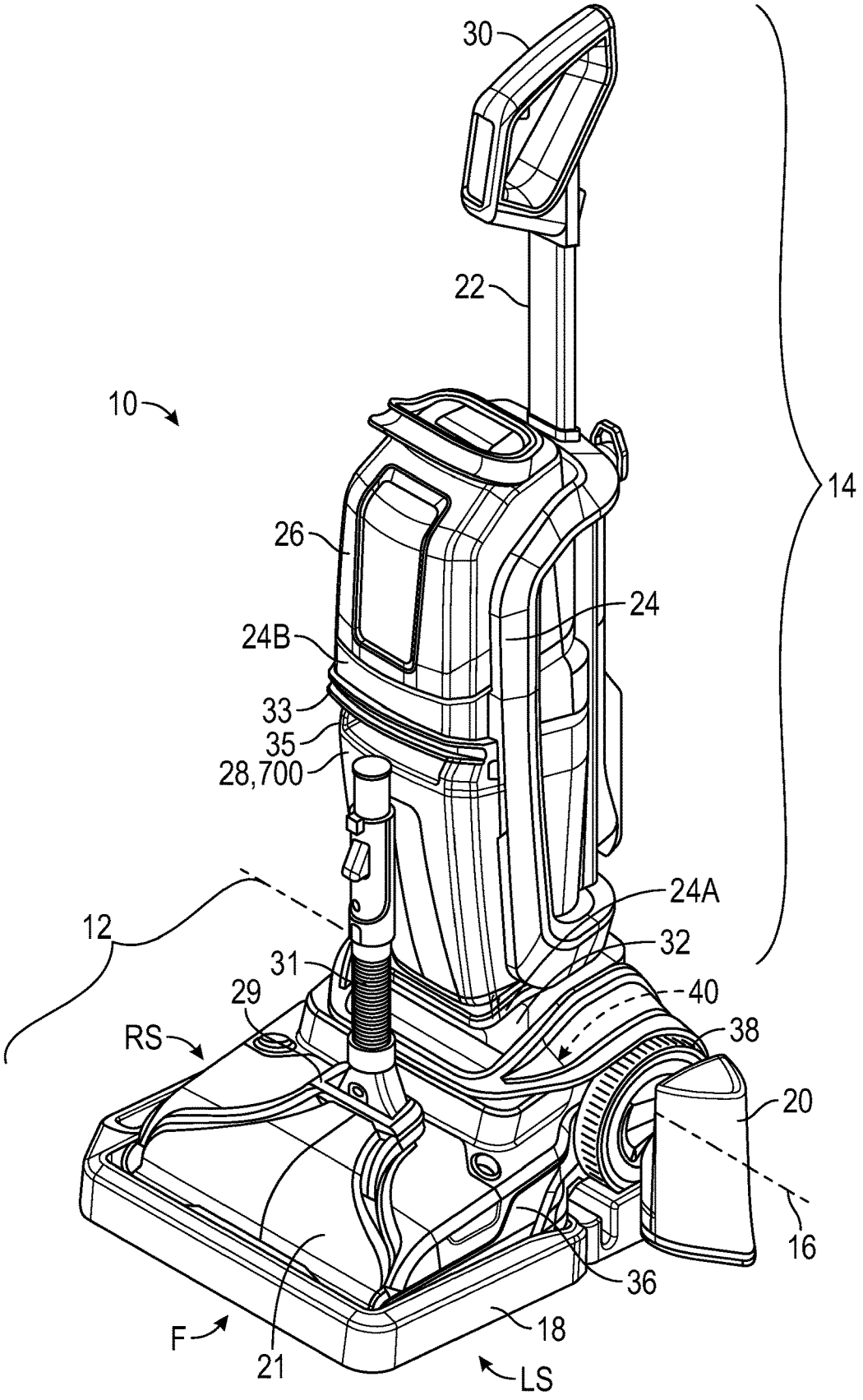
FIG. 1 is a perspective view of a surface cleaner with a base and a spine assembly, showing the spine assembly in an upright position.
Figure 2:
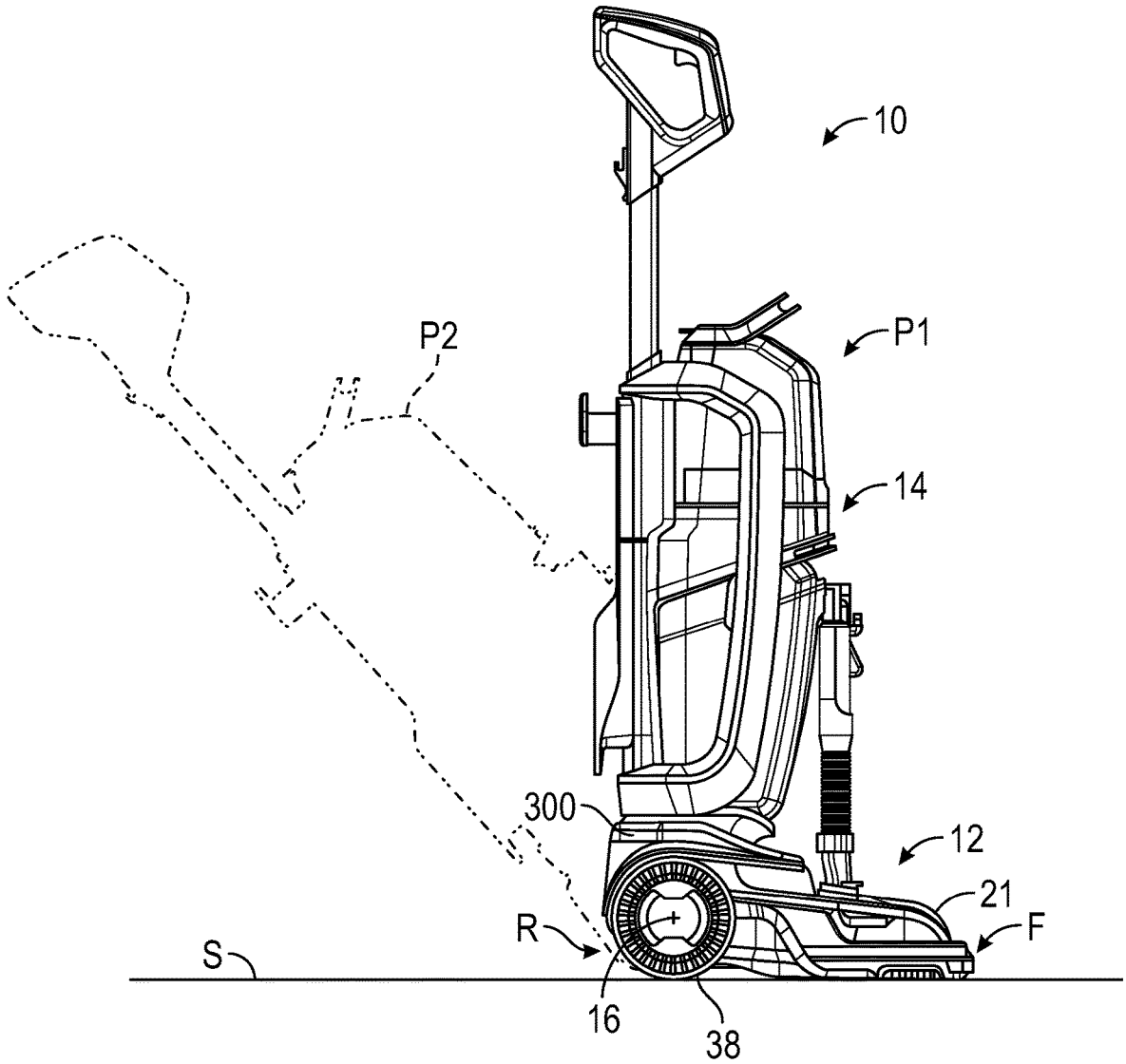
FIG. 2 is another side view of the surface cleaner and showing the spine assembly pivoted to a reclined position shown in phantom.

The present disclosure generally relates to a surface cleaner 10, such as shown in FIG. 1, and various aspects thereof for improved performance, compactness, ease of use, and other benefits. The surface cleaner 10 includes a base 12 and a spine assembly 14 pivotably connected to the base 12 and pivotable about a pivot axis 16 between a first position P1 and a second position P2. The first position P1 is also referred to as an upright position or a storage position and is shown in FIGS. 1 and 2. The second position P2 is also referred to as a use position or a reclined position, and is shown in phantom in FIG. 2, in which the spine assembly 14 is pivoted rearwardly to form an acute angle with a surface S to be cleaned. In FIG. 1, the base 12 is shown docked or parked in a docking tray 18. A fill cup 20 is shown supported on the docking tray 18. The base 12 is removed from the docking tray 18 in FIG. 2 for use in cleaning the surface S. The surface S may be, for example, any type of flooring, including soft surfaces, such as carpet and rugs, and hard surfaces, such as tile, wood, vinyl, and laminate surfaces. According to some aspects, the surface cleaner 10 may be in the form of an upright deep cleaner, also referred to as an extraction cleaner, which is configured for use on soft flooring surfaces, such as carpets and rugs. However, the aspects disclosed herein may be implemented on other types and configurations of cleaning apparatuses within the scope of the disclosure. The surface cleaner 10 can comprise various systems and components including a dual-phase fluid delivery system, a liquid delivery system, and a recovery system. These various systems and components can be supported by either or both the base 12 and the spine assembly 14.

For purposes of description related to the figures, the terms "upper," "lower," "right," "left," "rear," "front," "vertical," "horizontal," "inner," "outer," and derivatives thereof shall relate to the disclosure as oriented in FIG. 2 from the perspective of a user behind the surface cleaner 10 (e.g., to the left of the surface cleaner 10 in FIG. 2), which defines the rear R of the surface cleaner 10. However, it is to be understood that the disclosure may assume various alternative orientations, except where expressly specified to the contrary. The front F of the surface cleaner 10 is also indicated in FIG. 2 and is at a nozzle 21. A left side LS of the surface cleaner 10 is indicated in FIG. 1, as is a right side RS.

The spine assembly 14 can include any type of handle 22, wand, body, or combination thereof suitable for the purposes described herein, including for a user to maneuver the surface cleaner 10 over the surface S to be cleaned. The handle 22 extends upwardly from the frame 24 and is provided with a hand grip 30 at one end that can be used for maneuvering the surface cleaner 10 over the surface S to be cleaned.

In one embodiment, the spine assembly 14 includes a main support section or frame 24 (also referred to as a spine) supporting components of the surface cleaner 10, including, but not limited to, a recovery tank 28 for recovering dirty fluid and that is part of a recovery system, and a supply tank 26 for supplying cleaning fluid, and that is part of a liquid delivery system. An accessory hose port 29 is in fluid communication with the recovery system in an upper portion of the suction nozzle 21 for selectively coupling with an accessory hose 31 to which cleaning tools may be attached. The accessory hose port 29 includes a door (not shown) selectively moveable between a closed position and an open position for coupling the accessory hose 31. An exemplary accessory hose coupling system is described in U.S. Pat. No. 10,188,252, entitled "Surface Cleaning Apparatus," issued on Jan. 29, 2019 and assigned to BISSELL Inc., the contents of which are incorporated herein by reference in their entirety.

A motor housing 32 is formed at a lower end of the frame 24 and contains a suction source, such as a motor/impeller system, positioned therein in fluid communication with the suction nozzle 21 and the recovery tank 28. The recovery system can include the suction nozzle 21, the suction source in fluid communication with the suction nozzle 21 for generating a working air stream, and the recovery container 28 for separating and collecting fluid and debris from the working airstream for later disposal. Other components of the spine assembly 14 may include, but are not limited to, a heater, pumps, a power source, and the like, or any combination thereof.

The base 12 can comprise any type of base, foot, or cleaning head suitable for the purposes described herein. In one embodiment, the base 12 includes a base housing 36 supporting components of various systems, including, but not limited to a steam dispenser, a liquid dispenser, a suction nozzle, and an agitator. In one example, the base 12 includes a dual-phase distribution system for dispensing steam, such as described in Applicant's co-pending application U.S. Provisional Patent Application No. 63/297,851, entitled "Surface Cleaning Apparatus with Steam", filed Jan. 10, 2022, the contents of which are incorporated herein by reference in their entirety. In an example, the surface cleaner 10 may include a plurality of cleaning modes including a mode in which both liquid and steam are dispensed, a mode in which only steam is dispensed, and a mode in which only liquid is dispensed, such as described in Applicant's co-pending application U.S. Provisional Patent Application No. 63/305,723, entitled "Extraction Cleaner With Steam", filed Feb. 2, 2022, the contents of which are incorporated herein by reference in their entirety. Wheels 38 can at least partially support the base housing 36 for movement over the surface S to be cleaned. Other components of the base 12 may include, but are not limited to, a heater, pumps, a motor for driving the agitator, a hose, a squeegee, and the like, or any combination thereof.

A moveable joint assembly 40 can connect the base 12 to the spine assembly 14 for movement of the spine assembly 14 about the pivot axis 16. For example, as discussed herein, the engagement wheels 104, 104A (see FIGS. 3 and 10) pivot with the remainder of the spine assembly 14 relative to the base housing 36. In the embodiment shown herein, the spine assembly 14 can pivot about the pivot axis 16 relative to the base 12. Alternatively, in some embodiments, a movable joint assembly connecting the base 12 to the spine assembly 14 can alternatively comprise a universal joint, such that the spine assembly 14 can swivel about its longitudinal axis in addition to pivoting relative to the base 12.

Wiring and/or conduits can optionally supply electricity, air, liquid and/or steam between the spine assembly 14 and the base 12, or vice versa, and can extend though the joint assembly 40. As such, in some embodiments, various systems can extend through the joint assembly 40. For example, a steam supply path and/or a liquid supply path can extend through the joint assembly 40.

Figure 3:
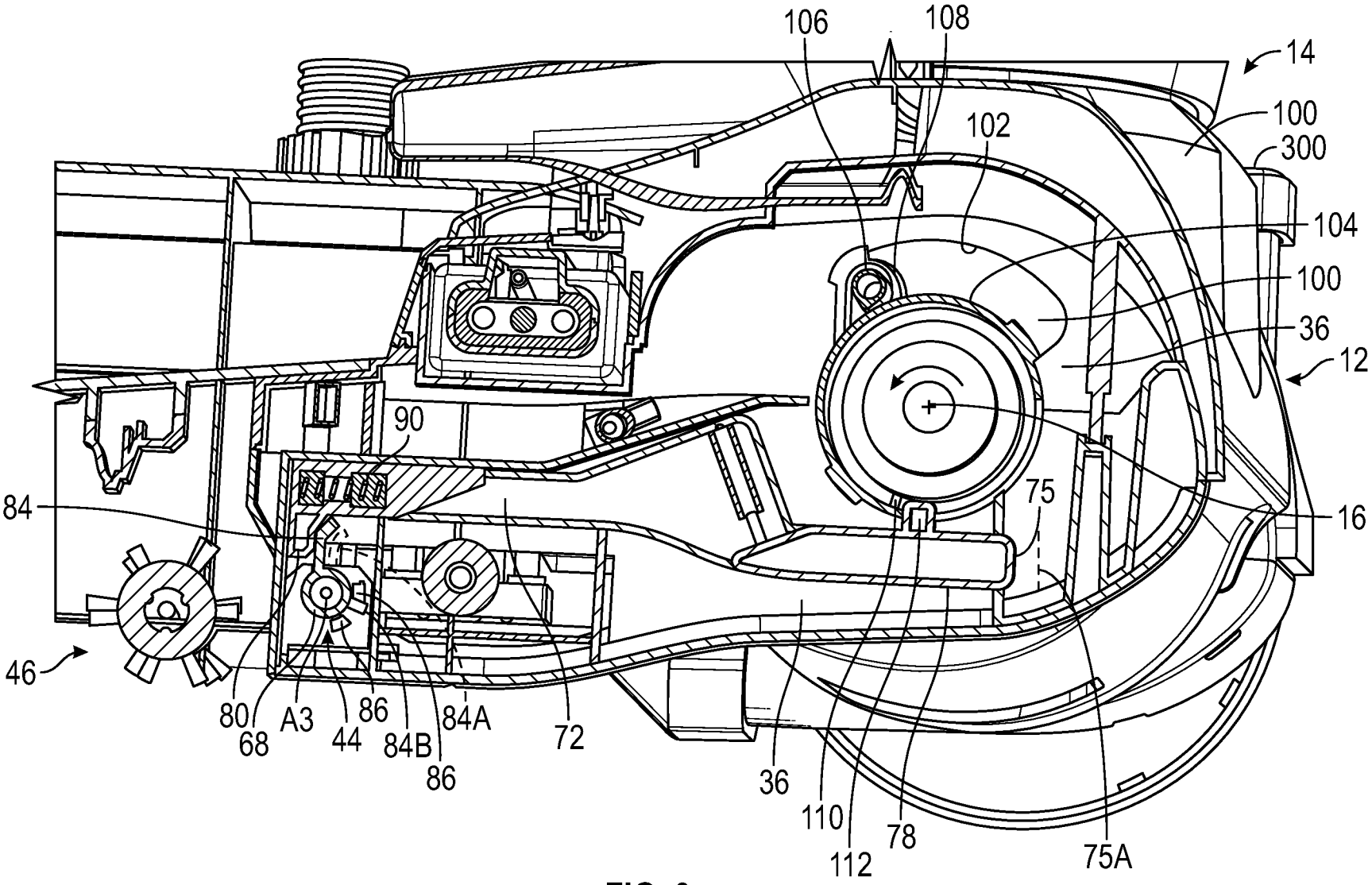
FIG. 3 is a fragmentary cross-sectional view of the base showing an agitator lifting mechanism for lifting an agitator assembly away from a surface to be cleaned.
Figure 6:
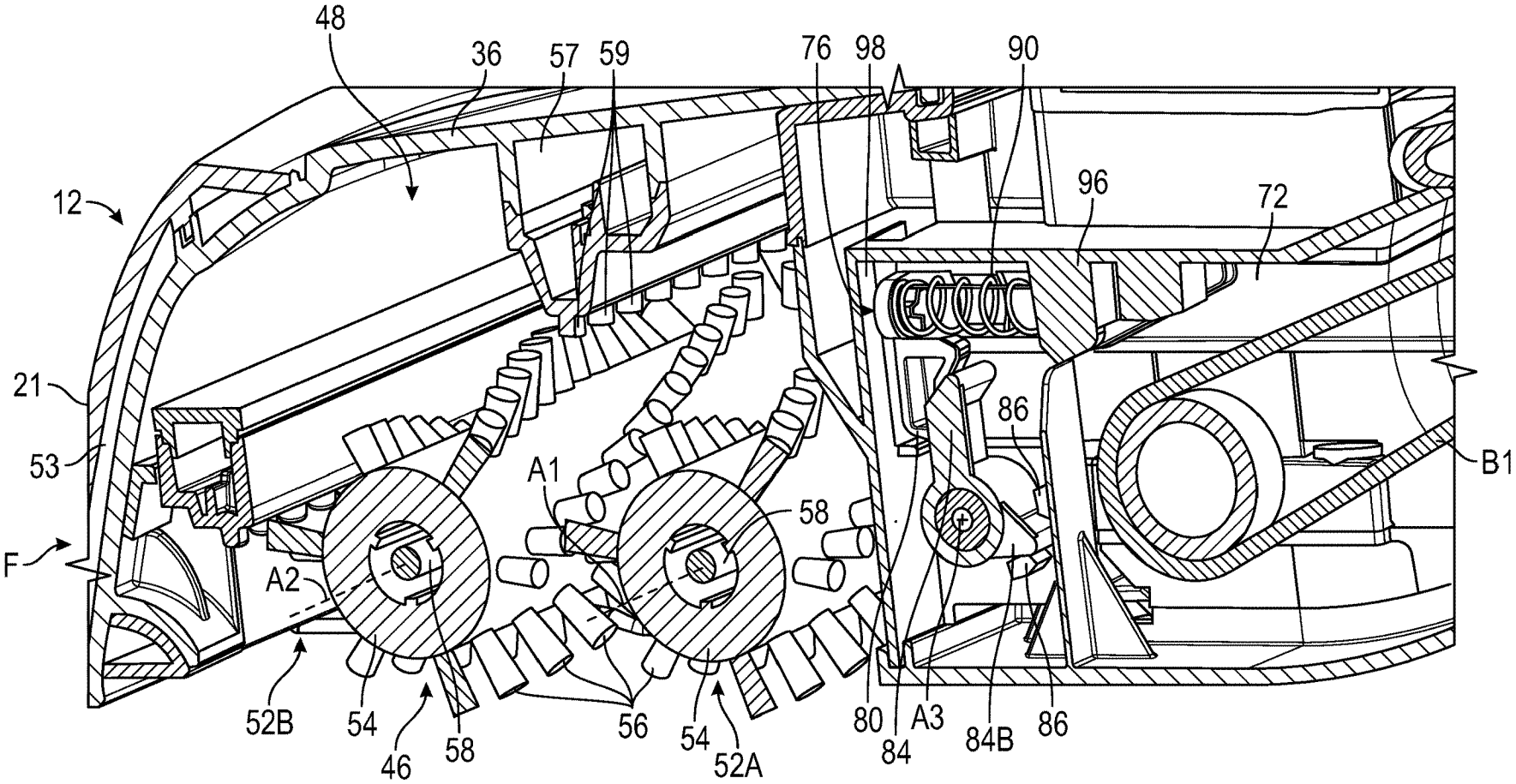
FIG. 6 is a fragmentary perspective cross-sectional view of the base showing the agitator lifting mechanism.

FIG. 3 is a fragmentary cross-sectional view of the base 12 showing an agitator lifting mechanism 44 for lifting an agitator assembly 46 away from the surface S to be cleaned. As best shown in FIG. 6, the base housing 36 defines, at least in part, an agitator chamber 48 in which an agitator assembly 46 is housed. The agitator assembly 46 includes a first rotatable agitator 52A and a second rotatable agitator 52B. The first rotatable agitator 52A may be referred to as a rear agitator and the second rotatable agitator 52B may referred to as a front agitator as the first rotatable agitator 52A is disposed rearward of the front rotatable agitator 52B. Both of the rotatable agitators 52A, 52B are shown as brush rolls 54 having bristles 56 that act to agitate the surface S during cleaning to loosen dirt and debris. While the agitators 52A, 52B are illustrated as brush rolls having rows of bristles, it is within the scope of the present disclosure for the agitators 52A, 52B to include additional or alternative configurations, non-limiting examples of which include microfiber material, fabric or polymeric blades, and combinations thereof. FIG. 6 also shows a portion of a nozzle inlet 53 defined by the nozzle 21 through which a vacuum is created by a suction source in fluid communication with the nozzle 21 for generating a working air stream to the recovery tank 28 for separating and collecting fluid and dirt from the working airstream for later disposal. FIG. 6 also shows a spray manifold 57 having multiple outlets 59 that deliver liquid cleaning fluid between the brush rolls 54 of the front agitator 52B and the rear agitator 52A. In some embodiments, the spray manifold 57 may be configured to deliver the liquid cleaning fluid onto one or both of the agitators 52A, 52B.

The agitators 52A, 52B each have a respective agitator axis A1 and A2 that are generally horizontal and parallel to the surface S to be cleaned when the agitator assembly 46 is in the lowered position. The agitator axes A1 and A2 are longitudinal axes of dowels 58 that support the brush rolls 54. The dowels 58 extend with the axes A1 and A2 parallel to the front F of the base 12 and extend from the left side LS to the right side RS. The rear agitator 52A is driven by a belt B2 of a drive assembly 200 engaged with a sprocket 55A at the end of the rear agitator 52A as discussed herein (see FIGS. 7 and 14). The sprocket 55A rotates with the rear brush roll 54 about the agitator axis A1. An additional belt B3 shown in FIG. 8 operatively engages a sprocket at the end of the rear agitator 52A with the front agitator 52B to rotatably drive the front agitator 52B about the axis A2. The additional belt B3 may be disposed at an opposite end of the agitators 52A, 52B than the belt B2. The opposite ends may also have sprockets as on the ends shown in FIGS. 7 and 8. For example, the front agitator 52B has a sprocket 55B shown in FIGS. 7 and 8 that rotates with the front brush roll 54 about the agitator axis A2. A like sprocket 55B at the opposite end may be engaged with the belt B3 of FIG. 8.

Figure 4:
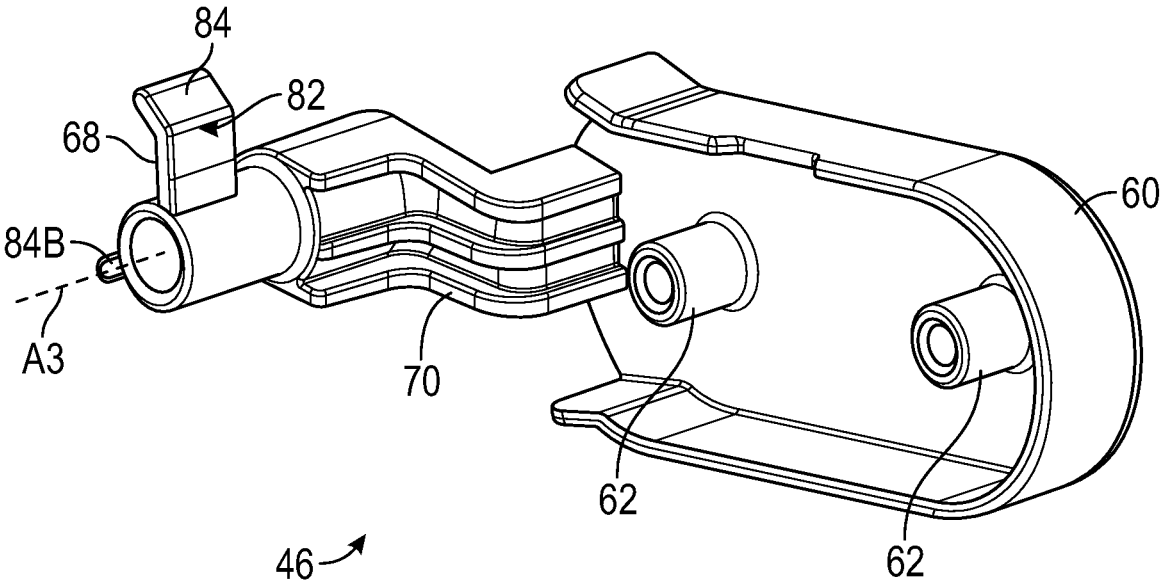
FIG. 4 is a perspective view of an engagement mechanism included in the agitator lifting mechanism and a portion of an agitator support frame.

FIG. 4 shows a portion of the agitator assembly 46 including an agitator support frame 60. FIG. 4 shows only a portion of the agitator support frame 60 that supports the ends of rotatable agitators 52A, 52B nearest the left side LS of the base 12. The perspective view of FIG. 4 shows an inner side of the agitator support frame 60. An engagement mechanism 68 shown secured via an arm 70 to the agitator support frame 60 is positioned rearward of agitator support frame 60 when viewed from an outer side, as in FIGS. 3 and 6, for example. Another agitator support frame that is a mirror image of the agitator support frame 60 shown in FIG. 4 supports the rotatable agitators 52A, 52B at the right side RS in the same manner. In some embodiments, the engagement mechanism 68, arm 70, and the support frame 60 may be a unitary, one-piece component.

Figure 8:
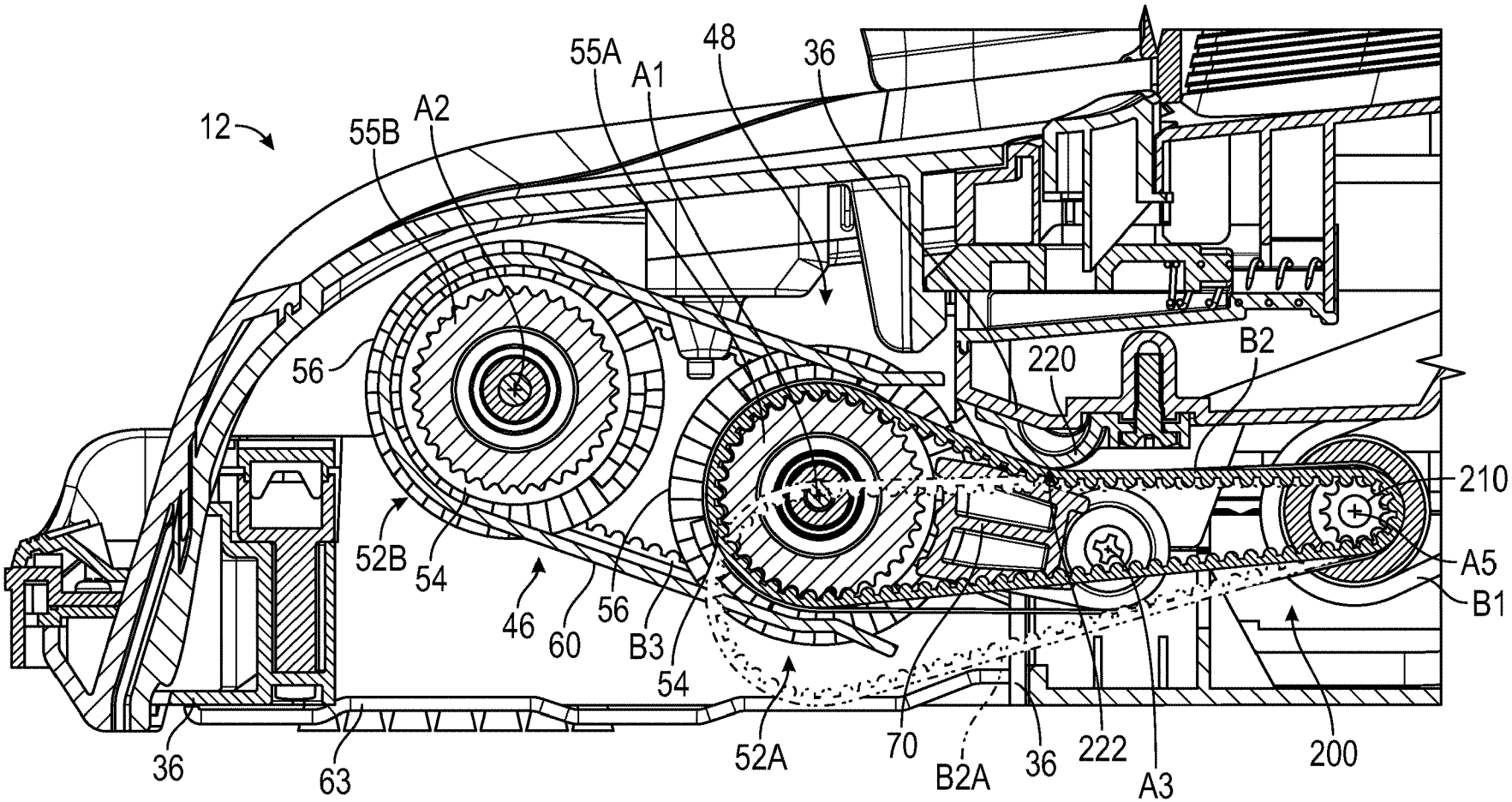
FIG. 8 is a fragmentary cross-sectional view of the base showing the agitator assembly in a lifted position and with a belt interfacing with a belt glide mechanism and showing a lowered position of the belt in phantom.

The rotatable agitators 52A, 52B are rotatably supported on the agitator support frame 60 by the dowels 58 and inner surfaces of the brush rolls 54 that interfit with hubs 62 shown on the agitator support frame 60 in FIG. 4. A support wire 63 that serves to further support the agitator assembly 46 may be disposed to extend in the fore-aft direction below the brush rolls 54 and may be secured to the base housing 36 forward and rearward of the agitator assembly 46, as shown in FIG. 8.

Lifting of the agitator assembly 46 away from the surface S to be cleaned may be desired, for example, when the surface cleaner 10 is in the upright position with power on. For example, during cleaning, a user may temporarily place the spine assembly 14 in the upright position with the power on and the base 12 not being moved across the surface S. The brush rolls 54 would remain at one location over the surface S until the user pivots the spine assembly 14 to the use position and moves the base 12 across the surface S. Because the brush rolls 54 will be rotating when the power is on, it may be advantageous to lift them away from the surface S when the spine assembly 14 is in the upright or parked position, and lower them only when the spine assembly 14 is in the use position. The agitator lifting mechanism 44 enables this lifting and lowering action.

Referring again to FIG. 3, the agitator lifting mechanism 44 includes an agitator lift lever 72 that is supported on the base housing 36 and is translatable relative to the base housing 36 between a forward position (shown in FIGS. 3 and 6) and a rearward position. In the rearward position, the entire lever 72 moves to the right in FIG. 3 so that the end 75 of the lever 72 is at location 75A.

The agitator lifting mechanism 44 further includes the engagement mechanism 68 of FIG. 4. As shown in FIG. 3, the engagement mechanism 68 is positioned to be pivoted by the agitator lift lever 72 about a pivot axis A3 as the agitator lift lever 72 translates to the rearward position. As shown in FIG. 4, the engagement mechanism 68 is secured to the arm 70 which in turn is secured to the support frame 60, so that the engagement mechanism 68, arm 70, and support frame 60 pivot in unison with the brush rolls 54 when the engagement mechanism 68 is pivoted by the lever 72. The pivot axis A3 may thus be referred to as an agitator support frame pivot axis.

A lower portion of the base housing 36 (not visible in the cross-section of FIG. 3) supports a rear portion of a lower edge 78 of the lever 72. A forward portion of the lower edge 78 rests on the engagement mechanism 68. More specifically, the lower edge 78 and a rear face 79 (indicated in FIG. 5) of a downward-extending finger 80 of the lever 72 rest against a forward face 82 (see FIG. 4) of a first arm 84 that projects radially outward from the pivot axis A3 and interfaces with the lever 72 at the finger 80. A second arm 84B also projects radially outward and is confined by projections 86 of the base housing 36 to move within an angular range between the projections 86, limiting the pivoting or rotational range of the engagement mechanism 68 and, hence, determining the amount of lift and release of the agitator assembly 46.

A spring 90 (see FIG. 3) surrounds a retention post 92 (see FIG. 5) of the lever 72. A forward portion of the spring 90 rests against a rear side of a top portion 94 of the finger 80. Coils of the spring 90 are of a sufficient diameter such that a rear portion of the spring 90 abuts a wall 96 of the base housing 36 as shown in FIG. 6. The wall 96 extends downward just outward of the lever 72 such that the wall 96 does not interfere with the fore-aft translation of the lever 72. When disposed as shown in FIG. 6, the spring 90 biases the forward face 76 of the lever 72 against another wall 98 of the base housing 36. Stated differently, the spring 90 biases the agitator lift lever 72 to the forward position. An advantage of biasing the spring 90 to the forward position is that, if the agitator assembly 46 is periodically removed during the life of the surface cleaner 10, such as to replace the brush rolls 54, the finger 80 will not accidentally be lodged rearward of the first arm 84.

Figure 5:
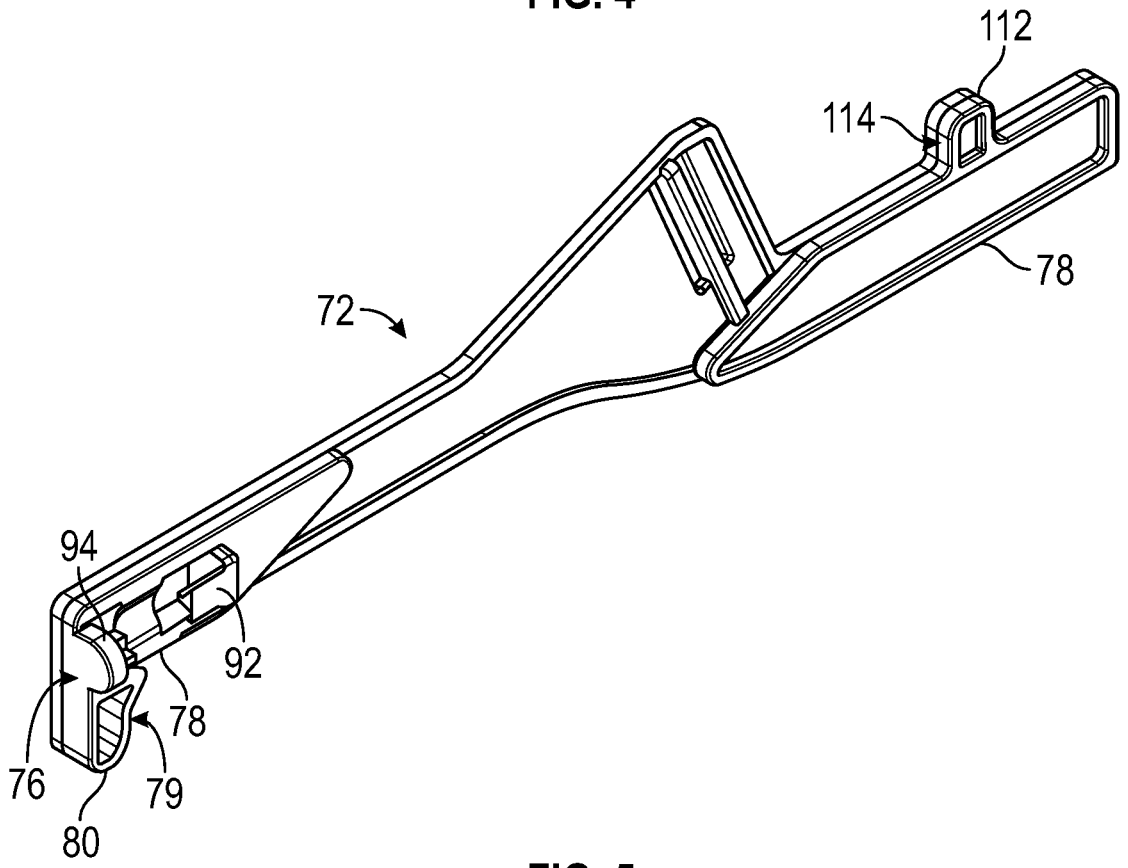
FIG. 5 is a perspective view of an agitator lift lever included in the agitator lifting mechanism.

The spine assembly 14 is configured to operatively engage the lever 72 and translate the lever 72 from the forward position (in which it is shown in FIG. 3) to the rearward position (indicated at 75A) when the spine assembly 14 is pivoted from the second position (the reclined position shown in phantom in FIG. 2) to the first position (the upright position of FIG. 2). More specifically, with reference to FIG. 3, the spine assembly 14 includes a lower shell 100. A portion of the lower shell 100 is adjacent to the base housing 36 at a window 102 in the base housing 36 as shown in FIG. 3. The spine assembly 14 further includes an engagement wheel 104 that is rotatably mounted to the lower shell 100 at the pivot axis 16. The engagement wheel 104 has a tubular knob 106 at its outer perimeter that is enveloped by a projecting sleeve 108 of the lower shell 100. The sleeve 108 acts against the knob 106 as the spine assembly 14 is pivoted to the upright position (counter-clockwise in FIG. 3). The engagement wheel 104 is moved counter-clockwise with the knob 106, as it is rotated by the lower shell 100 about the pivot axis 16. The engagement wheel 104 has a lower projection 110 that interfaces with an upwardly-extending arm 112 of the lever 72. The arm 112 is also shown in FIG. 5. The projection 110 is forced against the front face 114 of the arm 112, causing the lever 72 to translate from the forward position to the rearward position. As the lever 72 translates rearward, the finger 80 moves rearward applying force against the first arm 84 of the engagement mechanism 68, causing the engagement mechanism 68 to rotate clockwise in FIG. 3 so that the first arm 84 is in the position 84A. From the perspective in FIG. 4, the first arm 84 would rotate counter-clockwise. The arm 70 and support frame 60 connected with the engagement mechanism 68 also pivot with the engagement mechanism 68. Hence, because they are forward of the engagement mechanism 68, the arm 70 and the support frame 60 are lifted away from a horizontal plane underlying the base 12, such as the surface S of FIG. 2. The pivoting engagement mechanism 68 thus lifts the agitator support frame 60 and the agitators 52A, 52B (e.g., including the brush rolls 54) secured thereto from a lowered position to a raised position, the agitators 52A, 52B being further from the surface S to be cleaned in the raised position than in the lowered position.

Figure 7:
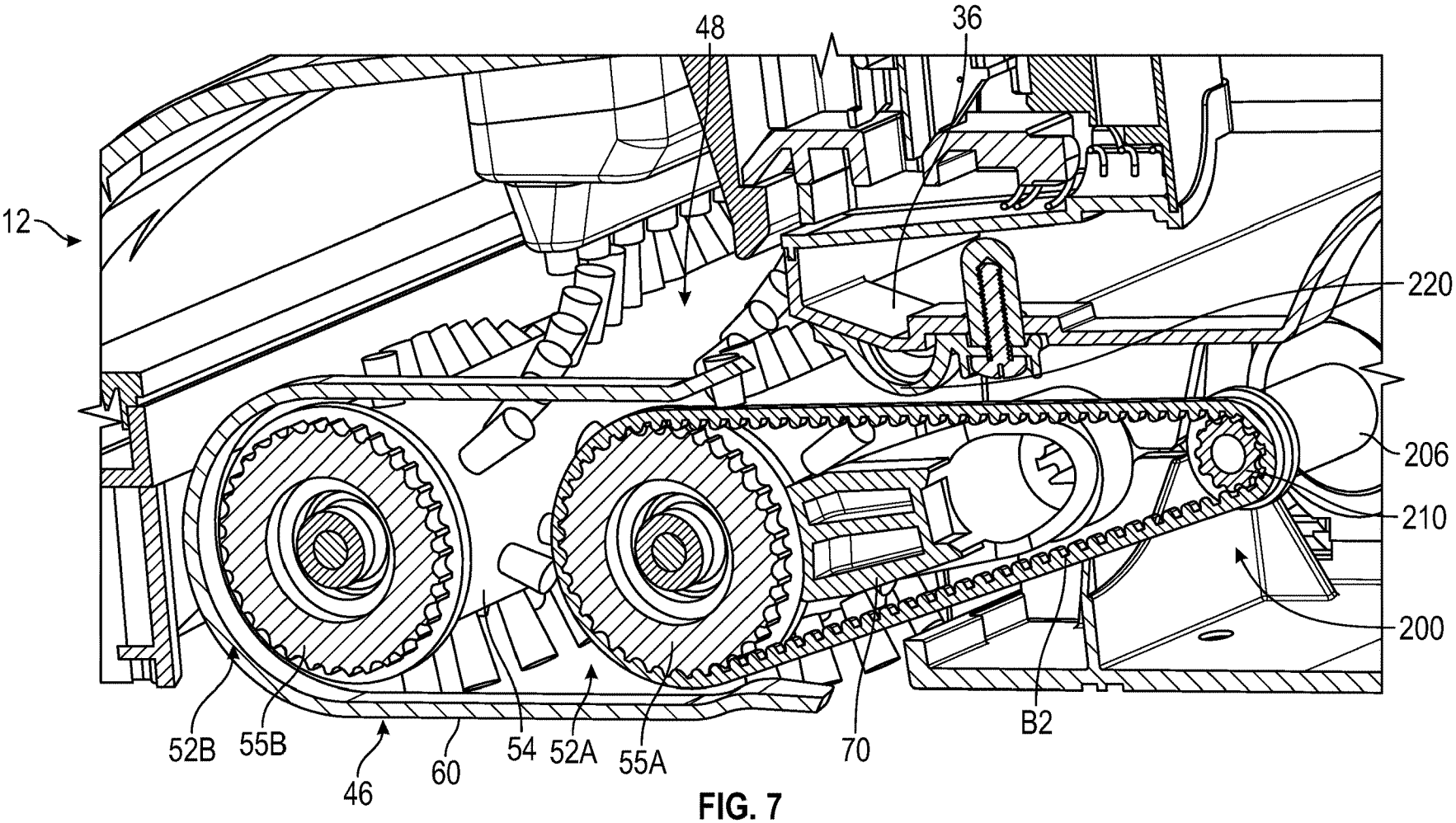
FIG. 7 is another fragmentary perspective cross-sectional view of the base showing the agitator assembly in a lowered position.
Figure 14:
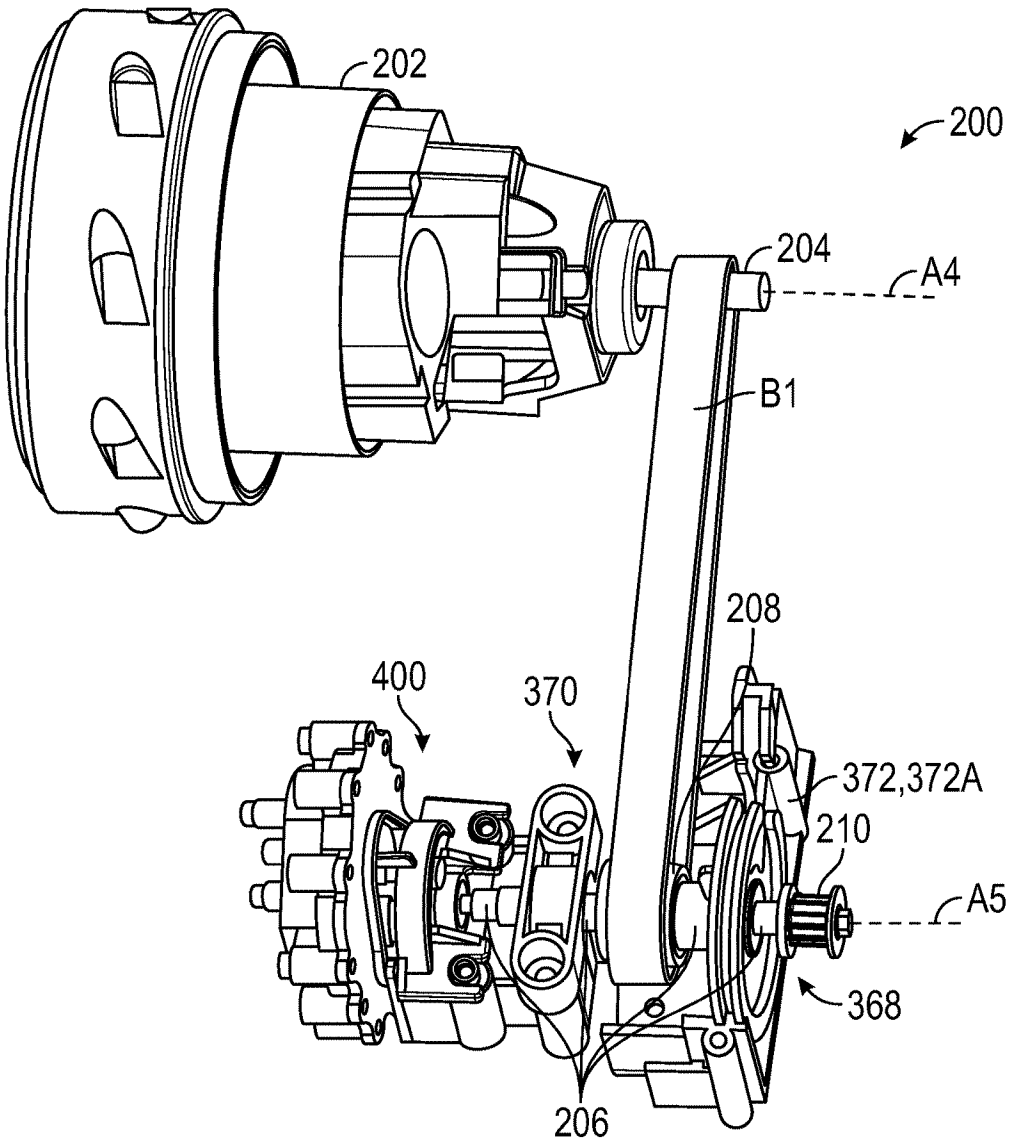
FIG. 14 is a perspective view of a portion of a drive assembly included in the base for rotatably driving the agitator assembly and for rotatably driving a centrifugal pump.

FIG. 8 shows the raised position of the agitator assembly 46. The belt B2 that is engaged with the sprocket 55A on the rear agitator 52A is shown in phantom at B2A to indicate the position of the belt B2 when the agitator assembly 46 is in the lowered position. The belt B2 is part of a drive assembly 200 that is shown partially in FIGS. 7-9 and partially in FIG. 14. With reference to FIG. 14, the drive assembly 200 includes a motor 202 that has a motor shaft 204 rotatably driven by the motor 202 about a motor axis A4. The drive assembly 200 further includes an intermediate shaft 206 that defines an intermediate axis A5 parallel with the motor axis A4 and parallel with the axis A1 of the first rotatable agitator 52A (i.e., the rear agitator 52A). The intermediate shaft 206 may also be referred to as a jackshaft. A first belt B1 is operatively engaged with the motor shaft 204 and with the intermediate shaft 206. A pulley (not shown) may be disposed on the motor shaft 204 and the first belt B1 may be operatively engaged with the motor shaft 204 via the pulley. The first belt B1 may be referred to as a stretch belt, is rotatably driven by the motor shaft 204 and, in turn, is engaged with a first pulley 208 on the intermediate shaft 206 to rotatably drive the intermediate shaft 206. A second pulley 210 is disposed at an end of the intermediate shaft 206 as shown in FIG. 14. The second pulley 210 is also shown in FIGS. 7 and 8. The second belt B2 is engaged with the second pulley 210. The second belt B2 may be referred to as a timing belt, and is also engaged with the sprocket 55A for rotating the agitator 52B about the agitator axis A1. The second pulley 210 and the sprocket 55A may have a difference in diameter, as shown, effecting a change in rotational speed of the rear agitator 52A and the front agitator 52B relative to the intermediate shaft 206. A difference in diameters of the motor shaft 204 and the first pulley 208 may further effect a change in rotational speed between the motor shaft 204 and the intermediate shaft 206. With the first pulley 208 shown as having a larger diameter than the motor shaft 204 and the sprocket 55A shown as having a larger diameter than the second pulley 210, the drive assembly 200 reduces the rotational speed of the agitators 52A, 52B relative to the motor speed at the motor shaft 204.

When the agitator assembly 46 is moved to the lifted position of FIG. 8 by pivoting about the axis A3, the axis A1 of the rear agitator 52A is closer to the rotational axis A5 of the intermediate shaft 206. To prevent this from causing excessive slack in the second belt B2, a projection 220 extends from the base housing 36 in the agitator chamber 48, as shown in FIG. 8. The projection 220 has a belt-engaging surface 222. The projection 220 is fixed (does not rotate) and the belt B2 glides across the surface 222. The second belt B2 is spaced apart from the belt-engaging surface 222 when the agitator assembly 46 is in the lowered position as shown in FIG. 7. When the agitator assembly 46 is in the raised position of FIG. 8, the second belt B2 is disposed against the belt-engaging surface 222. In fact, due to the location of the pivot axis A3 between the axes A1 and A5 and the range of rotation of the mechanism 68 when pivoted by the lever 72, the front agitator 52B and its rotational axis A2 are lifted higher than the rear agitator 52A. The second belt B2 is thus forced to turn at the projection 220, as shown in FIG. 8, which limits slack in the belt B2. Specifically, due to the turn, the length of the path of the belt B2 in the raised position is the same as the length of the path of the belt B2 in the lowered position. There is thus no change in tension in the belt B2 due to contact with the surface 222 of the projection 220. Stated differently, the tension in the belt B2 is the same in the lowered position of the agitator assembly 46 as it is in the raised position of the agitator assembly 46.

Figure 9:
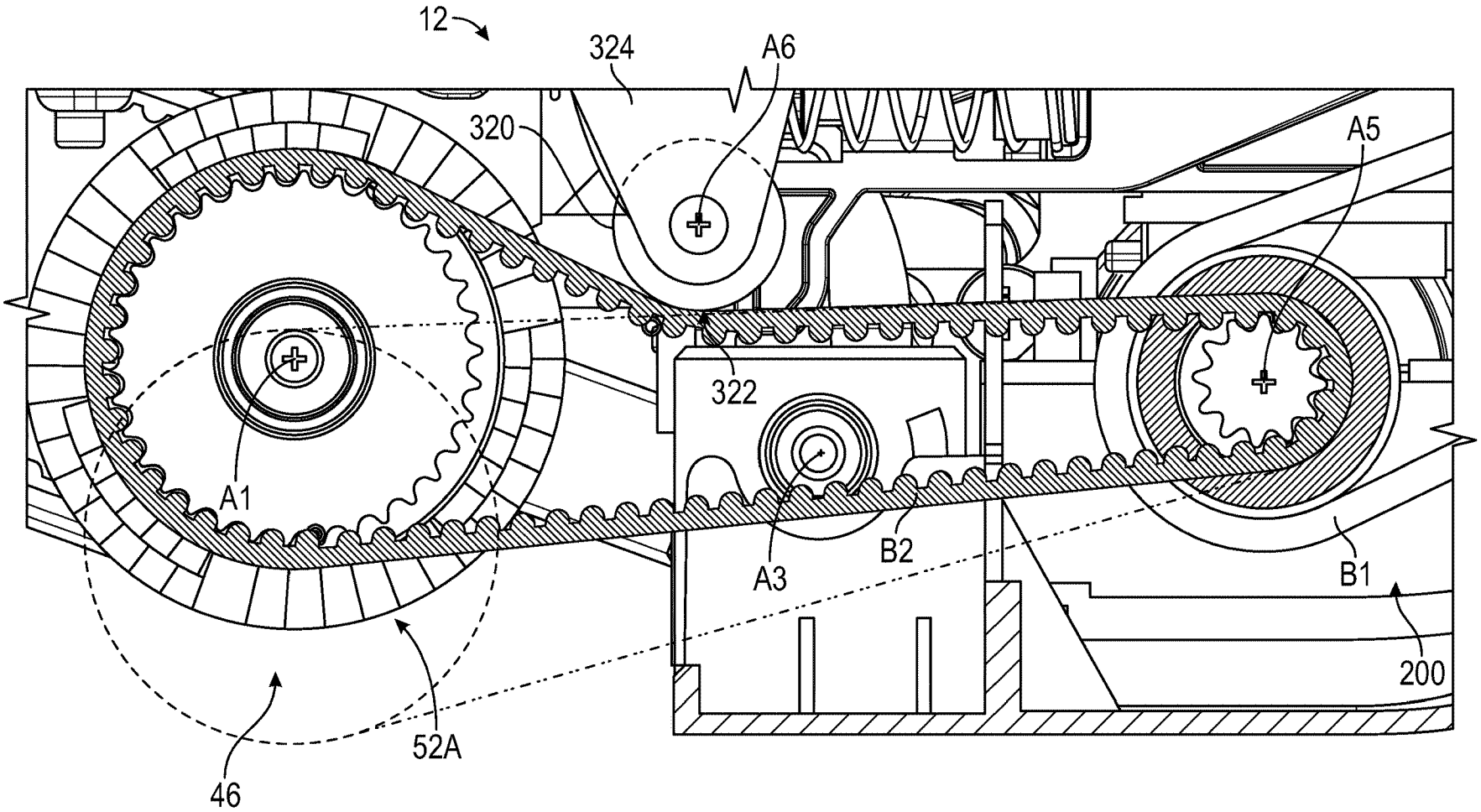
FIG. 9 is a fragmentary cross-sectional view of the base showing the agitator assembly in a lifted position with the belt interfacing with an alternative belt glide mechanism and showing a lowered position of the belt in phantom.

FIG. 9 shows the base 12 with a different embodiment of a projection 320 that interfaces with the second belt B2 when the agitator assembly 46 is in the raised position. The projection 320 is a rotatable bearing 320 having a contact surface 322 that contacts the second belt B2 when the agitator assembly 46 is in the raised position of FIG. 9. The bearing 320 is retained on a hub 324 and rotates about axis A6. The belt B2 rotates the bearing 320 by contact with the contact surface 322 of the bearing 320. The lowered position of the rear agitator 52A and the belt B2 is indicated in phantom in FIG. 9. In the lowered position, the second belt B2 is spaced apart from the contact surface 322 of the bearing 320 by at least a small gap. The agitator support frame 60 and arm 70 are not shown in FIG. 9, but the pivot axis A3 is indicated. As with the projection 220, there is thus no change in tension in the belt B2 between the raised and lowered positions of the agitator assembly 46 due to the contact with the surface 322 of the bearing 320.

Figure 10:
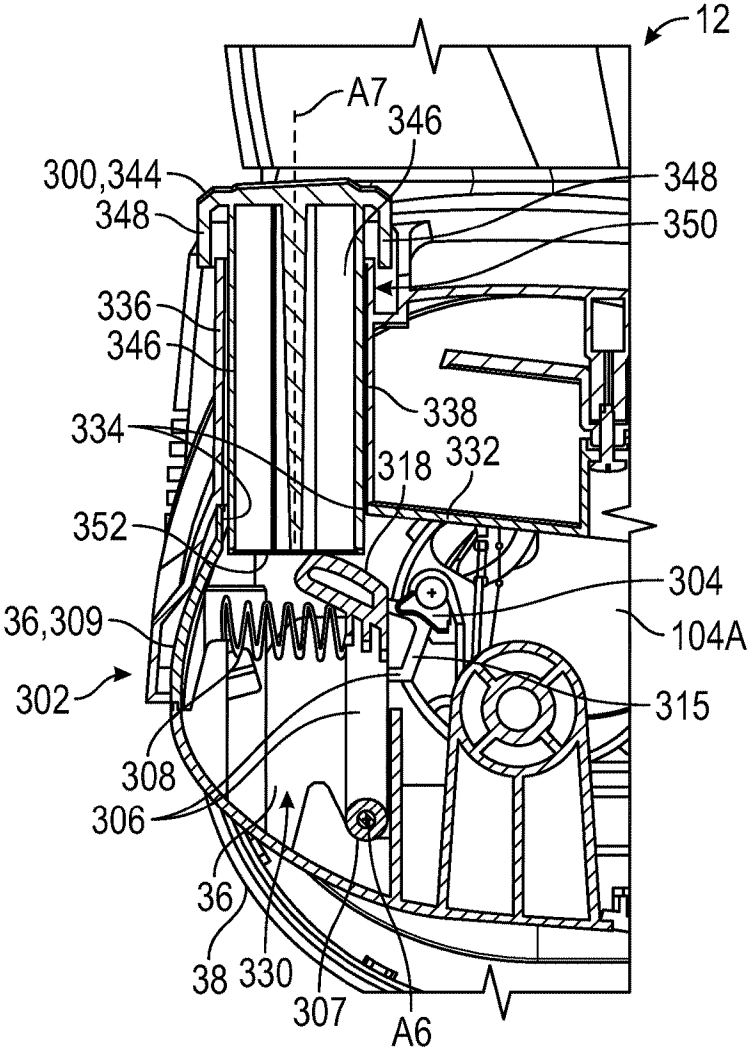
FIG. 10 is a fragmentary cross-sectional view of the base showing a detent mechanism in an engaged position to retain the spine assembly in the upright position.
Figure 12:
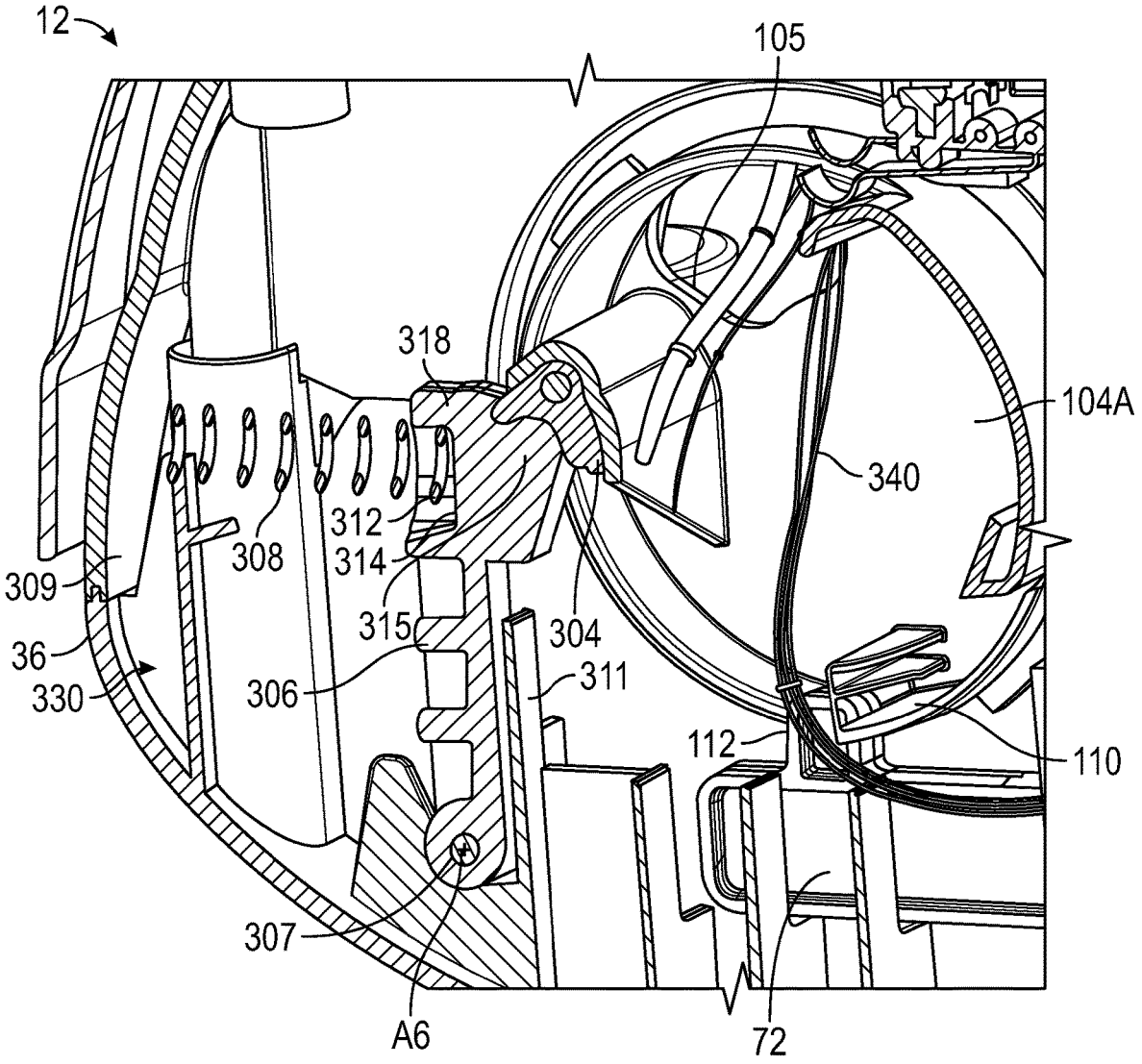
FIG. 12 is a fragmentary perspective cross-sectional view of the base showing the detent mechanism in the engaged position.

Once placed in the first position (e.g., the upright position), the spine assembly 14 remains in the first position until the user depresses a release button 300. The release button 300 is at the right side RS of the base 12 in the embodiment shown, as is evident in FIG. 2. As shown in FIG. 10, the release button 300 is part of a detent mechanism 302 that releasably secures the spine assembly 14 in the first position. In addition to the release button 300, the detent mechanism 302 includes a catch 304, a pivot arm 306, and a spring 308. The catch 304 is operatively secured to the lower shell 100 of the spine assembly 14. More specifically, the spine assembly 14 includes an engagement wheel 104A that is rotatably mounted to the lower shell 100 at the pivot axis 16 and has the features described with respect to engagement wheel 104 of FIG. 3 only on the opposite left side LS. In fact, FIG. 12 shows that the engagement wheel 104A has a lower projection 110 that interfaces with an upwardly-extending arm 112 of the lever 72 on the right side RS, as described with respect to the like projection 110, and lever 72 on the left side LS. FIG. 12 shows that the engagement wheel 104A has a window 105 that allows wiring 340 to extend into an internal cavity 330 in the base housing 36.

Figure 13:
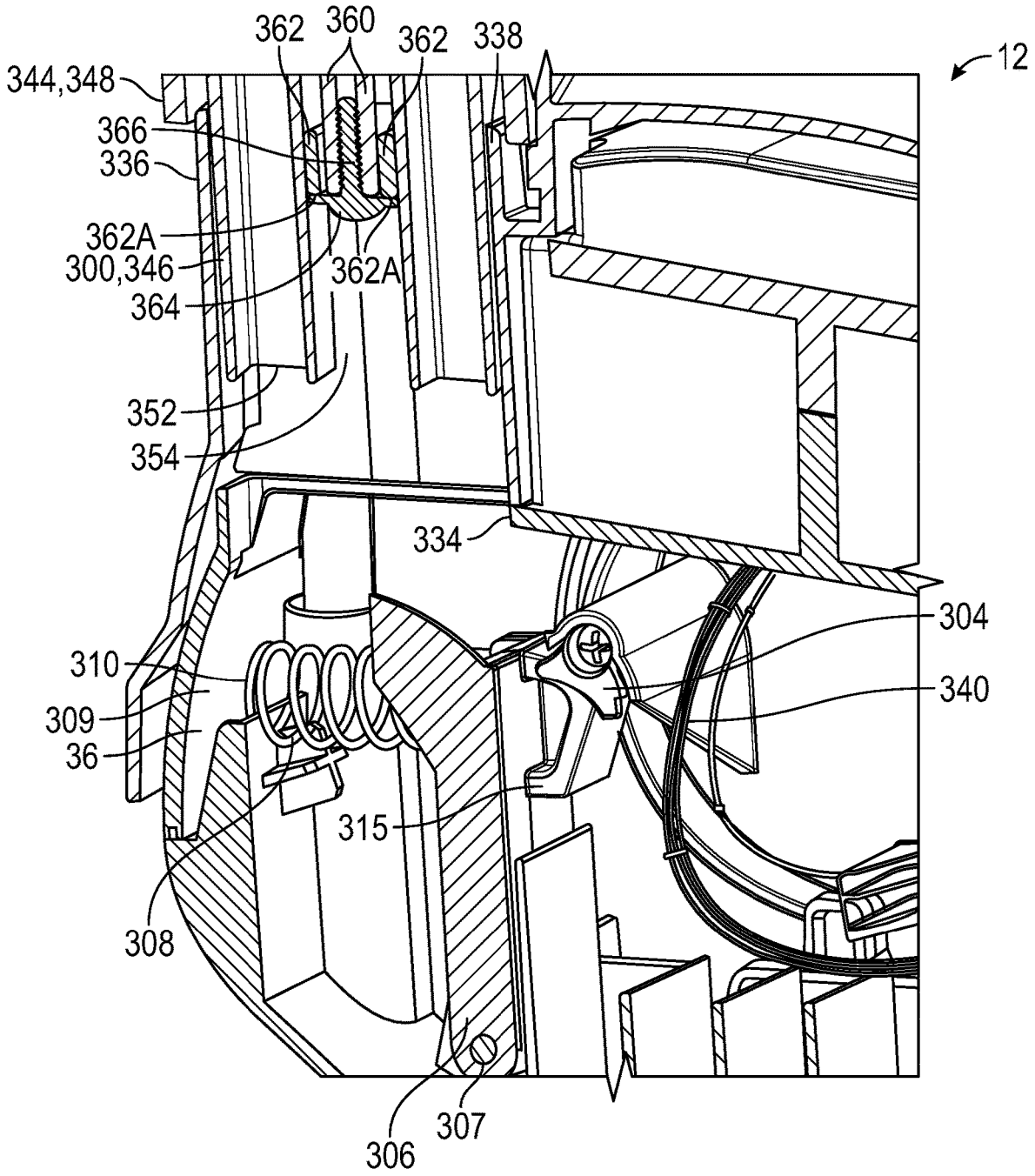
FIG. 13 is a fragmentary perspective cross-sectional view of the base showing the detent mechanism in the released position.

As shown in FIGS. 10 and 12, the pivot arm 306 is pivotably secured to the base housing 36 by a pin 307 establishing a pivot axis A6. The spring 308 has an outward end 310 biased against a wall 309 of the base housing 36, as best shown in FIG. 13, and an inward end 312 captured in a pocket 314 of the pivot arm 306, as best shown in FIG. 12. Pivoting of the pivot arm 306 in the clockwise direction in FIGS. 10-13 is limited by another wall 311 of the base housing 36, as shown in FIG. 12. A forward upper corner of a projection 315 of the pivot arm 306 is biased against the catch 304 when the spine assembly 14 is in the first position, as shown in FIGS. 10 and 12.

Figure 11:
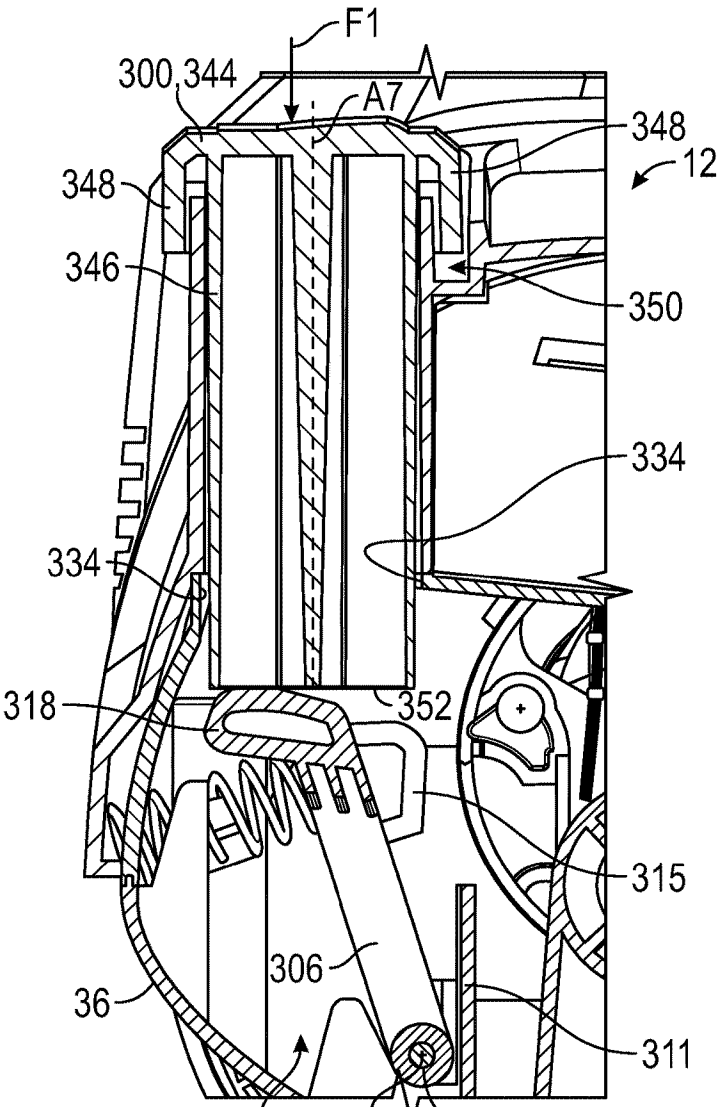
FIG. 11 is a fragmentary cross-sectional view of the base showing the detent mechanism in a released position to enable the spine assembly to be pivoted to the reclined position.

The release button 300 is mounted to the base housing 36 and is depressible by a user applying a downward force F1 (see FIG. 11). When depressed, the release button 300 presses against a head portion 318 of the pivot arm 306 to pivot the pivot arm 306 counter-clockwise in FIGS. 10-13, away from the catch 304 and against the spring 308, releasing the pivot arm 306 from the catch 304, and therefore allowing the spine assembly 14 to be pivoted to the second position (e.g., the reclined or use position of FIG. 2). The released position of the pivot arm 306 is shown in FIG. 11. It should be appreciated that there are a range of reclined positions, the second position of FIG. 2 being just one, as the spine assembly 14 is freely pivotable when the detent mechanism 302 is released.

The base housing 36 defines the internal cavity 330 that is bounded in part by the wall 309. A top wall 332 of the base housing 36 bounds the top of the internal cavity 330 and is shown in FIG. 10. An opening 334 into the internal cavity 330 is located between the wall 309 and the top wall 332 and faces generally upward. Vertical walls 336, 338 extend upward at the opening 334, providing an elongated entrance to the opening 334. The pivot arm 306, the catch 304, and the spring 308 are disposed entirely within the internal cavity 330 in both the retained position of the pivot arm 306 shown in FIG. 10 and the released position shown in FIG.

11. The release button 300 translates along a center axis A7 of the opening 334 when depressed by an applied force F1 as in FIG. 11 between a resting position of FIG. 10 and a depressed position of FIG. 11. By utilizing a vertically disposed and vertically-translating release button 300 that acts on an internally-disposed pivot arm 306, the opening 334 is smaller than an opening that would be required for a pivoting release pedal that extends out of the cavity 330. Such an opening would likely need to extend not only where the opening 334 is disposed, but would further extend through the rear wall 309. The smaller opening 334 helps to limit the entry of debris and moisture into the cavity 330. This is advantageous, especially due to the presence of electrical wiring 340 (see FIGS. 12 and 13) disposed in the cavity 330, such as for providing electrical power to a motor, pump, or switch(es), for example.

Additionally, the structure of the release button 300 also helps to protect the internal cavity 330 from debris and moisture, and also blocks a direct line of sight into the cavity 330. Specifically, the release button 300 has a cap portion 344 disposed outside of the internal cavity 330 and an elongated body portion 346 that extends from the cap portion 344 through the opening 334 and engages the pivot arm 306 when in the depressed position of FIG. 11. The cap portion 344 is wider than the opening 334 and has a perimeter flange 348 that surrounds an upper extent of the walls 336, 338 of the base housing 36 at the opening 334 in both the resting position and the depressed position, creating a labyrinth interface 350 between the cap portion 344 and the base housing 36.

The elongated body portion 346 has an engagement end 352 that depresses the pivot arm 306. As shown in the cross-sectional view of FIG. 13, the elongated body portion 346 has a central opening 354 at the engagement end 352 that extends partway to the cap portion 344 and surrounds a central post 360 of the elongated body portion 346. The central post 360 extends toward the engagement end 352 from the cap portion 344. The base housing 36 includes spaced ribs 362. The central post 360 slides between the spaced ribs 362 when the release button 300 translates. A stopper 364 is disposed at an end of the central post 360 and is configured to interfere with ends 362A of the spaced ribs 362 to prevent removal of the release button 300 from the base housing 36. For example, the central post 360 may be internally-threaded as shown in FIG. 13, and the stopper 364 may include a fastener 366 threaded to the central post 360 with a sufficiently wide head to interfere with the ends 362A. Alternatively, a washer may be captured at the end of the central post 360 by the fastener 366. With the central post 360 guided by the ribs 362 to translate between the ribs 362 and unable to be lifted away from the opening 334 further than the position shown in FIG. 13, the button 300 is retained to the base housing 36. Even in the furthest vertical position of the release button shown in FIG. 13, the flanges 348 still extend downward further than the tops of the walls 336, 338, protecting the internal cavity 330 from moisture and debris.

Figure 15:
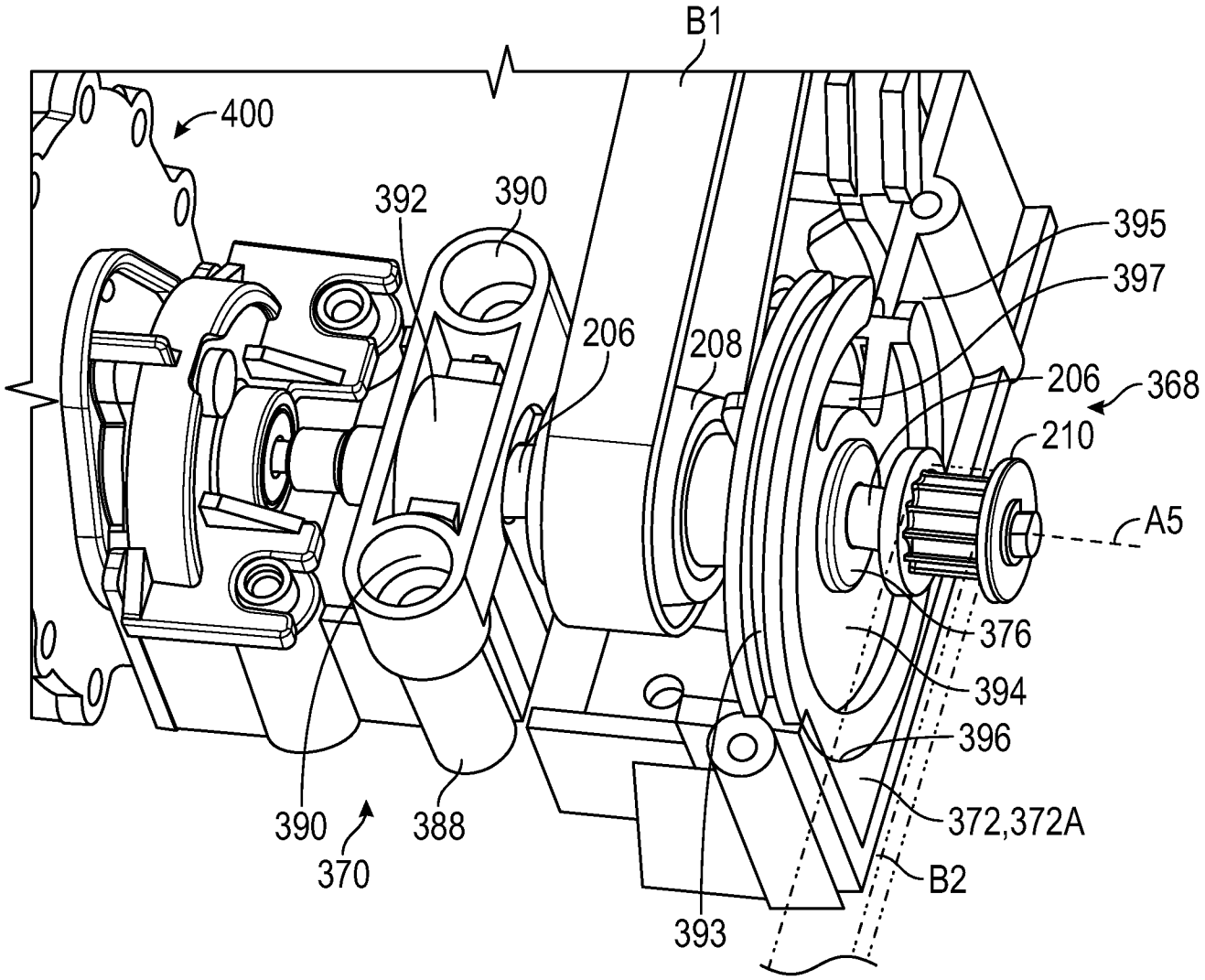
FIG. 15 is a fragmentary perspective view of a portion of the drive assembly of FIG. 14 showing a belt engaged with a pulley.

As discussed above, FIG. 14 is a perspective view of a portion of an embodiment of a drive assembly 200 that can be included in the base 12 of FIG. 8 for rotatably driving the agitator assembly 46. The drive assembly 200 also rotatably drives a centrifugal pump 400 discussed herein with respect to FIGS. 25-28. FIG. 14 shows that the drive assembly 200 includes a first bearing assembly 368 and a second bearing assembly 370. FIG. 15 is a fragmentary perspective view of a portion of the drive assembly 200 showing the first belt B1 belt engaged with the first pulley 208, as previously discussed.

Figure 16:
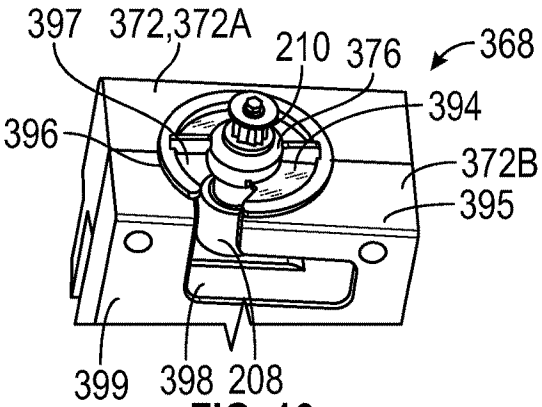
FIG. 16 is a fragmentary perspective view of a portion of the drive assembly showing with a portion of a bearing housing supporting an annularly-mounted bearing holder shown in a first position.

FIGS. 15 and 16 show that the first bearing assembly 368 includes a bearing housing 372 that is mounted to the base housing 36 of FIG. 8 via bolts or other fasteners. The bearing housing 372 is shown mounted to the base housing 36 in FIGS. 19-24. Only a first half 372A of the bearing housing 372 is shown in FIGS. 14 and 15. A second half 372B attaches to the first half 372A such as via pins or other fasteners and is shown in FIG. 16, for example. A rotatable bearing 376 is included in the first bearing assembly 368, allowing the first bearing assembly 368 to rotatably support the intermediate shaft 206.

FIG. 15 shows that the second bearing assembly 370 includes a bearing housing 388 that is mounted to the base housing 36 of FIG. 8 via bolts or other fasteners that will extend through fastener openings 390 in the bearing housing 388. A rotatable bearing 392 is included in the second bearing assembly 370, allowing the second bearing assembly 370 to rotatably support the intermediate shaft 206.

The first belt B1 is operatively engaged with the intermediate shaft 206 between the first bearing assembly 368 and the second bearing assembly 370, and is also operatively engaged with the motor shaft 204 as shown in FIG. 14. The second belt B2 is represented only in phantom in FIG. 15, but is shown in FIG. 8 engaged with the second pulley 210 which is disposed at the end of the intermediate shaft 206 in FIG. 14. The first bearing assembly 368 is between the second belt B2 and the first belt B1, and the second belt B2 is operatively engaged with the first rotatable agitator 52A as shown in FIG. 8.

It is apparent from FIG. 15 that the loads on the intermediate shaft 206 from the two belts B1 and B2 act towards one end of the length of the intermediate shaft 206. For example, both belts B1 and B2 act on a right half of the intermediate shaft 206 as viewed in FIG. 15. In another embodiment, the loading of the two belts B1 and B2 can be managed by placing two bearings on one side of both belts to allow for torsional support, creating a cantilevered belt arrangement (e.g., both bearing assemblies would be to the left of both belts B1 and B2 in the view in FIG. 15). Such an arrangement requires greater packaging space as the bearing assemblies must be spaced apart from one another significantly when packaged on one side of both belts in order to support the cantilevered load.

In the arrangement of the drive assembly 200 shown in FIG. 14, the first belt B1 is instead disposed between the bearing assemblies 368 and 370 along the length of the intermediate shaft 206 (e.g., along the rotational axis A5 of the intermediate shaft 206), and the first bearing assembly 368 is between the first belt B1 and the second belt B2 along the length of the intermediate shaft 206 (e.g., along the rotational axis A5 of the intermediate shaft 206). While this arrangement removes a cantilever effect of the first belt B1, and reduces the overall length of the drive assembly 200 along the intermediate shaft 206, it presents the challenge of providing access to the first belt B1 between the bearing assemblies 368, 370, as may be needed for maintenance or belt replacement. This issue is solved by providing the first bearing assembly 268 with an annularly-mounted bearing holder 394 supported by the bearing housing 372 in a first wall 395 of the bearing housing 372 at a through hole 396 in the bearing housing 372 through which the intermediate shaft 206 extends. For example, the through hole 396 is indicated in FIGS. 15 and 6 and is the circular hole formed by the bearing housing halves 372A, 372B. The annularly-mounted bearing holder 394 surrounds and supports an outer circumference of the bearing 376 and is in turn supported at its outer circumference by the bearing housing 372 at the through hole 396. As can be seen in FIG. 15, the first wall 395 extends into a groove 393 at the outer circumference of the bearing holder 394, allowing the bearing holder 394 to be rotated about the axis A5 while remaining captured at the wall 395 when the housing halves 372A, 372B are assembled and retained to the base housing 36.

Figure 24:
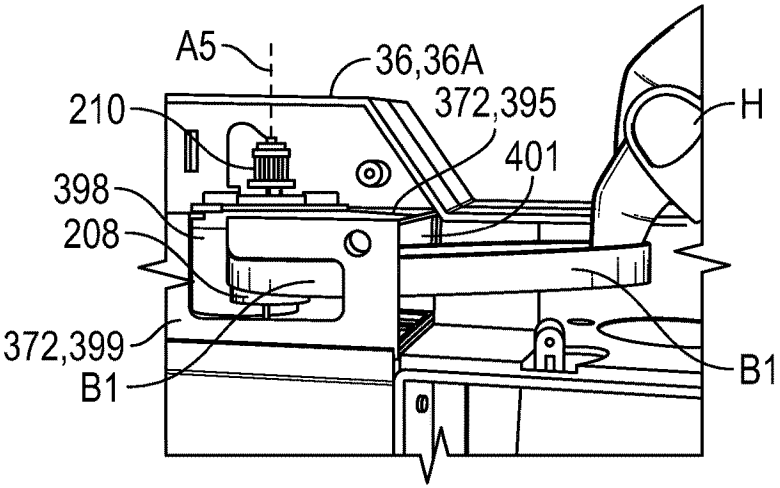
FIG. 24 is a fragmentary perspective view of the drive assembly of FIG. 19 and shows the belt fully drawn through the second window in the bearing housing for engagement with the motor shaft of FIG. 14.

The annularly-mounted bearing holder 394 has a slot 397 that extends approximately one-quarter of the way around the outer circumference of the bearing 376 and extends to the outer circumference of the bearing holder 394. The bearing housing 372 also defines a window 398 that extends through a second wall 399 of the bearing housing 372 and around a corner and partially into the first wall 395 as shown in FIG. 16. The window 398 may be referred to as a first window and extends through both of the walls 395, 399 to the area at the through hole 396 in which the first pulley 208 resides. As best shown in FIG. 24, the bearing housing 372 also has a second window 401 spaced from the first window 398. The first wall 395 extends perpendicular to the intermediate axis A5, the second wall 399 extends parallel with the intermediate axis A5 and perpendicular to the first wall 395, and the second window 401 extends parallel with the intermediate axis A5 and perpendicular to both the first wall 395 and the second wall 399.

The slot 397 and the first window 398 are sized to permit the first belt B1 to be routed around and engaged with the first pulley 208. More specifically, the first belt B1 is engaged with the first pulley 208 by alignment of the slot 397 with the first window 398, insertion of the first belt B1 through the slot 397 and the first window 398, rotation of the annularly-mounted bearing holder 394 to wrap the first belt B1 around the first pulley 208 (e.g., a full manual rotation of the annularly-mounted bearing holder 394), and then withdrawal of a portion of the first belt B1 through the second window 401 so that the withdrawn portion may be looped around the motor shaft 204. These steps are explained with reference to FIGS. 16-24.

Figure 18:
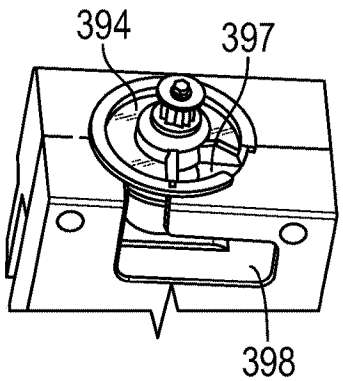
FIG. 18 is a fragmentary perspective view of the portion of the bearing housing of FIG. 16 showing the annularly-mounted bearing holder rotated to a third position.
Figure 17:
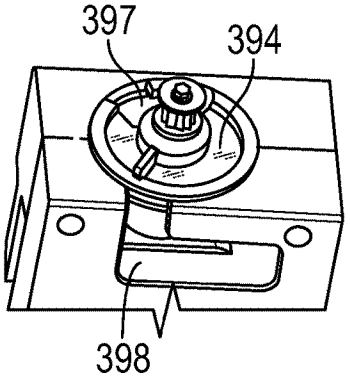
FIG. 17 is a fragmentary perspective view of the portion of the bearing housing of FIG. 16 showing the annularly-mounted bearing holder rotated to a second position.

For example, FIG. 16 shows the annularly-mounted bearing holder 394 in a first position in which the slot 397 is in communication with (e.g., aligned with) the first window 398. FIG. 17 shows the annularly-mounted bearing holder 394 rotated clockwise approximately one-quarter turn from the first position of FIG. 16 to a second position in which the slot 397 is not in communication with the first window 398. FIG. 18 shows the annularly-mounted bearing holder 394 rotated approximately a half-turn from the second position to a third position in which the slot 397 is still not in communication with the first window 398. The annularly-mounted bearing holder 394 would then be rotated approximately another one-quarter turn from the third position of FIG. 18 back to the first position of FIG. 16, such that one full manual rotation is completed and the slot 397 is again in communication with the first window 398.

Figure 20:
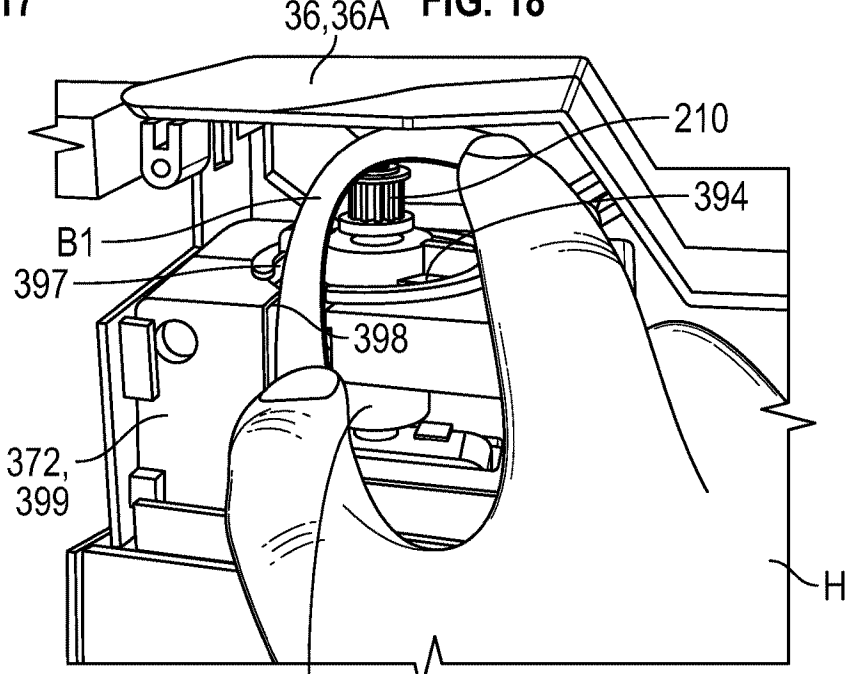
FIG. 20 is a fragmentary perspective view of the drive assembly of FIG. 19 and shows a belt being manually inserted into a window in the bearing housing and a slot in the annularly-mounted bearing holder with the annularly-mounted bearing holder shown in the first position.
Figure 19:
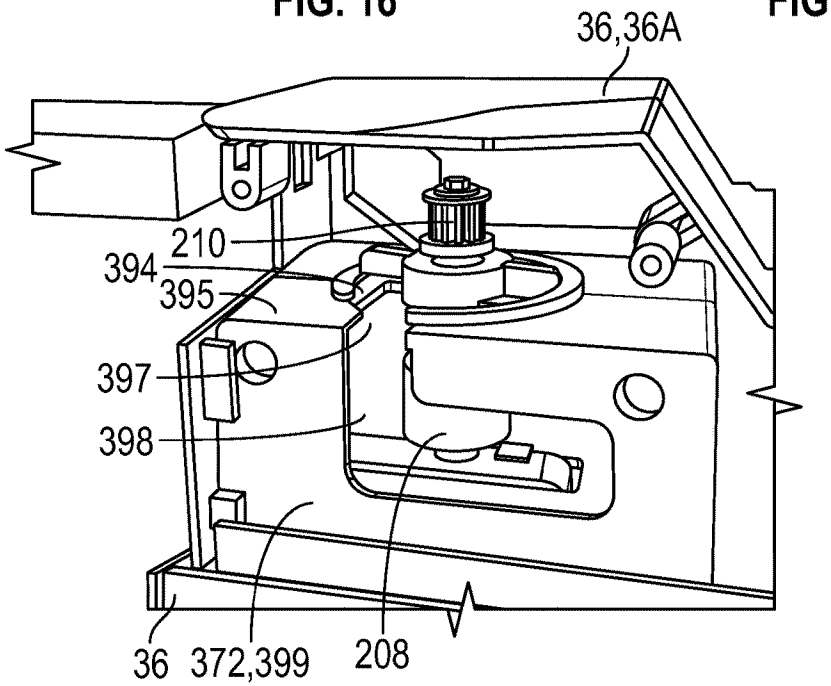
FIG. 19 is a fragmentary perspective view of a portion of the drive assembly including the bearing housing mounted to the base housing, a side cover of the bearing housing, and showing the bearing holder in the first position.
Figure 21:
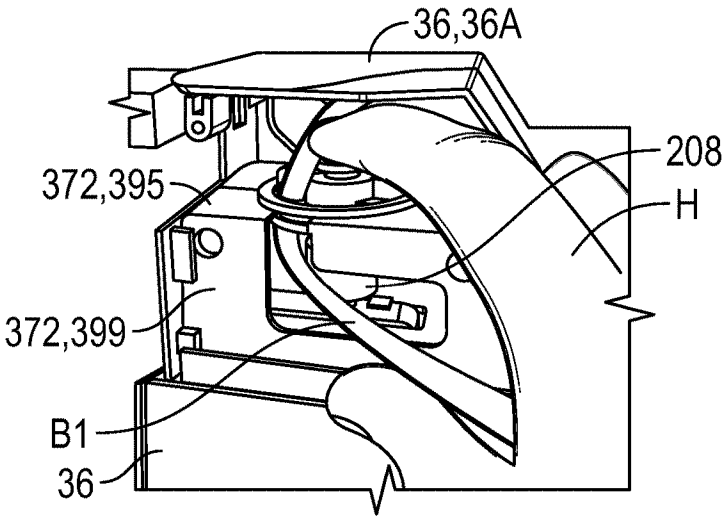
FIG. 21 is a fragmentary perspective view of the drive assembly of FIG. 19 and shows the annularly-mounted bearing holder being rotated toward the second position to partially wind the belt around a pulley.
Figure 22:
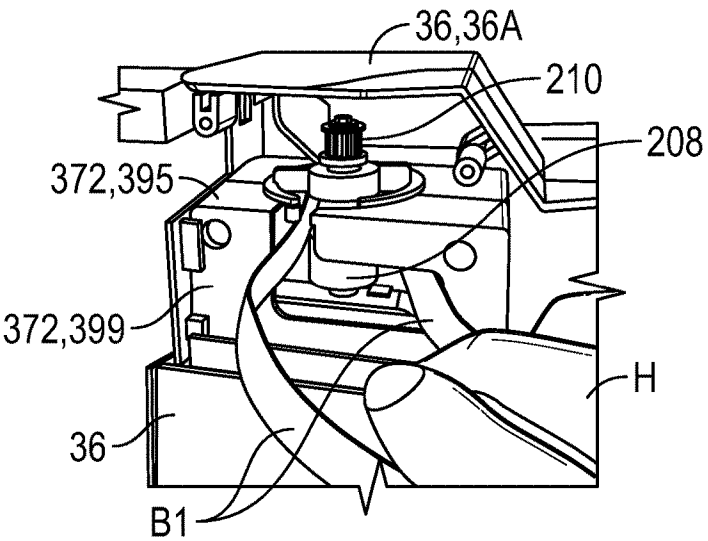
FIG. 22 is a fragmentary perspective view of the drive assembly of FIG. 19 and shows the annularly mounted bearing holder after a complete rotation back to the first position to fully wind the belt around the pulley.
Figure 23:
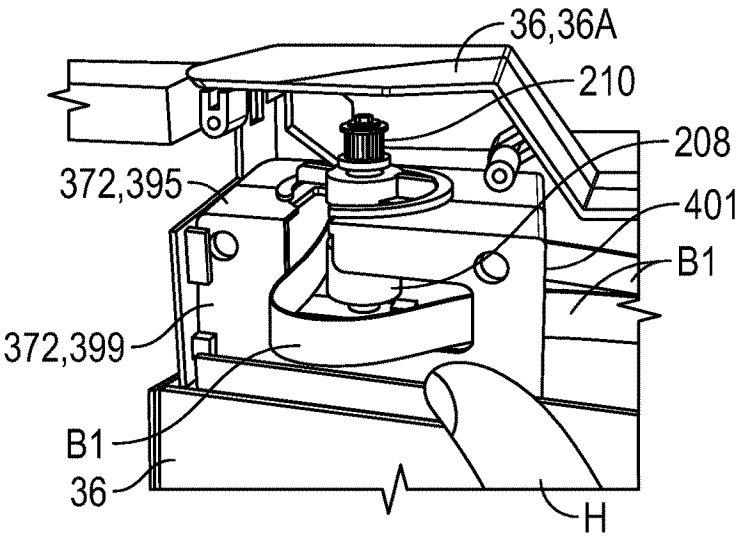
FIG. 23 is a fragmentary perspective view of the drive assembly of FIG. 19 and shows the belt being drawn partially through a second window in the bearing housing.

FIGS. 19-24 show the bearing housing 372 assembled to the base housing 36, with a side cover 36A of the base housing 36 extending outward of the pulley 210 and the annularly-mounted bearing holder 394. To engage the belt B1 with the first pulley 208, first, as shown in FIG. 19, the slot 397 is manually placed in a first position in which it is aligned with the first window 398. Next, as shown in FIG. 20, a hand H is shown manually inserting the first belt B1 into the first window 398 and the slot 397 with the annularly-mounted bearing holder 394 in the first position. The hand H pushes against the belt B1 to cause the annularly-mounted bearing holder 394 to rotate clockwise to the position shown in FIG. 21, causing the belt B1 to begin winding around the pulley 208 and pass over the pulley 208. As the hand H continues to cause the belt B1 to turn the annularly-mounted bearing holder 394 clockwise, the slot 397 comes back into communication with the first window 398 and the belt B1 becomes wound completely around the back of the pulley 208 with a portion of the belt B1 extending out through the first window 398 as shown in FIG. 22. FIG. 23 shows the portion of the belt B1 that had extended out of the first window 398 in FIG. 22 being pushed through the first window 398 and back through the second window 401. Finally, in FIG. 24, the belt B1 is fully drawn through the second window 401 in the bearing housing 372 and is ready for engagement with the motor shaft 204 of FIG. 14.

Figure 25:
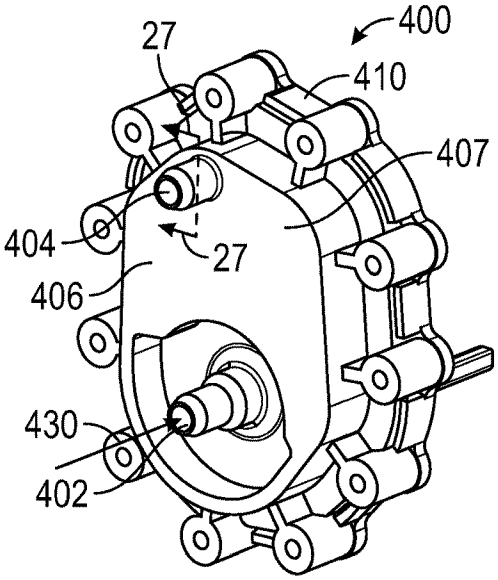
FIG. 25 is a perspective view of the centrifugal pump shown in FIG. 14.

In certain embodiments of the surface cleaner 10, the motor-driven centrifugal pump 400 rotatably driven on the intermediate shaft 206 by the motor 202 via the belt B1 may be self-priming. The centrifugal pump 400 is part of a fluid-dispensing system operable for delivering fluid to the surface S to be cleaned. The fluid-dispensing system also includes the supply tank 26 that holds the fluid and is in fluid communication with an inlet 402 of the centrifugal pump 400. The inlet 402 is shown in FIG. 25 and may be in communication with the supply tank 26 via one or more conduits, etc. The fluid may be water, cleaning solution, or a mixture of both. The spray outlets 59 of FIG. 6 are also part of the fluid-dispensing system and are in fluid communication with an outlet 404 of the centrifugal pump 400 which provides pressurized fluid to the spray outlets 59. The outlet 404 is shown in FIGS. 25 and 26.

Figure 26:
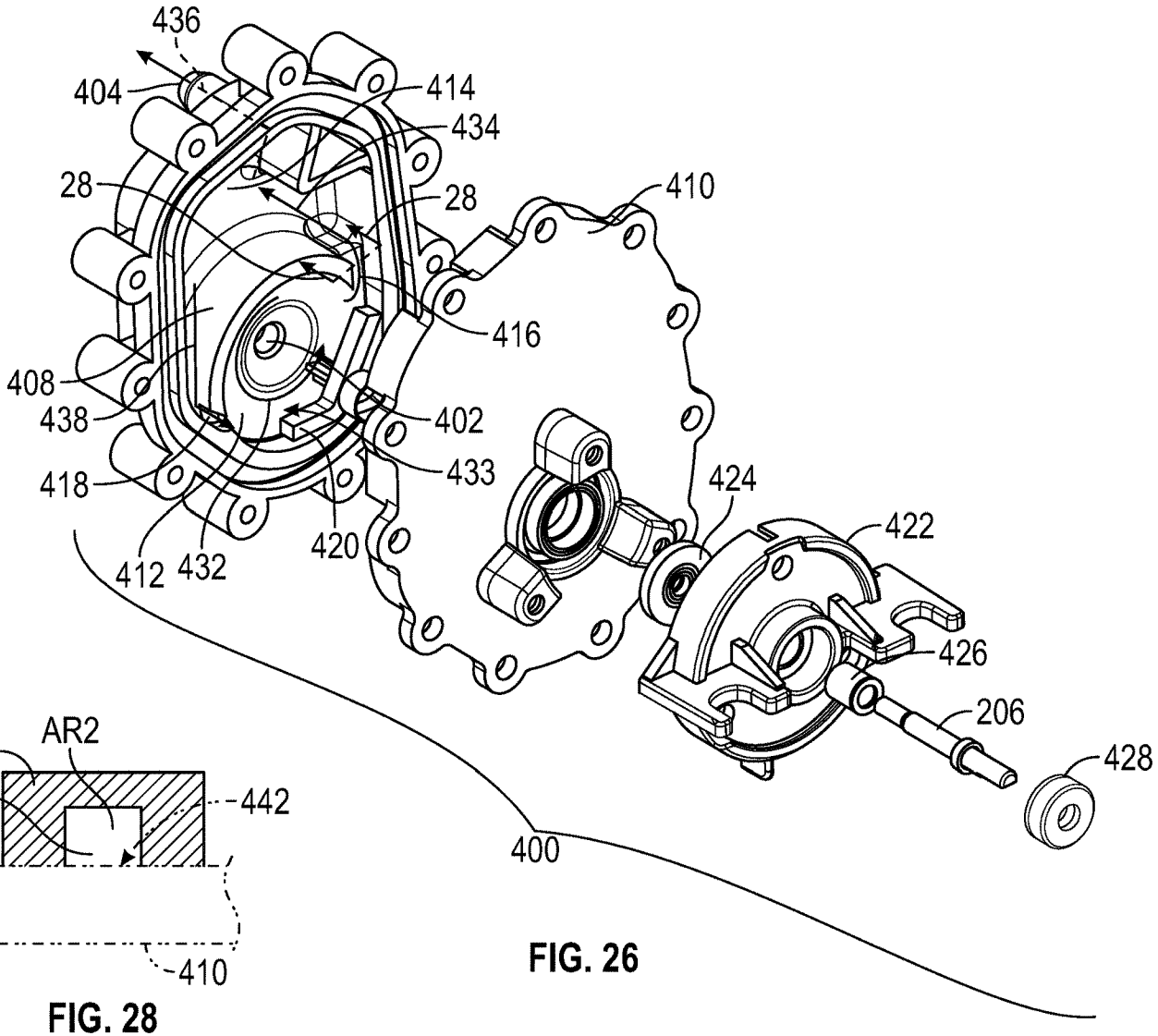
FIG. 26 is a perspective exploded view of the centrifugal pump of FIG. 25 showing integrated self-priming features.

Specifically, the centrifugal pump 400 includes a casing 406 that defines the inlet 402 through which fluid is drawn and that extends from an outer side 407 of the casing 406 (see FIG. 25) to an inner side 408 of the casing 406 (see FIG. 26). The casing 406 also defines the outlet 404 through which pressurized fluid is discharged, and the outlet 404 extends from the inner side 408 of the casing 406 back out to the outer side 407 of the casing 406. A cover 410 is secured to the casing 406 and encloses the inner side 408. The inner side 408 of the casing 406 defines a volute scroll 412 in fluid communication with the inlet 402, and an expansion chamber 414 in fluid communication with the outlet 404. The inner side 408 of the casing 406 also defines a throat 416 fluidly connecting the volute scroll 412 with the expansion chamber 414, and a weep hole 418 fluidly connecting the expansion chamber 414 with the volute scroll 412. The centrifugal pump 400 also includes an impeller 420 rotatably mounted to the intermediate shaft 206 and configured to rotate in the volute scroll 412 when driven by the motor 202 via the belt B1 and intermediate shaft 206 to pump fluid from the inlet 402 to the outlet 404 through the throat 416 and the expansion chamber 414, pressurizing the fluid at the outlet 404 in comparison to fluid pressure at the inlet 402. FIG. 26 also shows the intermediate shaft 206, a pump bracket 422 that secures to the pump cover 410 to structure within the base 12 such as the base housing 36, and various bushings 424, 426, and 428.

Typical centrifugal pumps are not self-priming as they cannot positively displace air that may occur due to an air pocket in the volute scroll, and intervention is needed to establish a prime upon the occurrence of an air pocket. To overcome this, prior solutions have included providing a pump priming system that includes a priming stack and a reservoir disposed adjacent to the pump, multiple valves, and further utilizing a vacuum motor to remove air from the pump priming system. This solution requires multiple additional components which take up additional space in the base of such a cleaner.

However, because the centrifugal pump 400 is designed to be self-priming, air is separated from the fluid so that a fluid seal is maintained at the impeller 420 and a reserve of fluid is maintained to re-flood the volute scroll 412 and maintain a slight amount of suction at the eye of the impeller 420 should the fluid supply be exhausted, all without needing additional components. Specifically, fluid is routed through the centrifugal pump 400 in a flow route indicated with arrows in FIGS. 25 and 26. Unpressurized fluid from the supply tank 26 enters the inlet 402 as flow indicated with arrow 430 and empties into the volute scroll 412. Assuming that the intermediate shaft 206 and the impeller 420 are rotating, the flow in the volute scroll 412 is represented with flow arrow 432. Next, the fluid is driven along a flow path through the throat 416 to the expansion chamber 414 as indicated by flow arrow 434. Once in the expansion chamber 414, under sufficient pressure, fluid is discharged out of the outlet 404 along flow path 436. If air is present, it will be separated from fluid in the expansion chamber 414, and fluid not driven out through the outlet 404 will return to the volute scroll 412 through the weep hole 418 along a flow path indicated by arrow 438, priming the centrifugal pump 400.

Figure 28:
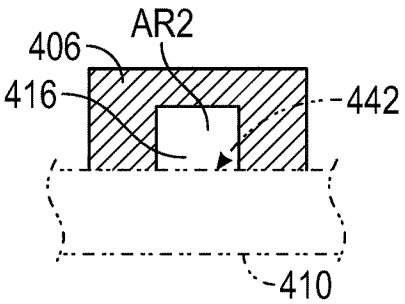
FIG. 28 is a cross-sectional view of a throat of the centrifugal pump taken at lines 28-28 in FIG. 26.
Figure 27:
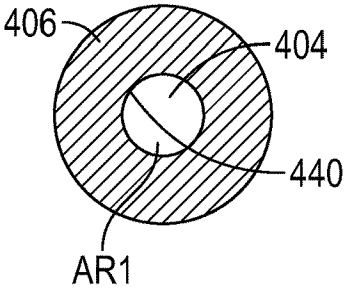
FIG. 27 is a cross-sectional view of a pump casing of the centrifugal pump of FIG. 25 at an outlet of the pump and taken at lines 27-27 in FIG. 25.

The centrifugal pump 400 is specifically configured to optimize the ability to maintain suction at the inlet 402, and to possess the ability to separate air from fluid in the expansion chamber 414 while maintaining adequate pressure at the outlet 404 and sufficient drain back through the weep hole 418 to maintain the pump 400 in a self-primed state. Specifically, FIG. 27 shows a cross-section of the pump casing 406 taken at the outlet 404 at lines 27-27 in FIG. 25. FIG. 27 indicates that the outlet 404 has a cross-sectional area AR1 (e.g., the area of the flow path 436 bounded by an inner perimeter 440 of the pump casing 406 at the outlet 404, which may be generally circular). FIG. 28 shows a cross-section of the pump casing 406 taken at the throat 416 at lines 28-28 in FIG. 26. The pump cover 410 is indicated in phantom in FIG. 28 and is represented with a flat inner surface 442 forming one boundary of the throat 416 along with the casing 406 at the throat 416. The cross-sectional area AR2 of the throat 416 is defined by the pump casing 406 and the pump cover 410 at the cross-section indicated and may be generally square or rectangular. According to one aspect of the present disclosure, a ratio of a cross-sectional area AR2 of the throat 416 to the cross-sectional area AR1 of the outlet 404 is from about 1.35 to about 1.55, about 1.35 to about 1.5, about 1.35 to about 1.45, about 1.35 to about 1.4, about 1.4 to about 1.55, about 1.4 to about 1.5, about 1.4 to about 1.45, about 1.45 to about 1.55, or about 1.45 to about 1.5. In some aspects, a ratio of a cross-sectional area AR2 of the throat 416 to the cross-sectional area AR1 of the outlet 404 is about 1.3, about 1.35, about 1.36, about 1.37, about 1.38, about 1.39, about 1.4, about 1.41, about 1.42, about 1.43, about 1.44, about 1.45, about 1.46, about 1.47, about 1.48, about 1.49, about 1.5, about 1.51, about 1.52, about 1.53, about 1.54, or about 1.55. In one exemplary embodiment, a ratio of a cross-sectional area AR2 of the throat 416 to the cross-sectional area AR1 of the outlet 404 is about 1.44.

Additionally, the volute scroll 412 has a volume V1 when the pump cover 410 is secured to the pump casing 406. The volume extends from the inlet 402 to the throat 416 and includes the entire region in which the impeller 420 rotates. The volume is partially defined by geometry of the inner surface of the pump casing 406 at the volute scroll 412 and by the inner surface 433 of the pump cover 410 facing the impeller 420. According to one aspect of the present disclosure, a ratio of the volume V1 of the volute scroll 412 to the cross-sectional area AR1 of the outlet 404 is about 175 to about 195, about 175 to about 190, about 175 to about 185, about 175 to about 180, about 180 to about 195, about 180 to about 190, about 180 to about 185, about 185 to about 195, or about 185 to about 190. In some aspects, a ratio of the volume V1 of the volute scroll 412 to the cross-sectional area AR1 of the outlet 404 is about 175, about 176, about 177, about 178, about 179, about 180, about 181, about 182, about 183, about 184, about 185, about 186, about 190, about 191, about 192, about 193, about 194, or about 195. In one exemplary embodiment, a ratio of the volume V1 of the volute scroll 412 to the cross-sectional area AR1 of the outlet 404 is about 182. With these particular ratios, the centrifugal pump 400 may operate to provide sufficient pressure at the outlet 404 while maintaining a self-primed flow at the volute scroll 412.

Figure 29:
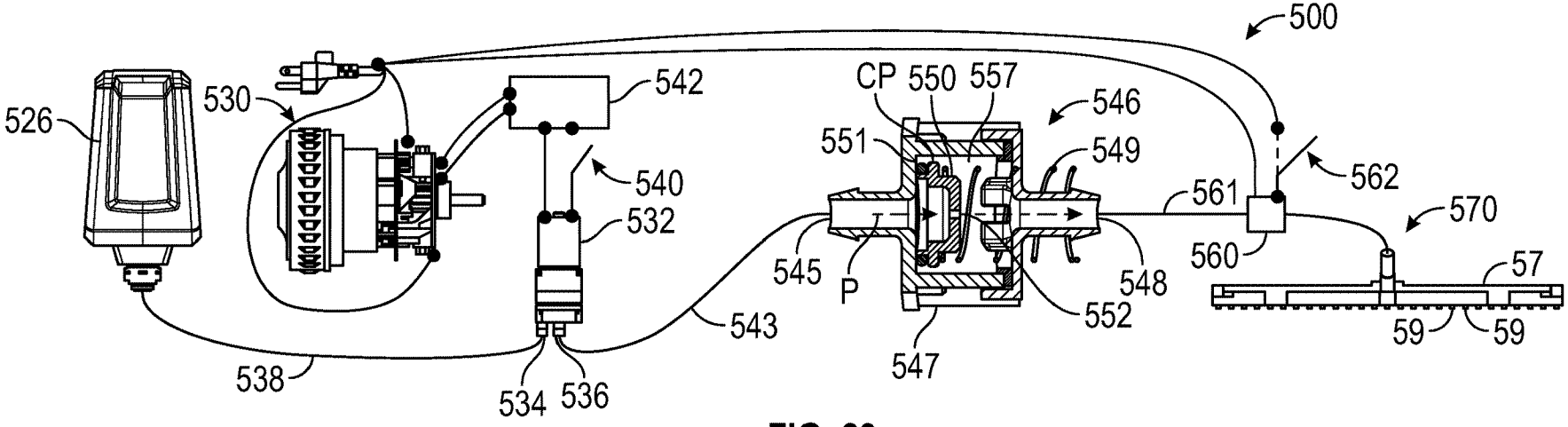
FIG. 29 is a schematic representation of a fluid-dispensing system for the surface cleaner of FIG. 1 in a low flow operating state.
Figure 30:
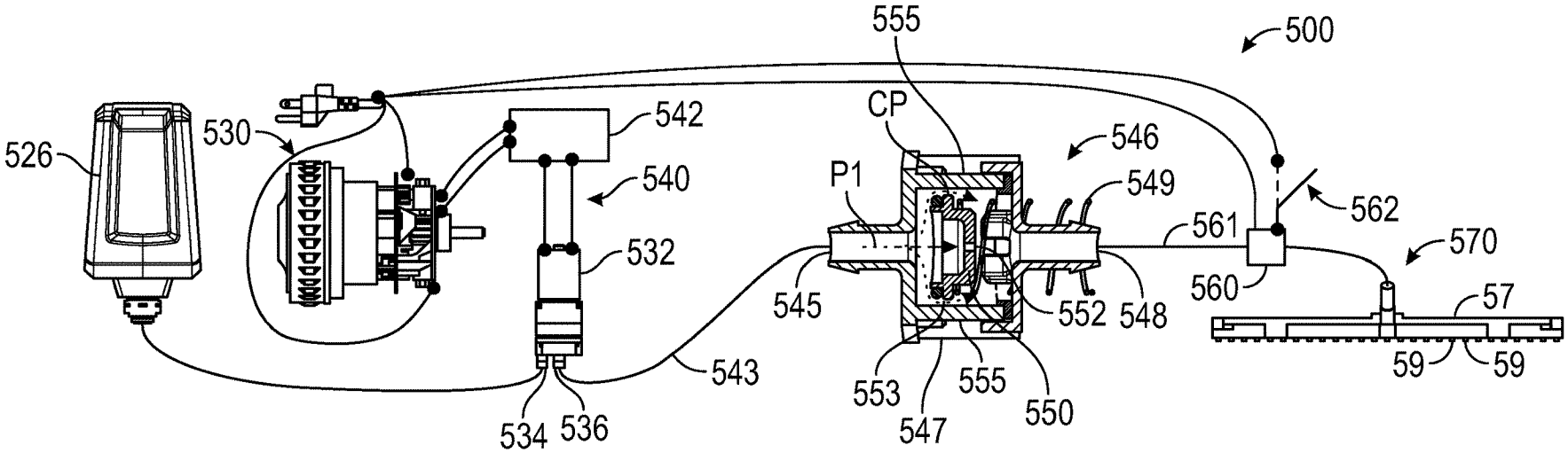
FIG. 30 is a schematic representation of the fluid-dispensing system of FIG. 29 in a high flow operating state.

FIG. 29 is a schematic representation of a fluid-dispensing system 500 that may be implemented on the surface cleaner 10 of FIG. 1 or on a different surface cleaner. The fluid-dispensing system 500 may be employed in the surface cleaner 10 in order to provide the ability to clean with fluid that is applied to the cleaning surface S with a relatively low flow rate (e.g., volume of fluid supplied per minute) or a relatively high flow rate. The relatively low flow rate is referred to as a low flow operating state, and the relatively high flow rate is referred to as a high flow operating state. In FIG. 29, the fluid-dispensing system 500 is depicted as operating in the low flow operating state. In FIG. 30, the fluid-dispensing system 500 is depicted as operating in the high flow operating state.

Referring to FIG. 29, the fluid-dispensing system 500 includes a fluid supply 526. The fluid supply 526 may be the same as clean fluid supply of the supply tank 26 when implemented on the surface cleaner 10. The fluid-dispensing system 500 also includes an electric motor 530 and a centrifugal pump 532. The centrifugal pump 532 is configured to be driven by the electric motor 530 and has an inlet 534 and an outlet 536. The inlet 534 is in fluid communication with the fluid supply 526, such as via a fluid conduit 538.

A pump control switch 540 is operatively connected to the centrifugal pump 532. A rectifier 542 connects the electric motor 530 to the centrifugal pump 532 when the pump control switch 540 is in an on state. An on state of the pump control switch 540 is depicted in FIG. 30 as the pump control switch 540 being closed. The electric motor 530 is not connected to the centrifugal pump 532 when the pump control switch 540 is in the off state. An off state of the pump control switch 540 is depicted in FIG. 29 as the pump control switch 540 being open. The pump control switch 540 may be a mode selection rocker switch disposed on the surface cleaner 10 for operation by the user, and may be labelled Low Flow for the position corresponding with the off state (open switch) and High Flow for the position corresponding with the on state (closed switch), for example. Accordingly, the centrifugal pump 532 is off when the pump control switch 540 is in the off state, and the centrifugal pump 532 is on when the pump control switch 540 is in the on state.

The outlet 536 of the centrifugal pump 532 is in fluid communication with an inlet 545 of a pressure valve 546, such as via a fluid conduit 543. When the centrifugal pump 532 is off (i.e., the pump 532 is off when the switch 540 is in the off state (open)), fluid from the fluid supply 526 simply drains through the centrifugal pump 532 from the inlet 534 to the outlet 536 to reach the pressure valve 546 without the centrifugal pump 532 adding pressure to the fluid. Pressure at this level is indicated as fluid with pressure P supplied to the pressure valve 546 in FIG. 29. A centrifugal pump 532 has the benefit of allowing fluid to pass through it even when off, unlike a positive displacement pump which must be energized to an on state in order for fluid to pass through the pump. When the centrifugal pump 532 is on (i.e., the pump 532 is on when the switch 540 is in the on state (closed)), the centrifugal pump 532 pressurizes the fluid such that fluid entering the fluid conduit 543 through the outlet 536 is pressurized above the pressure level of the fluid in the conduit 538. Pressure at this level is indicated as fluid with pressure P1 supplied to the pressure valve 546 in FIG. 30.

The pressure valve 546 may open to provide a greater flow rate through the pressure valve 546 to an outlet 548 of the pressure valve 546 under higher pressures at the inlet 545. For example, the pressure valve 546 may have a first flow area when under fluid pressure less than a predetermined fluid pressure P1, and a second flow area greater than the first flow area when under fluid pressure greater than or equal to the predetermined fluid pressure P1. The pressure valve 546 includes a valve housing 547 that defines a cavity 557 housing a valve member 550. The valve member 550 is biased toward the inlet 545 and against an internal wall 551 of the housing 547 by a spring 549 to a closed position CP shown in FIG. 29. The valve member 550 has an aperture 552 with a relatively small flow area, referred to as a first flow area, through which fluid must pass when the valve member 550 is in the closed position. For example, the first flow area is the cross-sectional area of the aperture 552. The valve member 550 thus restricts the flow rate to a relatively low flow rate when fluid pressure at the inlet 545 is less than a first predetermined pressure P1.

When fluid pressure at the inlet 545 is greater than or equal to the predetermined pressure P1, the force of the spring 549 is overcome, and the valve member 550 is moved away from the wall 551 by the pressure of the fluid to an open position OP as shown in FIG. 30. Fluid may pass through the valve 546 not only though the aperture 552 in the valve member 550, but may also pass around an outer periphery of the valve member 550 in the open position OP. The valve 546 thus has a greater second flow area when the valve member 550 is in the open position OP. Specifically, the second flow area is the sum of the area of the aperture 552 and the area of the annular passage 553 established between the outer periphery of the valve member 550 and the side walls 555 of the valve housing 547. The spring rate of the spring 549 and the impact surface area (e.g., the surface area of the underside of the valve member 550 facing the inlet 545) are selected so that the valve member 550 remains in the closed position CP when the pump 532 is off, resulting in fluid pressure at the inlet 545 less than the first predetermined pressure P1. When the pump 532 is energized, fluid pressure at the inlet 545 will be greater than or equal to the first predetermined pressure P1, and the increase in driven flow rate will impart a force against the valve member 550, compressing the spring 549, thereby opening the additional flow area around the perimeter of the valve member 550 and increasing the flow through the valve 546.

The fluid-dispensing system 500 may also include a solenoid valve 560 downstream of the pressure valve 546 and connected to the outlet 548 of the pressure valve 546 by a fluid conduit 561. The solenoid valve 560 may have an energized state in which fluid flows through the solenoid valve 560, and a deenergized state in which the solenoid valve 560 completely blocks fluid flow. A trigger 562 may be operable by the user to select the energized state of the solenoid valve 560 and is represented as a switch in FIGS. 29 and 30. For example, the user may pull the trigger 562 to an on position to close a circuit from an electrical source to the solenoid valve 560, selecting an energized state of the solenoid valve 560, which opens the solenoid valve 560 to allow flow. When the trigger 562 is in an off position, selecting a deenergized state of the solenoid valve 560, the solenoid valve 560 is closed to prevent flow. The trigger 562 may be operated in this manner both when the high flow state or the low flow state is selected at the switch 540 and may be represented to the user as an on-off switch. A fluid application device 570 is downstream of the solenoid valve 560 and is operable for applying fluid to the surface to be cleaned. For example the fluid application device 570 may include the manifold 57 with spray outlets 59 shown and discussed with respect to FIG. 6. When the trigger 562 is moved to the energized state, the solenoid valve 560 is open and fluid flows from the outlet 548 of the valve 546 through the solenoid valve 560 and is supplied to the fluid application device 570. The fluid at the fluid application device 570 will be in the relatively low flow state when the switch 540 is open (pump 532 off) and will be in the relatively high flow state when the switch 540 is closed (pump 532 on).

In other embodiments, the fluid-dispensing system 500 could be configured so that the trigger 562 could energize both the pump 532 and the solenoid valve 560 depending upon how the mode selection switch 540 is oriented. In still other embodiments, a circuit interrupt switch could be used to open the circuit for the pump 532 and/or the solenoid valve 560. If a hose was required, the pump 532 could be omitted from this interrupt. Logic software could provide enhanced operations depending on alternate mode selection methods. In still other embodiments, the solenoid valve 560 could be placed before the spray bar, or a mechanical valve could be used instead of the solenoid valve 560.

The fluid-dispensing system 500 with the centrifugal pump 532 could be used in a surface cleaner, such as the surface cleaner 10 when the centrifugal pump 400 driven on the intermediate shaft 206 as discussed herein is not provided. Alternatively, the fluid-dispensing system 500 could be used with the motor drive system having the centrifugal pump 400 in place of the centrifugal pump 532, but the electric motor 530 would be needed to drive the pump 400 as the fluid-dispensing system 500 relies upon electronically controlling the pump to the on state or to the off state.

Figure 32:
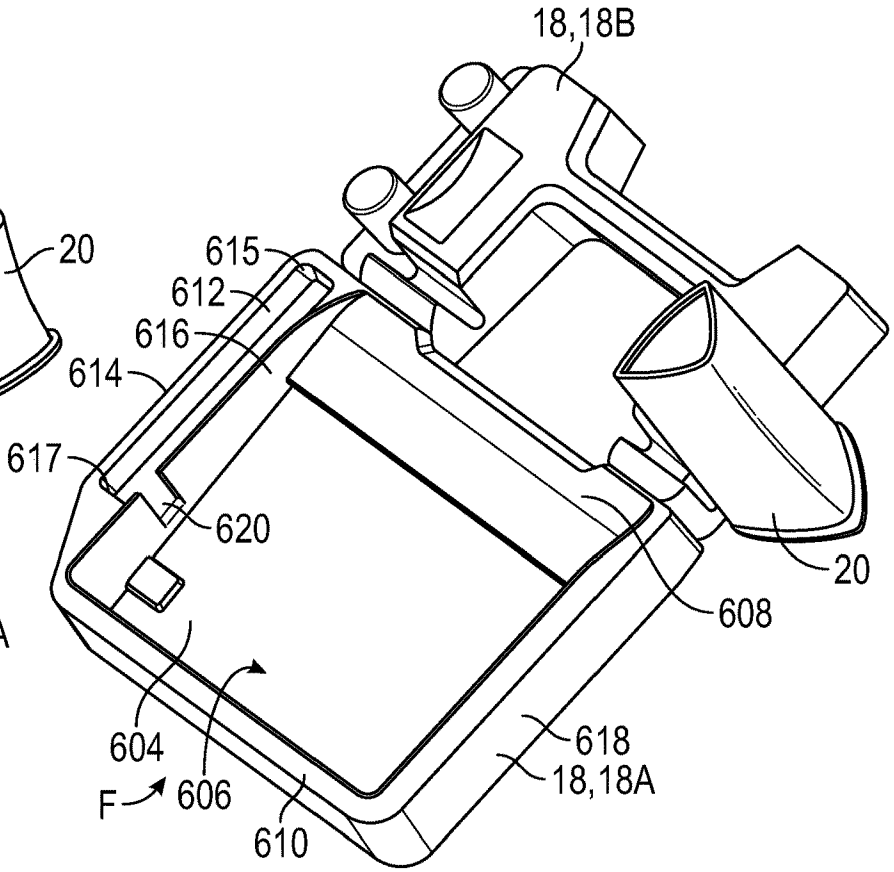
FIG. 32 is a side perspective view of the docking tray of FIG. 31.
Figure 31:
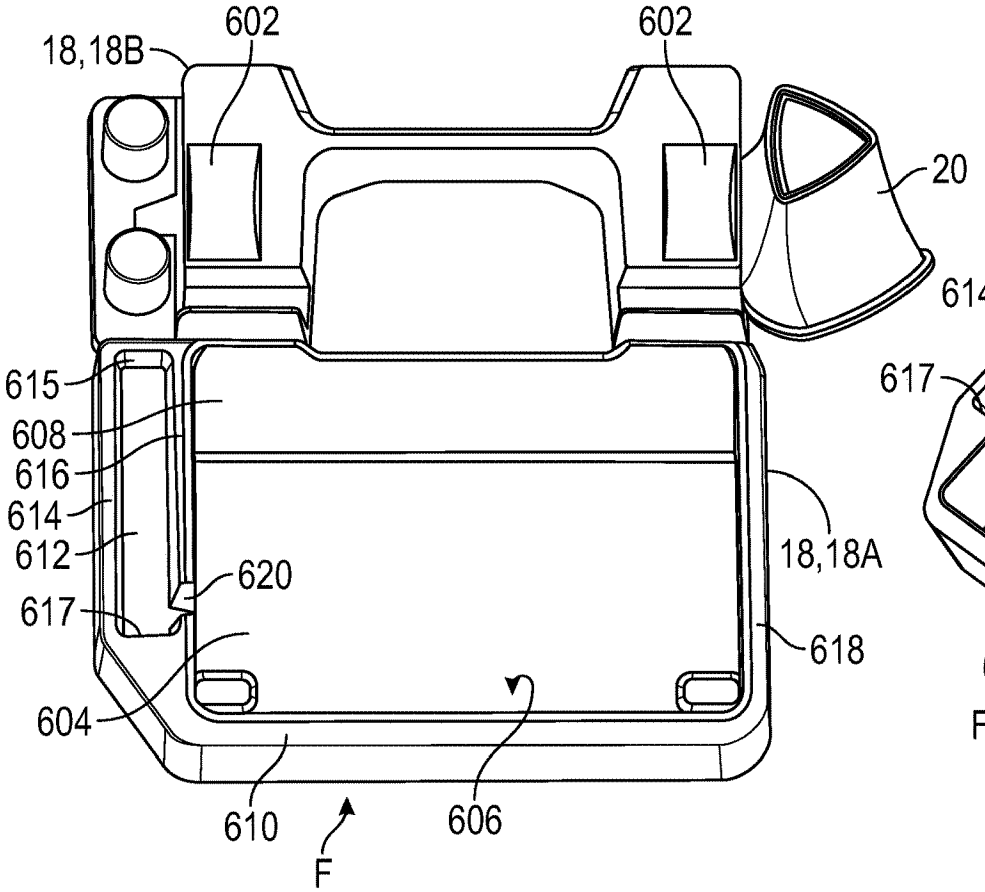
FIG. 31 is a top perspective view of a docking tray for the base of the surface cleaner of FIG. 1.

FIGS. 31 and 32 show the docking tray 18 of FIG. 1 and the fill cup 20 supported on the docking tray 18. The docking tray 18 may be referred to as a clean-out system for periodically cleaning the agitator assembly 46 of the base 12 after one or more uses of the surface cleaner 10. The docking tray 18 has a front tray portion 18A and a rear tray portion 18B The front part of the base 12, including the nozzle 21 and agitator assembly 46, rests in the front tray portion 18A when the surface cleaner 10 is docked, as in FIG. 1. The wheels 38 of FIGS. 1 and 2 are lodged in recesses 602 to retain the surface cleaner 10 on the docking tray 18.

The docking tray 18 defines a reservoir 604 that may be referred to as a main reservoir. The docking tray 18 has a bottom surface 606 that angles downward from a rear wall 608 bounding a rear of the main reservoir 604 to a front wall 610 bounding a front of the main reservoir 604 so that the main reservoir 604 increases in depth toward the front F and fluid in the docking tray 18 pools at a front of the main reservoir 604.

The tray 18 also defines a filling trough 612 that extends along a side the main reservoir 604. The filling trough 612 is defined between a right side wall 614 and an intermediate wall 616 of the tray 18. Like the main reservoir 604, the filling trough 612 may also increase in depth from a rear wall 615 of the filling trough 612 to a front wall 617 of the filling trough 612. The intermediate wall 616 separates the main reservoir 604 from the filling trough 612. The main reservoir 604 extends from the intermediate wall 616 to a left side wall 618. The docking tray 18 also defines a channel 620 that extends through the intermediate wall 616 and connects the main reservoir 604 with the filling trough 612. The channel 620 is at the front of the filling trough 612, at or near the front wall 617, or is at least nearer to the front wall 617 than to the rear wall 615. The main reservoir 604 extends further forward toward the front wall 610 of the docking tray 18 than does the filling trough 612. Stated differently, the front wall 610 of the main reservoir 604 is further forward than the front wall 617 of the filling trough 612. Both the main reservoir 604 and the filling trough 612 are open from the top side.

The docking tray 18 is thus configured such that the base 12 may be parked on the tray 18 before any fluid is deposited in the tray 18. With the base 12 parked on the tray 18, fluid is poured into the filling trough 612 and flows into the main reservoir 604 through the channel 620. The filling trough 612 helps prevent splashing of the fluid out of the tray 18 which could occur if fluid was first poured into the main reservoir 604 and then the base 12 is parked on the tray 18, or if fluid was poured directly into the main reservoir 604 with the base 12 already parked on the tray 18 (e.g., poured into a small space between the outer edge of the base 12 and the tray 18). The tray 18 thus allows the brush rolls 54 to be cleaned with greater ease due to the convenient filling trough 612.

The nozzle 21 and the brush rolls 54 may be cleaned with solution in the main reservoir 604 by powering the surface cleaner 10 (i.e., selecting the on state) when docked on the tray 18. The steps for cleaning the brush rolls 54 using the tray 18 are listed below.

Step 1. Place the base 12 on the tray 18 with the spine assembly 14 in the upright position.

Step 2. Pour cleaning fluid (e.g., water, cleaner, or a mixture of water and cleaner) into the filling trough 612. The filling cup 20 may be used to pour the fluid. The fluid will flow through the channel 620 from the filling trough 612 into the main reservoir 604 where the fluid can contact the brush rolls 54 and the suction nozzle 21.

Step 3. Open the accessory hose door 29. Fluid will not flow to the recovery tank 28 when the accessory hose door 29 is open.

Step 4. Press the release button 300 and move the spine assembly 14 to the reclined position of FIG. 2, causing the agitator assembly 46 (including the brush rolls 54) to lower as described herein so that they come more fully into contact with the cleaning fluid in the main reservoir 604.

Step 5. Turn on the surface cleaner 10. In an embodiment, the surface cleaner 10 may default to a mode that includes liquid and steam dispensed when the trigger 562 described in FIGS. 29 and 30 is pulled, for example. However, the surface cleaner 10 may be in any of various modes during brush cleaning on the tray 18, and the user is not instructed to pull the trigger 562.

Step 6. Allow the surface cleaner 10 to run to clean the brush rolls 54 for a predetermined amount of time (e.g., 30 seconds).

Step 7. Pivot the spine assembly 14 back to the upright position.

Step 8. Close the accessory hose door 29 to allow the surface cleaner 10 to suction the liquid from the main reservoir 604 into the recovery tank 28 through the suction nozzle 21.

Step 9. Remove the recovery tank 28 from the spine assembly 14.

Step 10. Empty the recovery tank 28, such as into a sink.

Figure 34:
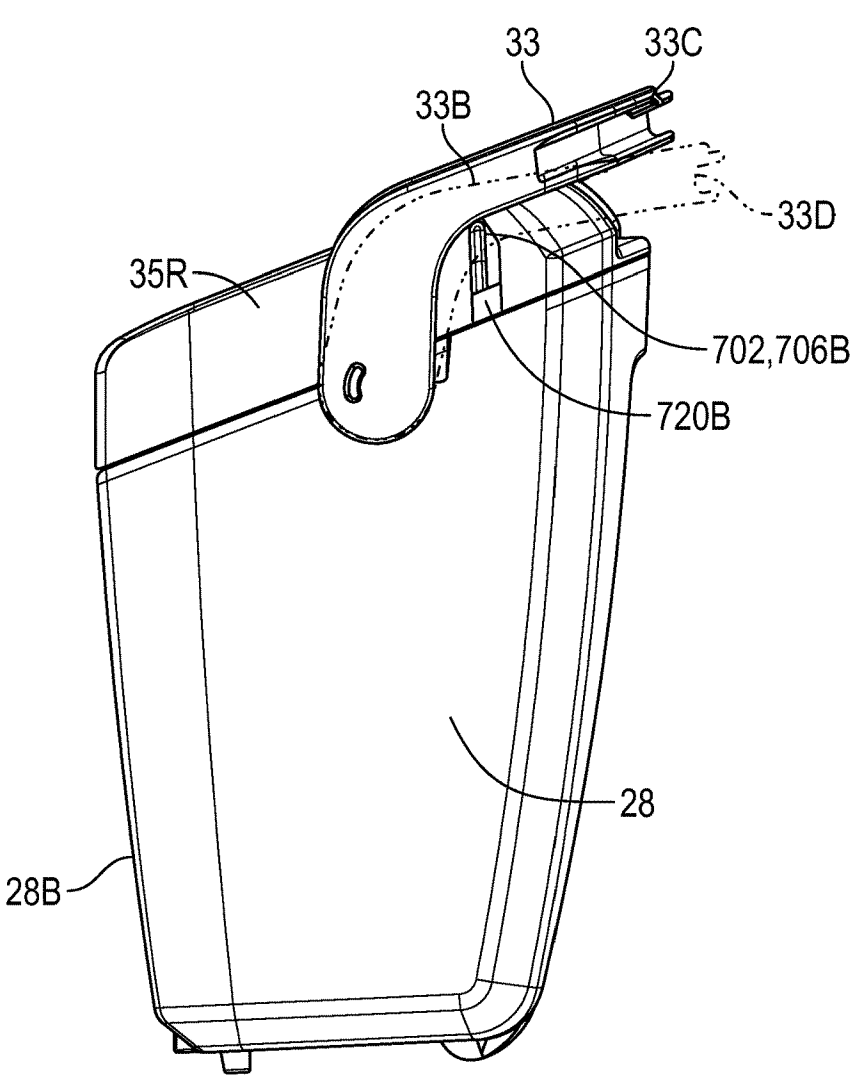
FIG. 34 is a side view of the recovery tank assembly of FIG. 33 and showing the handle in a lowered position in phantom.

In some embodiments, the recovery tank 28 may be secured to the spine assembly 14 via a spring-biased mounting mechanism 702 in the lid 35, so that removing the recovery tank 28 from the spine assembly 14 in Step 9 may include several sub-steps, including pressing down on a handle 33 that is pivotably secured to the lid 35 on the recovery tank 28 to move the handle 33 to a lowered position (shown in phantom in FIG. 34). The handle 33 and lid 35 are indicated in FIG. 1. The handle 33 is in a lifted position in FIG. 1. After pressing down on the handle 33, Step 9 may include the sub-step of tilting the top of the recovery tank 28 near the handle 33 outward toward the front F, and the sub-step of lifting the recovery tank 28 up and away from the spine assembly 14.

Figure 33:
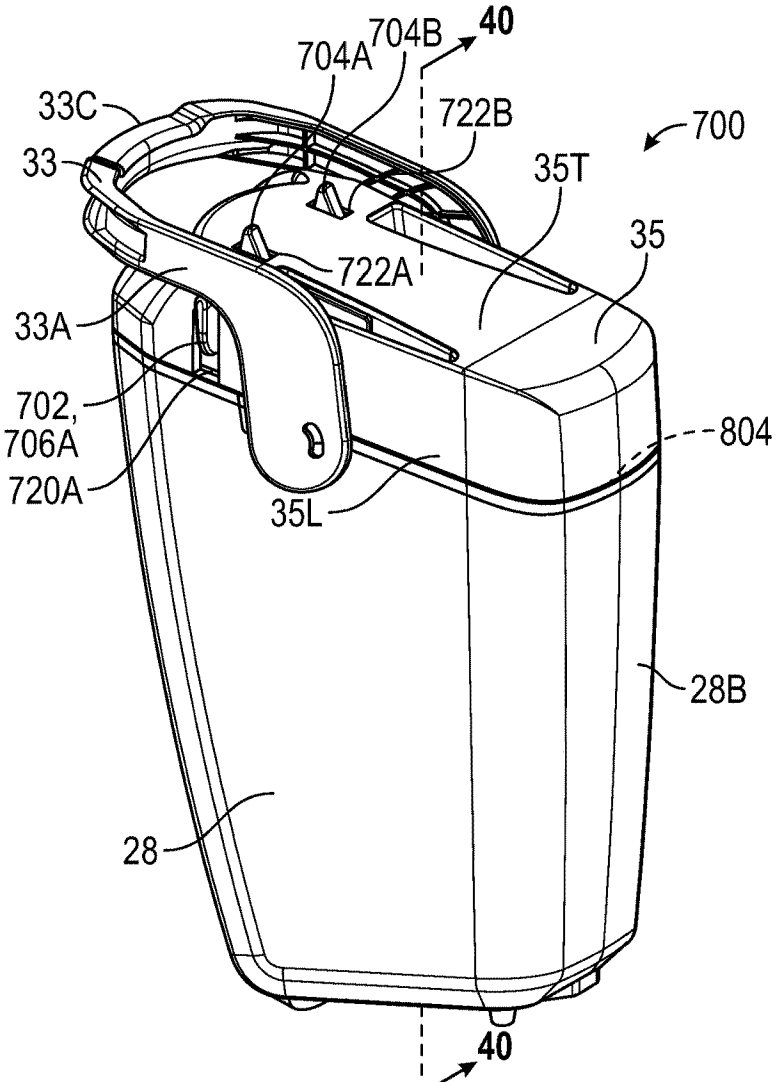
FIG. 33 is a perspective view of a recovery tank assembly including the recovery tank shown in FIG. 1, showing a handle in a raised position.

FIG. 33 shows a recovery tank assembly 700 that includes the recovery tank 28, the lid 35, the handle 33, and a spring-biased mounting mechanism 702 (best shown in FIGS. 36-37), as well as other components and features as discussed herein. The recovery tank assembly 700 is specifically designed to automatically secure to the frame 24 of the spine assembly 14 when seated on a lower platform 24A of the frame 24 (shown in FIG. 38), and to be easily removed by first pivoting the handle 33 to the lowered position to disengage the recovery tank assembly 700 from the frame 24 and then lifting the recovery tank assembly 700 away from the frame 24.

Figure 36:
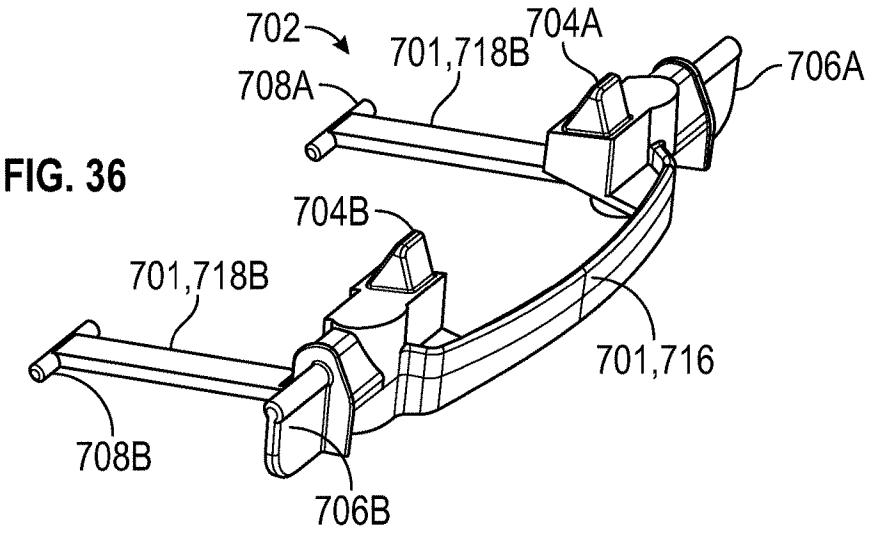
FIG. 36 is a perspective view of a spring-biased mounting mechanism included in the recovery tank assembly of FIG. 33.
Figure 37:
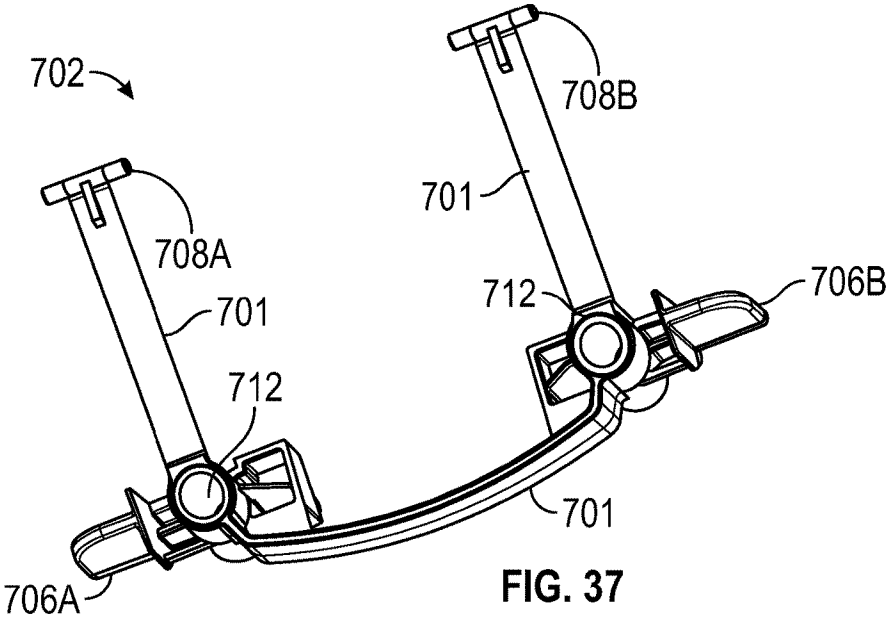
FIG. 37 is another perspective view of the spring-biased mounting mechanism of FIG. 36.

More specifically, the spring-biased mounting mechanism 702 is operable to selectively secure the lid 35 to the frame 24 by automatically engaging the frame 24 when the recovery tank assembly 700 is seated on the frame 24. With reference to FIGS. 36 and 37, the spring-biased mounting mechanism 702 has a body 701 with a first top projection 704A, a second top projection 704B, a first side arm 706A, and a second side arm 706B. The body 701 also has pivot posts 708A,708B that are retained at stanchions 710A, 710B of the lid 35 (shown in FIG. 43). The body 701 includes a front rail 716 extending laterally between the top projections 704A, 704B, and spaced legs 718A, 718B that extend rearwardly to the pivot posts 708A, 708B, respectively. An underside of the spring-biased mounting mechanism 702 has spring-retaining channels 712 in which springs 714 (shown in FIG. 42) are retained. The springs 714 rest against a surface 715 of a bottom wall 35A of the lid 35, biasing the body 701 to an upward position (e.g., away from the surface 715).

As shown in FIGS. 33 and 34, the lid 35 has a first side window 720A in a left side wall 35L of the lid 35, and a second side window 720B in a right side wall 35R of the lid 35. The first side arm 706A extends through the first side window 720A and the second side arm 706B extends through the second side window 720B when the spring-biased mounting mechanism 702 is disposed on the lower wall 35A of the lid 35.

FIGS. 33 and 34 show that a top wall 35T of the lid 35 includes a first top window 722A and a second top window 722B spaced apart from the first top window 722A. The spacing of the top windows 722A, 722B is such that the first top projection 704A extends through the first top window 722A and the second top projection 704B extends through the second top window 722B when the body 701 is biased away from the bottom wall 35A by the springs 714.

The handle 33 has spaced side arms 33A, 33B, and a center segment 33C that connects the side arms 33A, 33B. The side arm 33A of the handle 33 rests on the side arm 706A of the spring-biased mounting mechanism 702, and side arm 33B of the handle 33 rests on the side arm 706B of the spring-biased mounting mechanism 702. The biasing force of the springs 714 is sufficient to maintain the center segment 33C of the handle 33 in a lifted position (also referred to as a raised position) shown in FIG. 33 in the absence of an external force depressing the handle 33.

Ends of the side arms 33A, 33B are pivotably retained on external hubs 726A, 726B (see FIG. 44) of the recovery tank 28 and the handle 33 pivots about a pivot axis extending through the center of the hubs 726A, 726B. Optionally, the handle 33 may have a locking feature that allows it to be selectively locked to the lid 35. For example, each of the side walls 35L, 35R of the lid 35 may have an arcuate rib overlying the respective hub 726A, 726B. The inner side of each side arm 33A, 33B of the handle 33 may have an arcuate rib that overlies the arcuate rib of the respective side wall 35L, 35R both when the handle 33 is in the lifted position of FIG. 34 or the lowered position 33D (also referred to as a depressed position) shown in phantom in FIG. 34. In such an embodiment, the handle 33 may be pivoted approximately 90 degrees counterclockwise from the position shown in FIG. 34 to move the ribs on the handle 33 so that they no longer overlie the ribs on the lid 35, allowing the lid 35 to be lifted off of the recovery tank 28

When the center segment 33C is depressed to the lowered position, the side arms 33A, 33B of the handle 33 interfere with the side arms 706A, 706B, pushing the side arms 706A, 706B of the spring-biased mounting mechanism 702 downward within the side windows 720A, 720B, depressing the springs 714 and simultaneously moving the top projections 704A, 704B downward, causing the top projections 704A, 704B to lower to an extent that they no longer extend through the top windows 722A, 722B.

Figure 35:
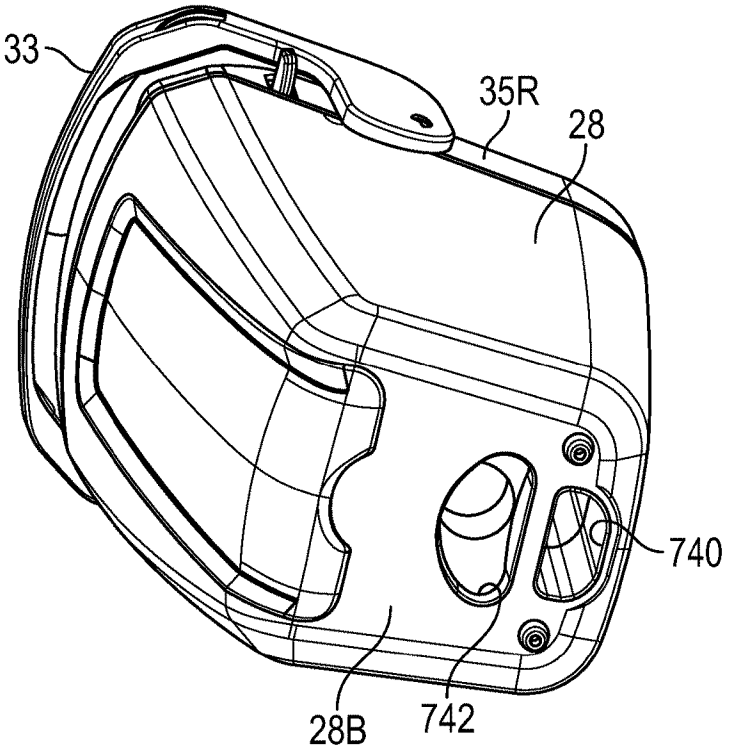
FIG. 35 is a perspective bottom view of the recovery tank assembly of FIG. 33.
Figure 38:
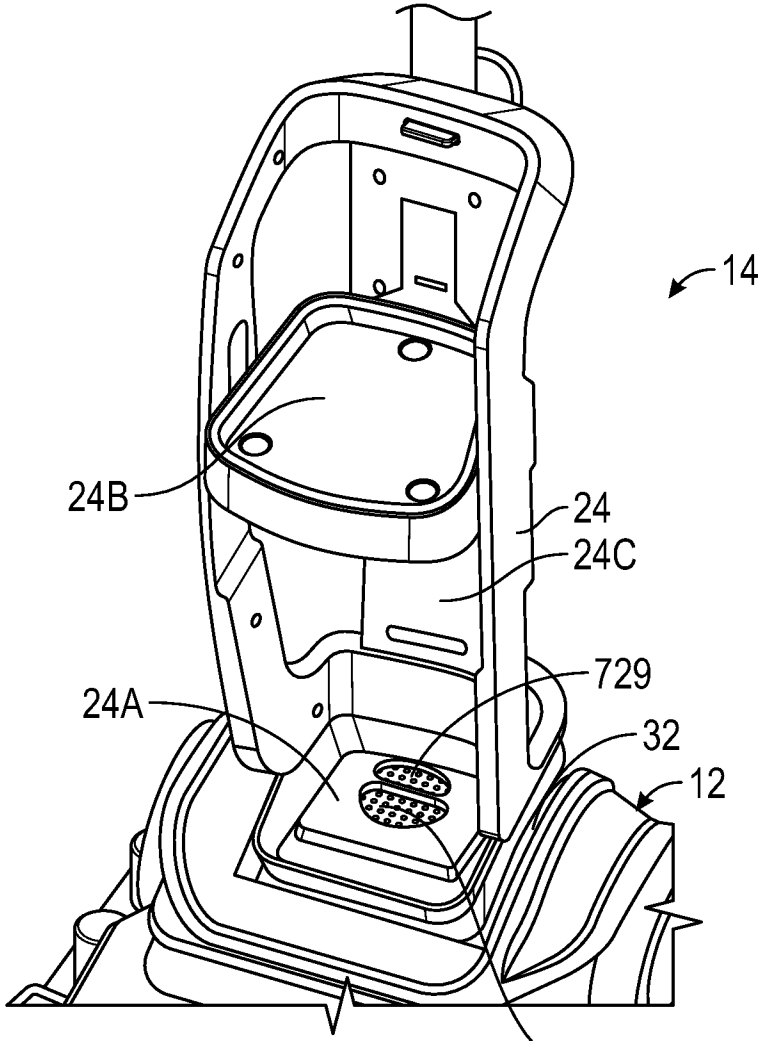
FIG. 38 is a fragmentary perspective view of the surface cleaner of FIG. 1 with both the recovery tank assembly and a supply tank removed.

FIG. 38 is a fragmentary perspective view of the surface cleaner 10 with both the recovery tank assembly 700 and the supply tank 26 removed. The frame 24 includes a lower platform 24A and an upper platform 24B. The supply tank 26 can be seated on the upper platform 24B to rest above the recovery tank assembly 700, as in FIG. 1. The recovery tank assembly 700 is configured to fit to the frame 24 with a bottom wall 28B of the recovery tank 28 (shown in FIG. 35) resting on the lower platform 24A. FIG. 38 shows that the lower platform 24A has an opening that is a recovery conduit outlet 729 in the base 12 and another opening forward of the recovery conduit outlet 729 that is a motor conduit inlet 731 in the base 12. Suction air flow that begins at the nozzle 21 and flows through conduits within the base 12 and/or the spine assembly 14 arrives at the recovery conduit outlet 729 where the mixed air and liquid stream is received by the recovery tank 28 as discussed herein. The mixed air and liquid stream may be referred to as working liquid/air, as it includes both liquid and air, as well as entrained dirt removed from the surface S of FIG. 2. An air/liquid separator system 800 discussed herein enables the recovery tank 28 to collect the liquid in the mixed air and liquid stream generated in the base 12. More specifically, the air/liquid separation system 800 separates the liquid from the mixed air and liquid stream, depositing it in the recovery tank 28 for subsequent disposal, and provides separated air to the motor conduit inlet 731, protecting a motor assembly therein from liquid. The motor conduit inlet 731 is shown with a screen extending over the inlet 731.

Figure 39:
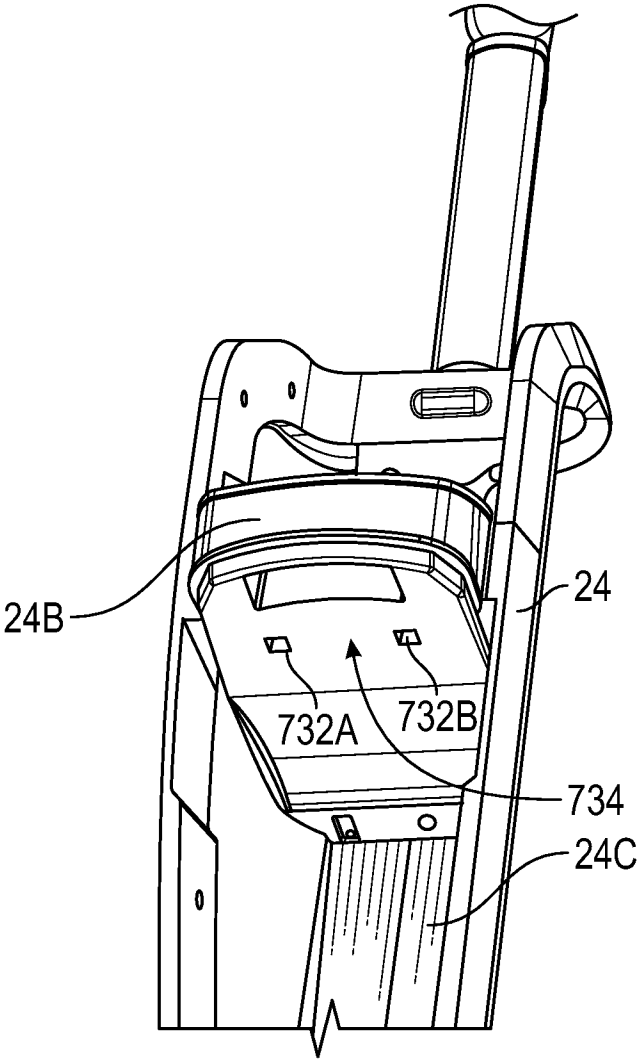
FIG. 39 is another fragmentary perspective view of the surface cleaner of FIG. 38.

FIG. 39 shows that a lower side 734 of the upper platform 24B includes a first aperture 732A and a second aperture 732B spaced apart from the first aperture 732A. The apertures 732A, 732B may be recesses or notches in the lower side 734 of the upper platform 24B. The recovery tank 28 is configured to fit to the frame 24 with the lid 35 secured to the recovery tank 28, the first top projection 704A extending in the first aperture 732A and the second top projection 704B extending in the second aperture 732B, and the handle 33 in the lifted position. As the recovery tank 28 is installed on the spine assembly 14, the user depresses the handle 33 to the lowered position 33D, which depresses the side arms 706A, 706B, as discussed, lowering the top projections 704A, 704B so that they do not extend through the top windows 722A, 722B, allowing the recovery tank 28 to be slid toward a back wall 24C of the frame 24. More specifically, the recovery tank assembly 700 is slid toward a back wall 24C of the frame 24 until the bottom wall 28B is fully seated on the lower platform 24A. During insertion, the top wall 35T slides along the lower side 734 of the upper platform 24B.

Once the recovery tank 28 is fully seated on the lower platform 24A, the top windows 722A, 722B will be directly under the apertures 732A, 732B, respectively. Releasing the handle 33 at this point releases the downward pressure on the side arms 706A, 706B and hence on the springs 714, allowing the top projections 704A, 704B to move back into the extended positions shown in FIG. 33, in which they will extend into the apertures 732A, 732B in the frame 24. When fully seated with the top projections 704A 704B in the apertures 732A, 732B, a liquid/air mixture inlet 740 (also referred to as a working liquid/air inlet) in the bottom wall 28B of the recovery tank 28 (see FIG. 35) will be disposed directly over the recovery conduit outlet 729, and a separated air outlet 742 (also referred to as a working air outlet) in the bottom wall 28B will be disposed directly over the motor conduit inlet 731.

To remove the recovery tank assembly 700 from the frame 24, the handle 33 is depressed to the lowered position 33D to withdraw the top projections 704A, 704B from the apertures 732A, 732B and allow the recovery tank assembly 700 to be tilted forward and lifted away from the frame 24.

The air/liquid separation system 800 of the surface cleaner 10 functions to separate the liquid from the air that is expelled at the recovery conduit outlet 729 to provide separated air (e.g., without liquid) at the motor conduit inlet 731. The air/liquid separation system 800 includes the recovery tank 28, a plurality of vertical walls disposed within a tank chamber 802 of the recovery tank 28 and defining an inlet stack 806 and an outlet stack 808 as discussed herein, the lid 35, and a float 830 disposed in the tank chamber 802.

Figure 44:
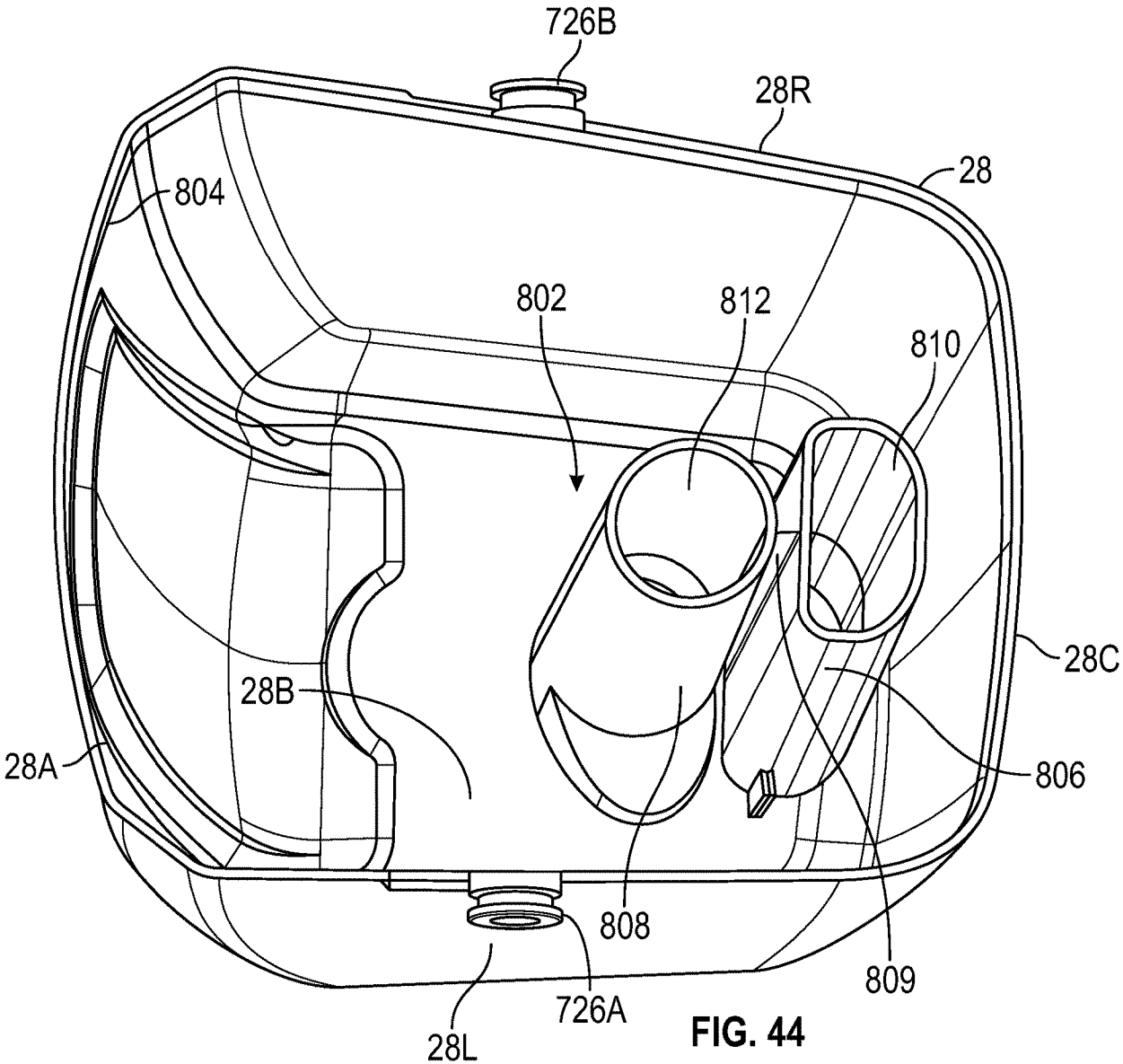
FIG. 44 is a top perspective view of a portion of the recovery tank assembly with the lid, the handle, and the float removed.

Referring to FIG. 44, the recovery tank 28 has the bottom wall 28B, a front side wall 28A, a rear side wall 28C, a right side wall 28R and a left side wall 28L. The side walls 28A, 28C, 28R, and 28L extend upward from the bottom wall 28B and define the tank chamber 802 and a top opening 804. The lid 35 is securable to the recovery tank 28 to extend over the top opening 804, as shown in FIG. 33. For example, a lower peripheral edge of the lid 35 may fit within a channel at the top of the side walls 28A, 28C, 28R, and 28L that define a periphery of the top opening 804.

FIG. 44 also shows a plurality of vertical walls 806, 808, and 809 disposed within the tank chamber 802. The vertical wall 806 surrounds a vertical column and may be referred to as an inlet stack 806. The vertical wall 808 surrounds another vertical column and may be referred to as an outlet stack 808. For stability, a connector wall 809 extends between and connects an exterior of the inlet stack 806 to an exterior of the outlet stack 808.

The inlet stack 806 extends upward and around the liquid/air mixture inlet 740 of the bottom wall 28B so that the liquid/air mixture inlet 740 (also referred to as a working liquid/air inlet) is an inlet of the inlet stack 806 at the bottom of the inlet stack 806. The inlet stack 806 has an outlet 810 at a top of the inlet stack 806. The outlet stack 808 extends upward around the separated air outlet 742 (also referred to as a working air outlet) which is also the outlet of the outlet stack 808 at the bottom of the outlet stack 808. The outlet stack 808 has an inlet 812 at the top of the outlet stack 808 and the outlet of the outlet stack 808 is the separated air outlet 742 (also referred to as a working air outlet) and is at a bottom of the outlet stack 808. The mixed air and liquid stream is thus introduced into the recovery tank 28 at the bottom of the inlet stack 806 as evidenced by arrow 850 and the separated air is discharged from the recovery tank 28 at the bottom of the outlet stack 808 as evidenced by arrow 852.

Figure 41:
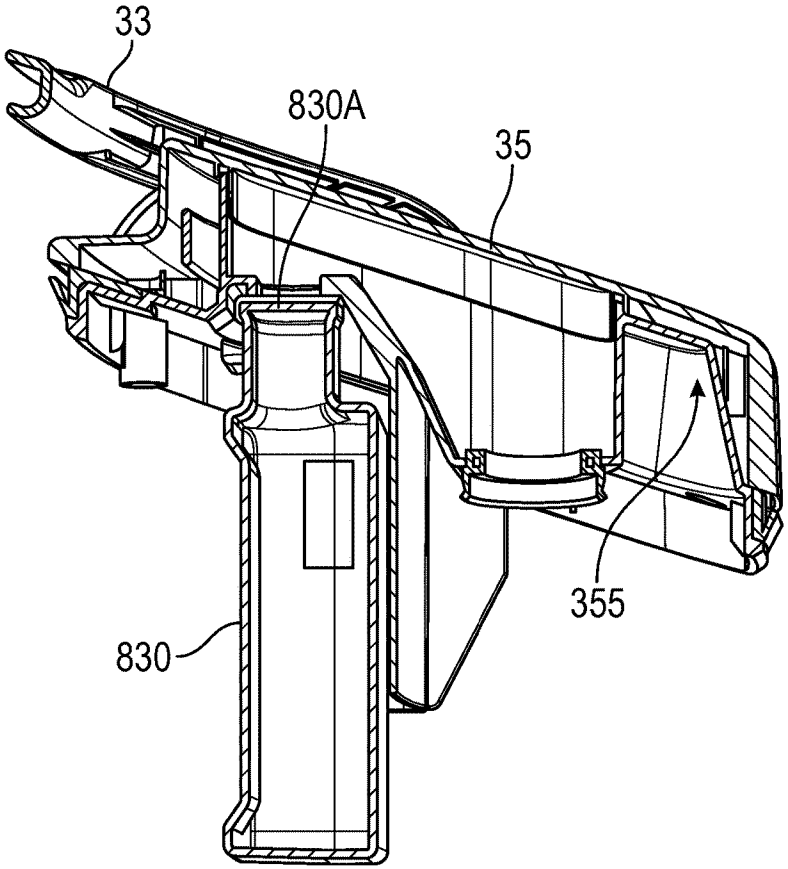
FIG. 41 is a cross-sectional view of the lid, the handle, and the float of the recovery tank assembly of FIG. 41.
Figure 40:
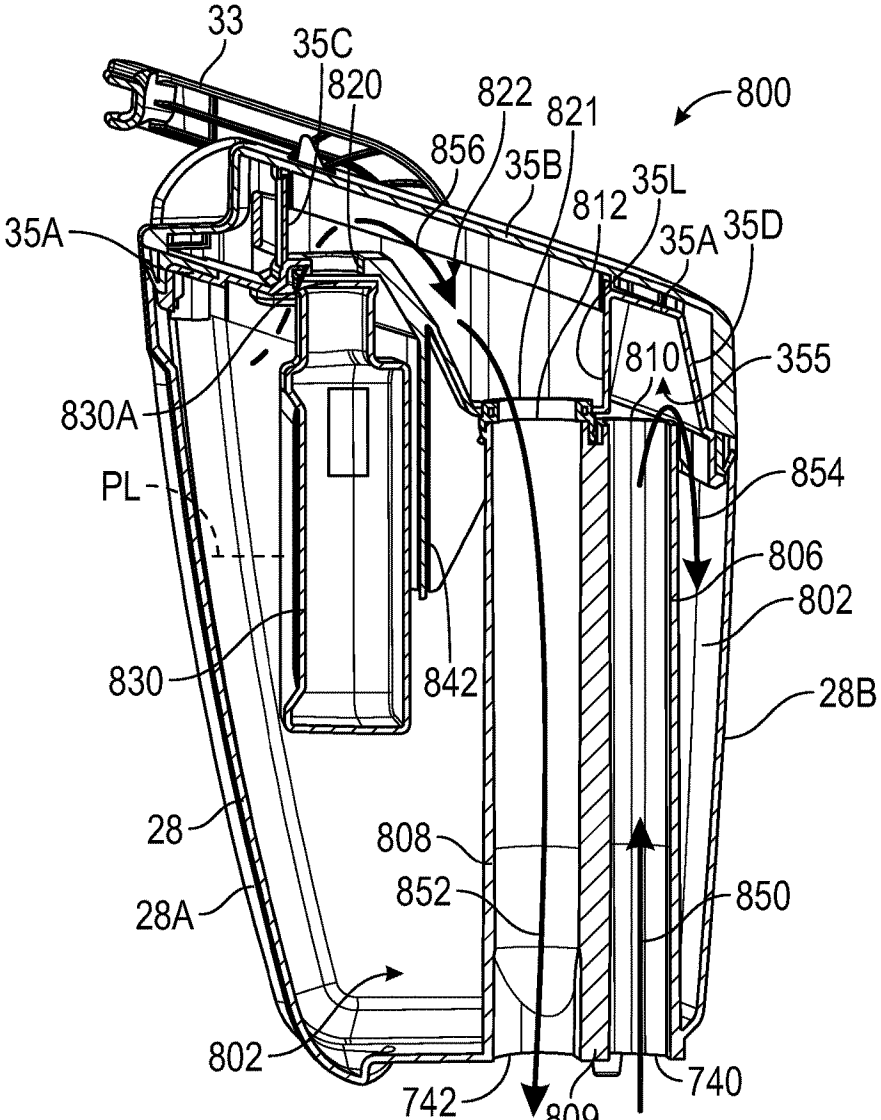
FIG. 40 is a cross-sectional view of the recovery tank assembly taken at lines 40-40 in FIG. 33.

Referring to FIGS. 40 and 41, in addition to the bottom wall 35A, the lid 35 includes a top wall 35B, and an internal wall 35C that extends between the top wall 35B and the bottom wall 35A. The bottom wall 35A has a first lid chamber opening 820 and a second lid chamber opening 821 rearward of the first lid chamber opening 820. The second lid chamber opening 821 is at the inlet 812 of the outlet stack 808. The internal wall 35C extends around the first lid chamber opening 820 and the second lid chamber opening 821 so that a lid chamber 822 is defined between the top wall 35B, the bottom wall 35A, and the internal wall 35C over the lid chamber openings 820, 821 and the inlet 812 of the outlet stack 808.

Another internal wall 35D extends upward from the bottom wall 35A and forward of the internal wall 35C. A top wall 35E extends over the inner wall 35C to define an inverted channel 355 open to the tank chamber 802 and above the outlet 810 of the inlet stack 806. The internal forward portion of the internal wall 35C, the internal wall 35D, and the top wall 35E serve as a baffle 35C, 35D, 35E over the outlet 810 that directs fluid in the mixed fluid and air exiting the inlet stack 806 through the outlet 810 to fall downward by gravity into the tank chamber 802 as illustrated by arrow 854 in FIG. 40. The air within the mixed fluid and air will separate from the liquid and gather above the liquid level in the tank chamber 802.

Figure 42:
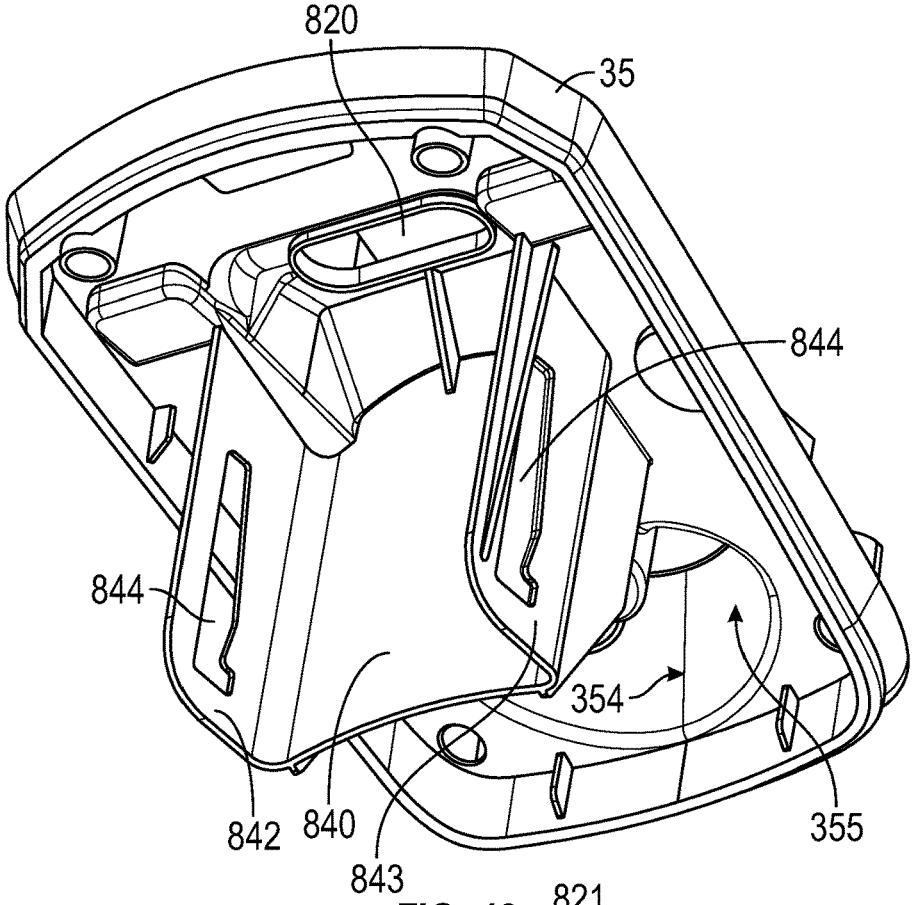
FIG. 42 is a bottom perspective view of a portion of the lid.
Figure 43:
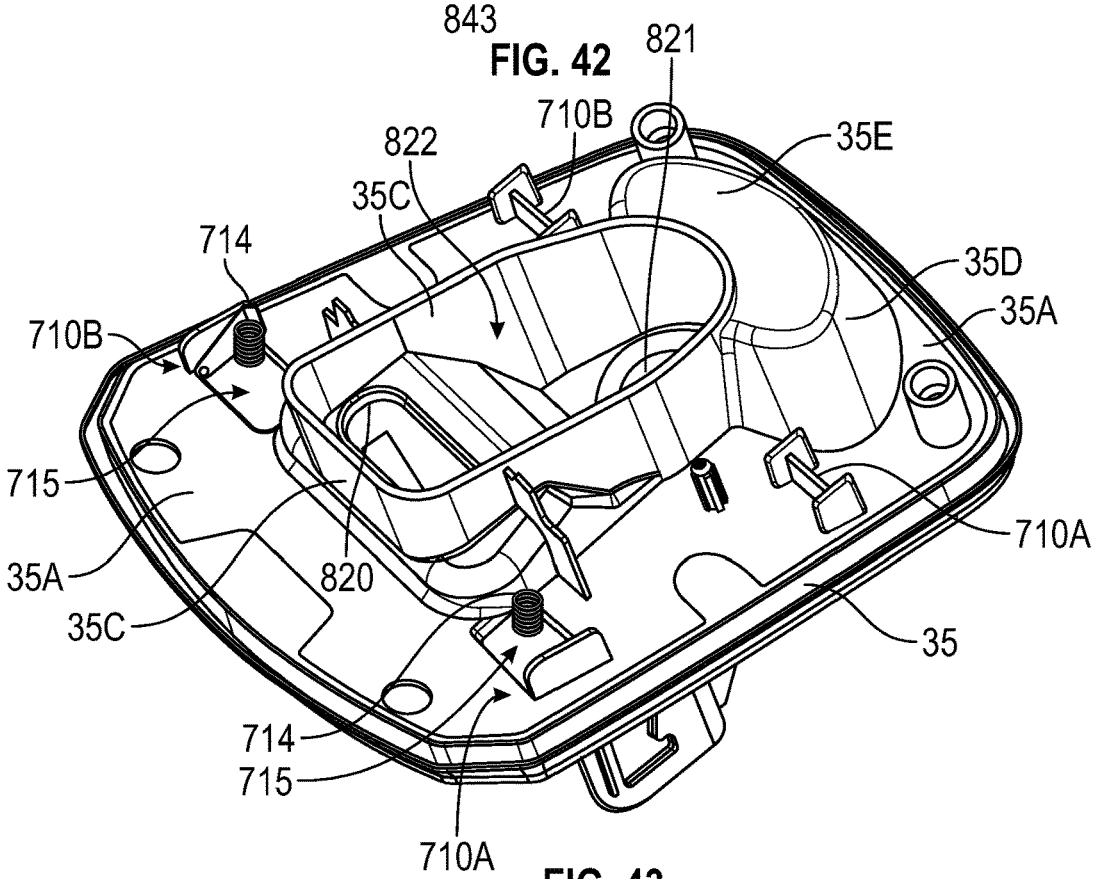
FIG. 43 is a top perspective view of the portion of the lid of FIG. 42.

A float 830 is disposed within the tank chamber 802 and is operatively attached to and vertically translatable relative to the lid 35. More specifically, the lid 35 includes float guide walls 840, 842, 843 that extend downward from the bottom wall 35A as shown in FIG. 42. The float 830 moves up and down within the tank chamber 802 within an area bounded by the guide walls 840, 842, 843. A guide slot 844 extends through each of the guide walls 842, 842. The float 830 may include side extensions that extend through the guide slots 844 so that the float 830 is operatively attached to the lid 35 and is vertically translatable relative to the lid 35 between a lowest position in which the guide extensions are at the bottom of the guide slots 844 to a highest position in which the float 830 closes the first lid cover opening 820.

The float 830 is configured to close the first lid chamber opening 820 when liquid within the tank chamber 802 reaches a predetermined level PL. In other words, the float 830 is lifted upward toward the first lid chamber opening 820 on the liquid collected in the tank chamber 802 until the top of the float 830 closes the first lid chamber opening 820 when the liquid reaches the predetermine level PL indicated with dashed lines in FIG. 40. When liquid in the tank chamber 802 is below the predetermined level PL, the separated air gathered above the liquid in the tank chamber 802 can exit the tank chamber 802 through the first lid chamber opening 820 and enter the lid chamber 822 (as indicated by arrow 856), then passing into the outlet stack 808 through the second lid chamber opening 821 and the inlet 812. In FIGS. 40 and 41, the float 830 is shown in the closed position 830A in which a top of the float 830 fits to and seals against the first lid chamber opening 820. However, if the liquid level in the tank chamber 802 is below the predetermined level PL, the float 830 will move downward from the closed position 830A shown to an open position, moving the top of the float 830 away from the first lid chamber opening 820.

The first lid chamber opening 820 is disposed higher in the tank chamber 802 than the outlet 810 of the inlet stack 806 and higher than the inlet 812 of the outlet stack 808, as best shown in FIGS. 40 and 41. The first lid chamber opening 820, the outlet stack 808, and the inlet stack 806 are oriented front to back in the tank chamber 802. Stated differently, the inlet stack 806 is disposed rearward of the outlet stack 808, and the first lid chamber opening 820 is disposed forward of the outlet stack 808. In addition, because the first lid chamber opening 820, the outlet stack 808, and the inlet stack 806 are oriented front to back in the tank chamber 802, this results in the float 830, the outlet stack 808, and the inlet stack 806 being oriented front to back in the tank chamber 802.

Once removed from the frame 24, the handle 33, the lid 35, and the attached float 830 are removable from the recovery tank 28 as a unit, as shown in FIG. 41, by simply pulling upward on the handle 33 to lift the lid 35 off of the recovery tank 28, exposing the top opening 804, or by grasping the sides of the lid 35 and pulling upward on the lid 35. When the handle 33, the lid 35, and attached float 830 are removed, the inlet stack 806 and the outlet stack 808 remain within the tank chamber 802. The recovery tank 28 can be easily emptied of the captured liquid separated from the working liquid air stream by tipping the recovery tank 28.

Figure 45:
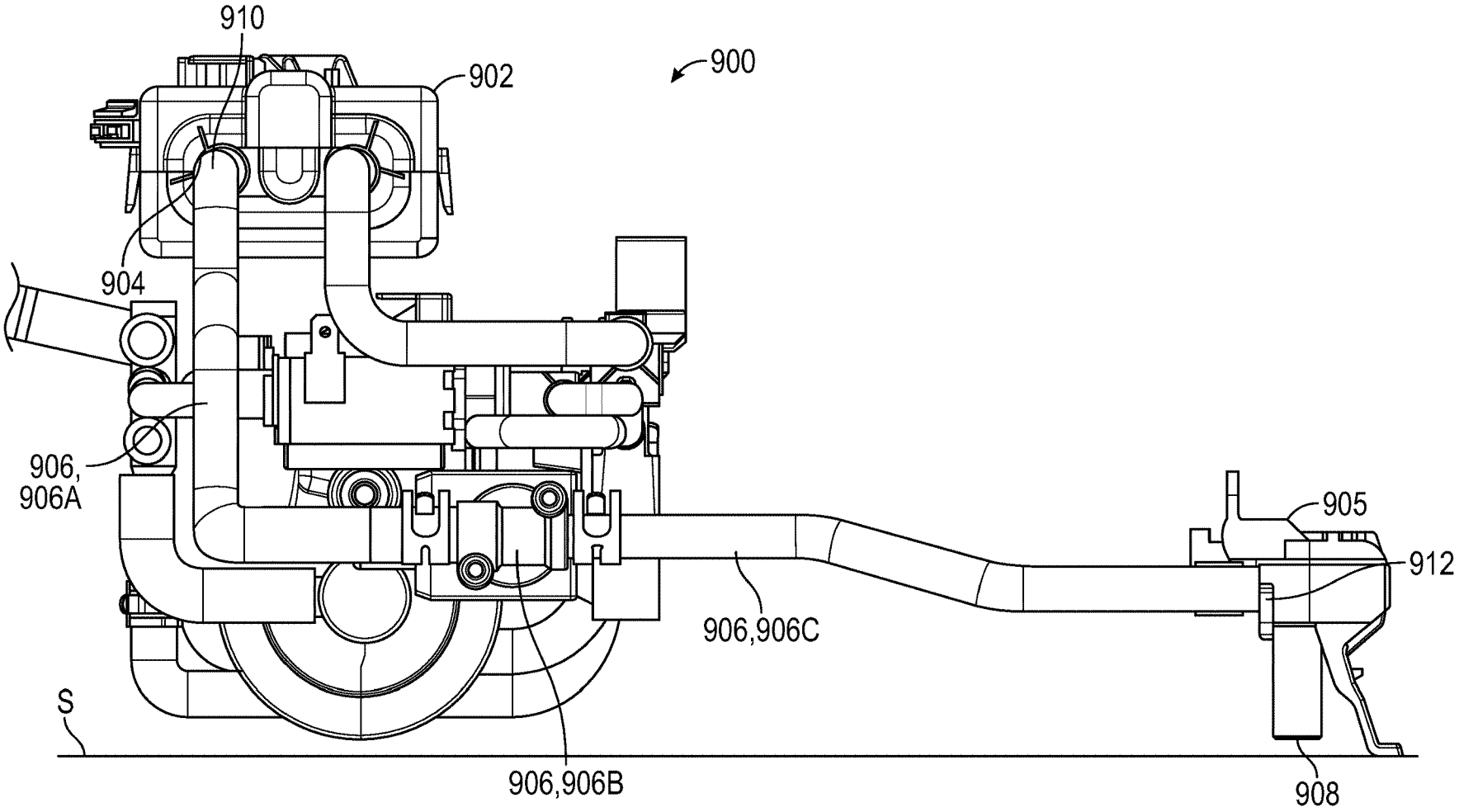
FIG. 45 is a fragmentary side view of a portion of a fluid dispensing system for the surface cleaner.
Figure 46:
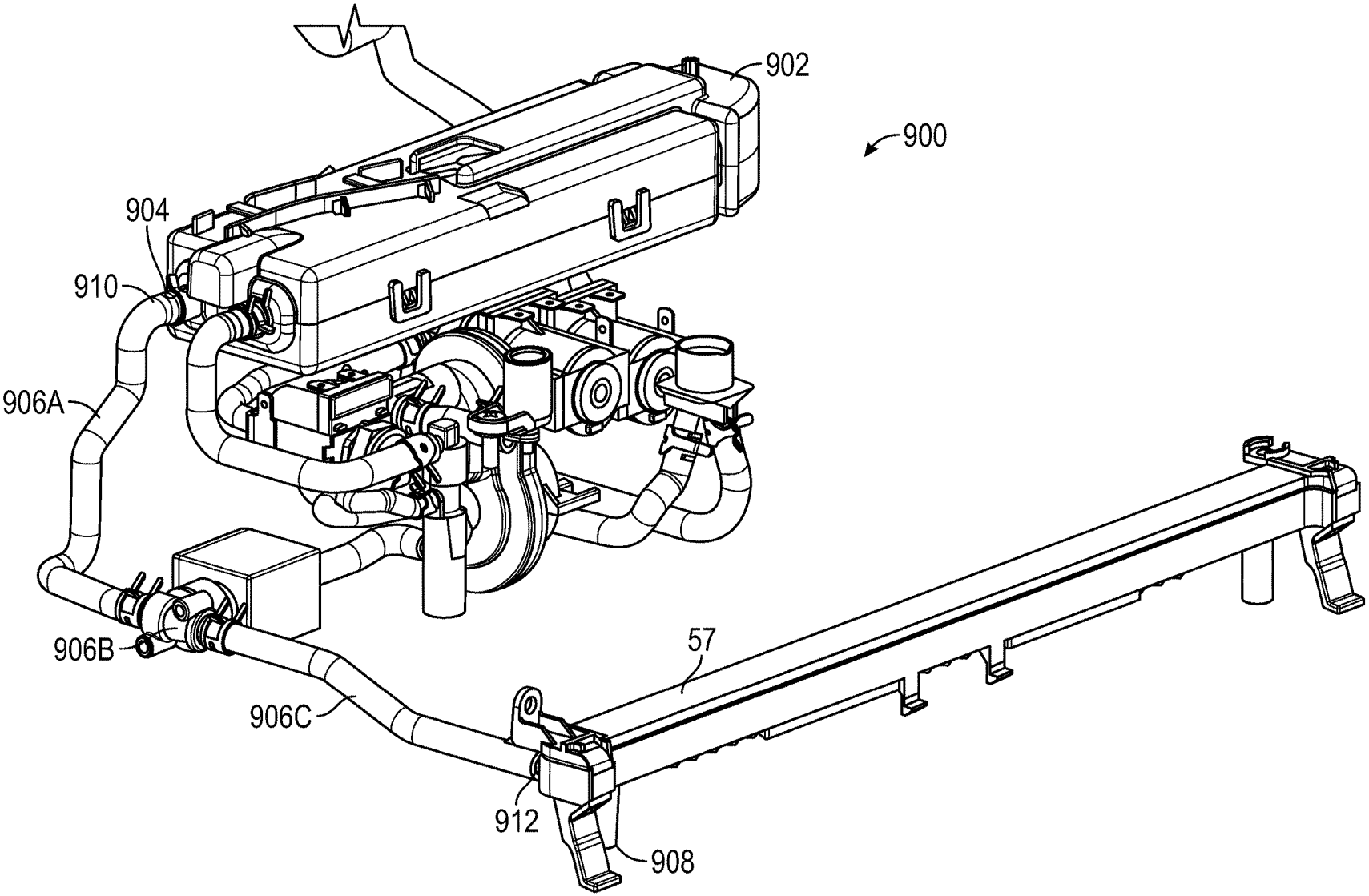
FIG. 46 is a fragmentary perspective view of the fluid dispensing system of FIG. 45.

FIG. 45 is a fragmentary side view of a portion of a fluid-dispensing system 900 that may be included in the surface cleaner 10, and FIG. 46 is a fragmentary perspective view of the fluid-dispensing system 900 of FIG. 45. In FIG. 45, the fluid-dispensing system 900 is shown in the position relative to the surface to be cleaned S that it is in when the base 12 is resting on the surface S as in FIG. 2 in a use position. The portion of the fluid-dispensing system 900 shown in FIGS. 45 and 46 may be housed mainly within the base housing 36 of FIG. 1, for example. The fluid-dispensing system 900 includes a heater 902 that generates steam. The fluid-dispensing system 900 is configured so that once the steam exits the heater 902, a conduit path 906 for routing the steam to a dispenser 905 at the surface S to be cleaned includes only horizontal or downwardly sloping portions (i.e., "downhill" portions), and is without any upwardly-sloping portions. With such a downhill configuration, there will not be an accumulation of water in the conduit path 906 resulting from cooled steam after the surface cleaner 10 is turned off, so cooled accumulated water will not be present in the fluid-dispensing system 900 when the surface cleaner 10 is subsequently powered on.

The heater 902 may be in fluid communication with the supply tank 26 and is operable to heat the liquid sufficiently to generate steam. The heater 902 has a steam outlet 904.

Steam travels from the steam outlet 904 to a dispenser 905 via a conduit path 906. The dispenser 905 has a dispenser outlet 908 through which the steam is distributed to the surface S to be cleaned. The dispenser 905 may be integrated into the manifold 57, as shown.

The conduit path 906 has a conduit inlet 910 at the steam outlet 904 of the heater 902 and a conduit outlet 912 at the dispenser 905. The conduit inlet 910 is disposed further above the surface S to be cleaned than the conduit outlet 912 when the base is resting on the surface S, such as when the surface cleaner 10 is in either the upright position or the reclined position as in FIG. 2.

The conduit path 906 may include any conduits such as ducts, tubing, hoses, connectors, valves, etc. that provide a route through which steam is directed from the heater 902 to the dispenser 905. In the implementation shown, the conduit path 906 includes an upper duct 906A, a valve assembly 906B, and a lower duct 906C. The conduit inlet 910 is an inlet to the upper duct 906A, and the conduit outlet 912 is an outlet of the lower duct 906C. The valve assembly 906B may be operatively connected to and controlled by user selection of a steam mode, for example, that opens the valve assembly to direct steam through the lower duct 906C to the dispenser 905. As best shown in FIG. 46, the upper duct 906A progresses downward with a series of vertical segments connected by downwardly-sloping or horizontal segments, without any segment sloping upward in the direction of flow from the conduit inlet 910 to the valve assembly 906B. Similarly, the lower duct 906C progresses downward with a series of horizontal segments connected by downwardly-sloping segments, without any segment sloping upwardly in the direction of flow from the valve assembly 906B to the conduit outlet 912. Stated differently, the flow of the steam along the conduit path 906 in a direction from the conduit inlet 910 to the conduit outlet 912 is without any upward slope as there are no upwardly-sloping portions of the conduit path 906. With such an arrangement, the steam has no opportunity to pool within the conduit path 906 when the surface cleaner 10 is turned off, avoiding any dispensing of cooled liquid in a subsequent selection of a steam dispensing mode.

The following Clauses provide example configurations of a surface cleaner and other articles disclosed herein.

Clause 1. A surface cleaner comprising: a base configured for movement across a surface to be cleaned, the base including a base housing defining an agitator chamber, an agitator assembly housed in the agitator chamber, and an agitator lift lever supported on the base housing and translatable relative to the base housing between a forward position and a rearward position; a spine assembly for directing the base across the surface to be cleaned, the spine assembly pivotably connected to the base and pivotable relative to the base about a pivot axis between a first position and a second position; wherein the agitator assembly includes an agitator support frame and a rotatable agitator rotatably supported on the agitator support frame; wherein the spine assembly is configured to operatively engage the lever and translate the lever from the forward position to the rearward position when the spine assembly is pivoted from the second position to the first position; an engagement mechanism secured to the agitator support frame and positioned to be pivoted by the agitator lift lever as the agitator lift lever translates to the rearward position, the pivoting engagement mechanism lifting the agitator support frame and the agitator secured thereto from a lowered position to a raised position, the agitator being further from the surface to be cleaned in the raised position than in the lowered position.

Clause 2. The surface cleaner of clause 1, further comprising: a spring engaged with the agitator lift lever and biasing the agitator lift lever to the forward position.

Clause 3. The surface cleaner of any of clauses 1-2, wherein: the engagement mechanism pivots about a pivot axis and includes a first arm projecting radially outward from the pivot axis and interfacing with the agitator lift lever.

Clause 4. The surface cleaner of any of clauses 1-3, wherein: the spine assembly further includes a lower shell and an engagement wheel mounted to the lower shell at the pivot axis and configured to be rotated by the lower shell about the pivot axis to; the engagement wheel includes a projection and the lever includes an arm; and the projection interfaces with the arm to translate the lever from the forward position to the rearward position when the spine assembly is pivoted from the second position to the first position.

Clause 5. The surface cleaner of any of clauses 1-4, wherein the spine assembly further includes a lower shell, and the surface cleaner further comprising: a detent mechanism configured to selectively retain the spine assembly in the first position, the detent mechanism including: a catch operatively secured to the lower shell; a pivot arm pivotably secured to the base housing; a spring biasing the pivot arm against the catch when the spine assembly is in the first position; and a release button mounted to the base housing and depressible against the pivot arm to pivot the pivot arm away from the catch and against the spring, releasing the pivot arm from the catch, allowing the spine assembly to be pivoted to the second position.

Clause 6. The surface cleaner of any of clauses 1-5, wherein the agitator assembly further includes a sprocket supported for rotation with the agitator about an agitator axis, and the surface cleaner further comprising: a drive assembly including a motor-driven shaft, a belt engaged with both the motor-driven shaft and with the sprocket for rotating the agitator about the agitator axis; a projection extending from the base housing in the agitator chamber and having a belt-engaging surface; wherein the belt is spaced apart from the belt-engaging surface when the agitator assembly is in the lowered position, and the belt is disposed against the belt-engaging surface when the agitator assembly is in the raised position.

Clause 7. The surface cleaner of clause 6, wherein the agitator support frame is pivotably connected to the base housing at an agitator support frame pivot axis disposed between the motor-driven shaft and the sprocket such that the agitator axis is closer to a rotational axis of the motor-driven shaft when the agitator assembly is in the raised position than when the agitator assembly is in the lowered position; and wherein the belt turns at the projection when the agitator assembly is in the raised position, the projection limiting slack in the belt.

Clause 8. The surface cleaner of clause 6, wherein the projection is a rotatable bearing and the belt rotates the bearing by contact with the belt-engaging surface.

Clause 9. The surface cleaner of clause 6, wherein the projection is fixed and the belt glides against the belt-engaging surface.

Clause 10. The surface cleaner of any of clauses 1-9, wherein the rotatable agitator is a first rotatable agitator, and the agitator assembly further includes a second rotatable agitator rotatably supported on the agitator support frame and disposed parallel to the first rotatable agitator.

Clause 11. A surface cleaner comprising: a base configured for movement across a surface to be cleaned, the base including a base housing defining an agitator chamber, and an agitator assembly housed in the agitator chamber; a spine assembly for directing the base across the surface to be cleaned, the spine assembly being pivotably connected to the base and pivotable relative to the base about a pivot axis between a first position and a second position; wherein the first position is relatively upright with respect to the base and the second position is relatively reclined with respect to the base; the agitator assembly including an agitator support frame, a rotatable agitator rotatably supported on the agitator support frame, and a sprocket supported for rotation with the rotatable agitator about an agitator axis; the agitator support frame and the rotatable agitator supported thereon lifting from a lowered position to a raised position when the spine assembly is pivoted from the second position to the first position, the rotatable agitator being further from the surface to be cleaned in the raised position than in the lowered position; a drive assembly including a motor-driven shaft, a belt engaged with both the motor-driven shaft and with the sprocket for rotating the rotatable agitator about the agitator axis; and a projection extending from the base housing in the agitator chamber and having a belt-engaging surface; wherein the belt is spaced apart from the belt-engaging surface when the agitator assembly is in the lowered position, and the belt is disposed against the belt-engaging surface when the agitator assembly is in the raised position.

Clause 12. The surface cleaner of clause 11, wherein the projection is a rotatable bearing and the belt rotates the bearing by contact with the belt-engaging surface.

Clause 13. The surface cleaner of clause 11, wherein the projection is fixed and the belt glides against the belt-engaging surface.

Clause 14. A surface cleaner comprising: a base configured for movement across a surface to be cleaned, the base including a base housing; a spine assembly for directing the base across the surface to be cleaned, the spine assembly being pivotably connected to the base and pivotable relative to the base about a pivot axis between a first position and a second position; wherein the first position is relatively upright with respect to the base and the second position is relatively reclined with respect to the base; wherein the spine assembly includes a lower shell; a detent mechanism configured to selectively retain the spine assembly in the first position, the detent mechanism including: a catch operatively secured to the lower shell; a pivot arm pivotably secured to the base housing; a spring biasing the pivot arm against the catch when the spine assembly is in the first position; and a release button mounted to the base housing and depressible against the pivot arm to pivot the pivot arm away from the catch and against the spring, thereby releasing the pivot arm from the catch, allowing the spine assembly to be pivoted to the second position.

Clause 15. The surface cleaner of clause 14, wherein: the base housing defines an internal cavity and includes a wall with an opening into the internal cavity; the pivot arm, the catch, and the spring are disposed within the internal cavity; and the release button translates along a center axis of the opening between a resting position and a depressed position.

Clause 16. The surface cleaner of clause 15, wherein the release button has a cap portion disposed outside of the internal cavity and an elongated body portion that extends from the cap portion through the opening and engages the pivot arm when in the depressed position; the cap portion is wider than the opening and has a perimeter flange that surrounds the wall of the base housing at the opening in both the resting position and the depressed position, creating a labyrinth interface between the cap portion and the base housing.

Clause 17. The surface cleaner of clause 16, wherein: the elongated body portion has an engagement end that depresses the pivot arm and a central opening at the engagement end, the central opening extending partway to the cap portion and surrounding a central post of the elongated body portion that extends toward the engagement end from the cap portion; the base housing includes spaced ribs; the central post slides between the spaced ribs when the release button translates; and the detent mechanism includes a stopper disposed at an end of the central post and configured to interfere with ends of the spaced ribs to prevent removal of the release button from the base housing.

Clause 18. The surface cleaner of clause 17, wherein the central post is threaded, and the stopper includes a fastener threaded to the central post and/or a washer captured at the end of the central post by the fastener.

Clause 19. The surface cleaner of any of clauses 15-18, wherein the opening faces generally upward.

Clause 20. A surface cleaner comprising: a base including a base housing defining an agitator chamber, and an agitator assembly supported by the base housing in the agitator chamber and including a rotatable agitator; a drive assembly operative for rotating the rotatable agitator about an agitator axis, the drive assembly including: a motor having a motor shaft defining a motor axis; an intermediate shaft disposed between the rotatable agitator and the motor shaft and defining an intermediate axis parallel to the agitator axis and the motor axis; a first bearing assembly and a second bearing assembly mounted to the base housing and rotatably supporting the intermediate shaft; a first belt operatively engaged with the intermediate shaft between the first bearing assembly and the second bearing assembly, and the first belt being operatively engaged with the motor shaft; and a second belt operatively engaged with the intermediate shaft at an end of the intermediate shaft with the first bearing assembly between the second belt and the first belt, and the second belt being operatively engaged with the rotatable agitator.

Clause 21. The surface cleaner of clause 20, wherein the first belt is a stretch belt and the second belt is a timing belt, and the surface cleaner further comprising: a first pulley disposed on the intermediate shaft between the first bearing assembly and the second bearing assembly, with the first belt engaged with the first pulley; a second pulley disposed at the end of the intermediate shaft, with the second belt engaged with the second pulley; and a sprocket disposed at an end of the rotatable agitator, with the second belt engaged with the sprocket; wherein the first pulley, the sprocket, and the second pulley effect a change in rotational speed of the rotatable agitator relative to the motor shaft.

Clause 22. The surface cleaner of any of clauses 20-21, the surface cleaner further comprising: a first pulley disposed on the intermediate shaft between the first bearing assembly and the second bearing assembly, with the first belt engaged with the first pulley; wherein the first bearing assembly includes: a bearing housing fixed to the base housing and surrounding the intermediate shaft, the bearing housing including a through hole through which the intermediate shaft extends; an annularly-mounted bearing holder supported by the bearing housing in a first wall of the bearing housing at the through hole and rotatable relative to the bearing housing, the annularly-mounted bearing holder having a slot; wherein the bearing housing has a window that extends to the through hole; and wherein the slot in the annularly-mounted bearing holder is in communication with the window during a portion of a rotation of the annularly-mounted bearing holder; and wherein the slot and the window are sized to permit the first belt to be routed around and engaged with the first pulley.

Clause 23. The surface cleaner of clause 22, wherein: the window is a first window, and the bearing housing has a second window spaced from the first window; and the first belt is engaged with the first pulley by insertion of the first belt through the slot and the first window, rotation of the annularly-mounted bearing holder to wrap the first belt around the first pulley, and withdrawal of the first belt through the second window.

Clause 24. The surface cleaner of clause 23, wherein: the first wall extends perpendicular to the intermediate axis, and the bearing housing further includes a second wall extending parallel with the intermediate axis and perpendicular to the first wall; the first window extends through both the first wall and the second wall; and the second window extends parallel with the intermediate axis and perpendicular to both the first wall and the second wall.

Clause 25. A surface cleaner comprising: a base configured for movement across a surface to be cleaned, the base including a base housing; a fluid-dispensing system operable for delivering fluid to the surface to be cleaned, the fluid-dispensing system including a centrifugal pump mounted in the base housing, the centrifugal pump including: a casing having an inlet through which fluid is drawn, an outlet through which fluid is discharged, a volute scroll in fluid communication with the inlet, an expansion chamber in communication with the outlet, a throat fluidly connecting the volute scroll with the expansion chamber, and a weep hole fluidly connecting the expansion chamber with the volute scroll; and an impeller configured to rotate in the volute scroll to pump fluid from the inlet to the outlet through the throat and the expansion chamber, with fluid in the expansion chamber separating from air in the expansion chamber and returning to the volute scroll through the weep hole, thereby priming the centrifugal pump.

Clause 26. The surface cleaner of clause 25, wherein a ratio of a cross-sectional area of the throat to a cross-sectional area of the outlet is about 1.44.

Clause 27. The surface cleaner of any of clauses 25-26, wherein a ratio of a volume of the volute scroll to a cross-sectional area of the outlet is about 182.

Clause 28. The surface cleaner of any of clauses 25-27, wherein the base housing defines an agitator chamber, and the base further includes an agitator assembly supported by the base housing in the agitator chamber, the agitator assembly including a rotatable agitator; the surface cleaner further including a drive assembly operative for rotating the rotatable agitator about an agitator axis, the drive assembly including: a motor having a motor shaft defining a motor axis; an intermediate shaft disposed between the rotatable agitator and the motor shaft and defining an intermediate axis parallel to the agitator axis and the motor axis; a first belt operatively engaged with the intermediate shaft and with the motor shaft; a second belt operatively engaged with the intermediate shaft and with the rotatable agitator; and wherein the impeller is driven by the intermediate shaft.

Clause 29. A surface cleaner comprising: a fluid-dispensing system operable for delivering fluid to a surface to be cleaned, the fluid-dispensing system including: a fluid supply; an electric motor; a centrifugal pump configured to be driven by the electric motor and having an inlet and an outlet; wherein the inlet is in fluid communication with the fluid supply; a pump control switch operatively connected to the centrifugal pump, the pump control switch having an on state and an off state; wherein the centrifugal pump is off when the pump control switch is in the off state, and the centrifugal pump is on when the pump control switch is in the on state; and a pressure valve in fluid communication with the outlet, the pressure valve having a first flow area under fluid pressure less than a predetermined fluid pressure, and a second flow area greater than the first flow area under fluid pressure greater than or equal to the predetermined fluid pressure; wherein the fluid pressure at the pressure valve is less than the predetermined fluid pressure when the centrifugal pump is off, and is greater than or equal to the predetermined fluid pressure when the centrifugal pump is on; and wherein fluid from the fluid supply drains through the centrifugal pump to reach the pressure valve when the pump control switch is in the off state.

Clause 30. The surface cleaner of clause 29, wherein the fluid-dispensing system further includes: a solenoid valve downstream of the pressure valve, the solenoid valve having an energized state in which fluid flows through the solenoid valve, and a deenergized state in which the solenoid valve blocks fluid flow; a trigger operable to select the energized state of the solenoid valve.

Clause 31. The surface cleaner of clause 30, further comprising: a fluid application device downstream of the solenoid valve and operable for applying fluid to the surface to be cleaned; and wherein fluid flows to the fluid application device when the solenoid valve is in the energized state.

Clause 32. A clean-out system for use in cleaning out an agitator assembly of a surface cleaner, the clean-out system comprising: a docking tray defining a reservoir and a filling trough, with a wall of the docking tray separating the reservoir from the filling trough; wherein the surface cleaner includes a base configured for movement across a surface to be cleaned, the base including an agitator assembly, and the docking tray is configured to support the base with the agitator assembly disposed at the reservoir; wherein the docking tray defines a channel extending through the wall and connecting the reservoir with the filling trough, and the docking tray is configured such that fluid poured into the filling trough flows into the reservoir through the channel.

Clause 33. The clean-out system of clause 32, wherein a bottom surface of the docking tray in the reservoir angles downward from a rear of the reservoir to a front of the reservoir such that fluid in the docking tray pools at a front of the reservoir.

Clause 34. The clean-out system of any of clauses 32-33, wherein the reservoir extends further forward than the filling trough.

Clause 35. The clean-out system of any of clauses 32-34, wherein the filling trough extends along a side of the reservoir with the channel at a front of the filling trough.

Clause 36. The clean-out system of any of clauses 32-34 in combination with a surface cleaner having the base including a base housing defining an agitator chamber, and the agitator assembly supported by the base housing in the agitator chamber and including a rotatable agitator.

Clause 37. The clean-out system in combination with the surface cleaner of clause 36, wherein the surface cleaner further comprises a spine assembly for directing the base across the surface to be cleaned, the spine assembly pivotably connected to the base and pivotable relative to the base about a pivot axis between a first position and a second position; wherein the first position is relatively upright with respect to the base and the second position is relatively reclined with respect to the base; and wherein the rotatable agitator is lifted when the spine assembly is in the first position.

Clause 38. A surface cleaner comprising: a base configured for movement across a surface to be cleaned; a spine assembly operatively connected to the base for directing the base across the surface to be cleaned; wherein the spine assembly includes a frame having an aperture; a recovery tank for collecting liquid received from a mixed air and liquid stream generated in the base, the recovery tank having a bottom wall, a plurality of side walls extending upward from the bottom wall, and defining a tank chamber with a top opening; a lid securable to the recovery tank to extend over the top opening, the lid having a top wall with a top window and a side wall with a side window; a handle pivotably connected to the lid and pivotable between a lowered position and a lifted position; and a spring-biased mounting mechanism operable to selectively secure the lid to the frame, the spring-biased mounting mechanism including a body having a top projection extending upward through the top window and biased to an extended position, and a side arm extending sideways through the side window; wherein the recovery tank is configured to fit to the frame with the lid secured to the recovery tank and the top projection extending in the aperture of the frame when the handle is in the lifted position; and wherein the handle interferes with the side arm when pivoted to the lowered position, moving the side arm downward in the side window and simultaneously moving the top projection downward through the top window to withdraw the top projection from the aperture and allow the recovery tank to be removed from the frame.

Clause 39. The surface cleaner of clause 38, wherein: the aperture is a first aperture, the side window is a first side window in a first side wall of the lid, the top window is a first top window, the top projection is a first top projection, and the side arm is a first side arm; the frame includes a second aperture spaced apart from the first aperture, the lid includes a second side wall opposite from the first side wall of the lid and having a second side window; the lid includes a second top window spaced apart from the first top window; the body of the spring-biased mounting mechanism further includes a second top projection and a second side arm, the second top projection spaced apart from the first top projection and extending upward through the second top window and biased to an extended position, and the second side arm extending opposite from the first side arm through the second side window; and the handle interferes with the second side arm when pivoted to the lowered position, moving the second side arm downward in the second side window and simultaneously moving the second top projection downward through the second top window to withdraw the second top projection from the second aperture.

Clause 40. The surface cleaner of any of clauses 38-39, wherein the top projection is received in the aperture when a liquid/air mixture inlet in a bottom wall of the recovery tank is aligned with a recovery conduit outlet in the base and a separated air outlet in the bottom wall of the recovery tank is aligned with a motor conduit inlet in the base.

Clause 41. A surface cleaner comprising: a base configured for movement across a surface to be cleaned; and an air/liquid separation system including: a recovery tank for collecting liquid received from a mixed air and liquid stream generated in the base, the recovery tank having a bottom wall, a plurality of side walls extending upward from the bottom wall, and defining a tank chamber with a top opening; a lid securable to the recovery tank to extend over the top opening; a plurality of vertical walls disposed within the tank chamber and defining an inlet stack and an outlet stack; and a float disposed within the tank chamber and operatively attached to and vertically translatable relative to the lid; wherein the bottom wall has an inlet opening at a bottom of the inlet stack through which the mixed air and liquid stream is introduced and an outlet opening at a bottom of the outlet stack through which separated air is discharged from the recovery tank; wherein the lid includes a top wall and a bottom wall with a lid chamber therebetween, the bottom wall having a first lid chamber opening in selective fluid communication with the tank chamber and serving as a tank chamber air outlet, and a second lid chamber opening at an inlet of the outlet stack; wherein the float is configured to close the first lid chamber opening when liquid within the tank chamber reaches a predetermined level; and wherein the lid and attached float are removable from the recovery tank as a unit, with the plurality of vertical walls that define the inlet stack and the outlet stack remaining in the tank chamber when the lid and attached float are removed.

Clause 42. The surface cleaner of clause 41, wherein the first lid chamber opening is disposed higher in the tank chamber than the outlet of the inlet stack and higher than the inlet of the outlet stack.

Clause 43. The surface cleaner of any of clauses 41-42, wherein the inlet stack is disposed rearward of the outlet stack, and the first lid chamber opening is disposed forward of the outlet stack.

Clause 44. The surface cleaner of any of clauses 41-42, wherein the lid includes a baffle disposed over the outlet of the inlet stack.

Clause 45. The surface cleaner of clause 44, wherein the baffle is configured as an inverted channel.

Clause 46. The surface cleaner of any of clauses 41-42, wherein the float is disposed forward of the outlet stack and the outlet stack is disposed forward of the inlet stack.

Clause 47. A surface cleaner including a base configured for movement across a surface to be cleaned, the surface cleaner comprising: a fluid-dispensing system operable for delivering fluid to the surface to be cleaned, the fluid-dispensing system including: a heater operable for generating steam and having a steam outlet; a dispenser having a dispenser outlet through which the steam is distributed to the surface to be cleaned; and a conduit path through which the steam travels from the steam outlet to the dispenser; wherein the conduit path has a conduit inlet at the steam outlet of the heater and a conduit outlet at the dispenser, and the conduit inlet is disposed further above the surface to be cleaned than the conduit outlet when the base is resting on the surface to be cleaned in a use position.

Clause 48. The surface cleaner of clause 47, wherein flow along the conduit path in a direction from the conduit inlet to the conduit outlet is without any upward slope.

To assist and clarify the description of various embodiments, various terms are defined herein. Unless otherwise indicated, the following definitions apply throughout this specification (including the claims). Additionally, all references referred to are incorporated herein in their entirety.

"A", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

For consistency and convenience, directional adjectives may be employed throughout this detailed description corresponding to the illustrated embodiments. Those having ordinary skill in the art will recognize that terms such as "above", "below", "upward", "downward", "top", "bottom", etc., may be used descriptively relative to the figures, without representing limitations on the scope of the invention, as defined by the claims.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative and exemplary of the entire range of alternative embodiments that an ordinarily skilled artisan would recognize as implied by, structurally and/or functionally equivalent to, or otherwise rendered obvious based upon the included content, and not as limited solely to those explicitly depicted and/or described embodiments.

What is claimed is:

1. A surface cleaner comprising:

a base configured for movement across a surface to be cleaned, the base including a base housing defining an agitator chamber, an agitator assembly housed in the agitator chamber, and an agitator lift lever supported on the base housing and translatable relative to the base housing between a forward position and a rearward position;

a spine assembly for directing the base across the surface to be cleaned, the spine assembly pivotably connected to the base and pivotable relative to the base about a pivot axis between a first position and a second position; wherein the agitator assembly includes an agitator support frame and a rotatable agitator rotatably supported on the agitator support frame;

wherein the spine assembly is configured to operatively engage the lever and translate the lever from the forward position to the rearward position when the spine assembly is pivoted from the second position to the first position; and an engagement mechanism secured to the agitator support frame and positioned to be pivoted by the agitator lift lever as the agitator lift lever translates to the rearward position, the pivoting engagement mechanism lifting the agitator support frame and the agitator secured thereto from a lowered position to a raised position, the agitator being further from the surface to be cleaned in the raised position than in the lowered position; wherein a lower edge of the agitator lift lever rests on the engagement mechanism.

2. The surface cleaner of claim 1, further comprising:

a spring engaged with the agitator lift lever and biasing the agitator lift lever to the forward position.

3. The surface cleaner of claim 1, wherein:

the engagement mechanism pivots about a pivot axis and includes a first arm projecting radially outward from the pivot axis and interfacing with the agitator lift lever.

4. The surface cleaner of claim 1, wherein:

the spine assembly further includes a lower shell and an engagement wheel mounted to the lower shell at the pivot axis and configured to be rotated by the lower shell about the pivot axis;

the engagement wheel includes a projection and the lever includes an arm; and the projection interfaces with the arm to translate the lever from the forward position to the rearward position when the spine assembly is pivoted from the second position to the first position.

5. A surface cleaner comprising:

a base configured for movement across a surface to be cleaned, the base including a base housing defining an agitator chamber, an agitator assembly housed in the agitator chamber, and an agitator lift lever supported on the base housing and translatable relative to the base housing between a forward position and a rearward position;

a spine assembly for directing the base across the surface to be cleaned, the spine assembly pivotably connected to the base and pivotable relative to the base about a pivot axis between a first position and a second position;

wherein the spine assembly includes a lower shell;

wherein the agitator assembly includes an agitator support frame and a rotatable agitator rotatably supported on the agitator support frame;

wherein the spine assembly is configured to operatively engage the lever and translate the lever from the forward position to the rearward position when the spine assembly is pivoted from the second position to the first position;

an engagement mechanism secured to the agitator support frame and positioned to be pivoted by the agitator lift lever as the agitator lift lever translates to the rearward position, the pivoting engagement mechanism lifting the agitator support frame and the agitator secured thereto from a lowered position to a raised position, the agitator being further from the surface to be cleaned in the raised position than in the lowered position; and a detent mechanism configured to selectively retain the spine assembly in the first position, the detent mechanism including:

a catch operatively secured to the lower shell;

a pivot arm pivotably secured to the base housing;

a spring biasing the pivot arm against the catch when the spine assembly is in the first position; and a release button mounted to the base housing and depressible against the pivot arm to pivot the pivot arm away from the catch and against the spring, releasing the pivot arm from the catch, allowing the spine assembly to be pivoted to the second position.

6. The surface cleaner of claim 5, wherein:

the base housing defines an internal cavity and includes a wall with an opening into the internal cavity;

the pivot arm, the catch, and the spring are disposed within the internal cavity; and the release button translates along a center axis of the opening between a resting position and a depressed position.

7. The surface cleaner of claim 6, wherein:

the release button has a cap portion disposed outside of the internal cavity and an elongated body portion that extends from the cap portion through the opening and engages the pivot arm when in the depressed position;

the cap portion is wider than the opening and has a perimeter flange that surrounds the wall of the base housing at the opening in both the resting position and the depressed position, creating a labyrinth interface between the cap portion and the base housing.

8. The surface cleaner of claim 7, wherein:

the elongated body portion has an engagement end that depresses the pivot arm and a central opening at the engagement end, the central opening extending partway to the cap portion and surrounding a central post of the elongated body portion that extends toward the engagement end from the cap portion;

the base housing includes spaced ribs;

the central post slides between the spaced ribs when the release button translates; and the detent mechanism includes a stopper disposed at an end of the central post and configured to interfere with ends of the spaced ribs to prevent removal of the release button from the base housing.

9. The surface cleaner of claim 8, wherein the central post is threaded, and the stopper includes a fastener threaded to the central post and/or a washer captured at the end of the central post by the fastener.

10. The surface cleaner of claim 6, wherein the opening faces generally upward.

11. A surface cleaner comprising:

a base configured for movement across a surface to be cleaned, the base including a base housing defining an agitator chamber, an agitator assembly housed in the agitator chamber, and an agitator lift lever supported on the base housing and translatable relative to the base housing between a forward position and a rearward position;

wherein the agitator assembly includes a sprocket supported for rotation with the agitator about an agitator axis;

a spine assembly for directing the base across the surface to be cleaned, the spine assembly pivotably connected to the base and pivotable relative to the base about a pivot axis between a first position and a second position; wherein the agitator assembly includes an agitator support frame and a rotatable agitator rotatably supported on the agitator support frame;

wherein the spine assembly is configured to operatively engage the lever and translate the lever from the forward position to the rearward position when the spine assembly is pivoted from the second position to the first position;

an engagement mechanism secured to the agitator support frame and positioned to be pivoted by the agitator lift lever as the agitator lift lever translates to the rearward position, the pivoting engagement mechanism lifting the agitator support frame and the agitator secured thereto from a lowered position to a raised position, the agitator being further from the surface to be cleaned in the raised position than in the lowered position;

a drive assembly including a motor-driven shaft, a belt engaged with both the motor-driven shaft and with the sprocket for rotating the agitator about the agitator axis; and a projection extending from the base housing in the agitator chamber and having a belt-engaging surface; wherein the belt is spaced apart from the belt-engaging surface when the agitator assembly is in the lowered position, and the belt is disposed against the belt-engaging surface when the agitator assembly is in the raised position.

12. The surface cleaner of claim 11, wherein the agitator support frame is pivotably connected to the base housing at an agitator support frame pivot axis disposed between the motor-driven shaft and the sprocket such that the agitator axis is closer to a rotational axis of the motor-driven shaft when the agitator assembly is in the raised position than when the agitator assembly is in the lowered position; and wherein the belt turns at the projection when the agitator assembly is in the raised position, the projection limiting slack in the belt.

13. The surface cleaner of claim 11, wherein the projection is a rotatable bearing and the belt rotates the bearing by contact with the belt-engaging surface.

14. The surface cleaner of claim 11, wherein the projection is fixed and the belt glides against the belt-engaging surface.

15. The surface cleaner of claim 1, wherein the rotatable agitator is a first rotatable agitator, and the agitator assembly further includes a second rotatable agitator rotatably supported on the agitator support frame and disposed parallel to the first rotatable agitator.

* * * * *